US012678859B2

(12) United States Patent
Anderson et al.

(10) Patent No.: US 12,678,859 B2
(45) Date of Patent: Jul. 14, 2026

(54) POWDER SATELLITE-REDUCTION APPARATUS AND METHOD FOR GAS ATOMIZATION PROCESS

(71) Applicant: Iowa State University Research Foundation, Inc., Ames, IA (US)

(72) Inventors: Iver E. Anderson, Ames, IA (US); Jordan A. Tiarks, Ames, IA (US); Timothy E. Prost, Ames, IA (US); Bo Kong, Ames, IA (US); Emma H. White, Ames, IA (US); Trevor M. Riedemann, Ames, IA (US); Eric J. Deaton, Ames, IA (US); Ross Anderson, Ames, IA (US); David Byrd, Ames, IA (US); Franz Hugolino Hernandez Gaitan, Ames, IA (US)

(73) Assignee: Iowa State University Research Foundation, Inc., Ames, IA (US)

( * ) Notice: Subject to any disclaimer, the term of this patent is extended or adjusted under 35 U.S.C. 154(b) by 0 days.

(21) Appl. No.: 18/465,392

(22) Filed: Sep. 12, 2023

(65) Prior Publication Data

US 2024/0058864 A1 Feb. 22, 2024

Related U.S. Application Data

(63) Continuation of application No. 17/304,586, filed on Jun. 23, 2021, now Pat. No. 11,780,012.
(Continued)

(51) Int. Cl.
*B22F 9/08* (2006.01)
*B22F 1/052* (2022.01)

(52) U.S. Cl.
CPC ..... *B22F 9/082* (2013.01); *B22F 1/052* (2022.01); *B22F 2009/0824* (2013.01); *B22F 2009/0832* (2013.01); *B22F 2009/0896* (2013.01)

(58) Field of Classification Search
None
See application file for complete search history.

(56) References Cited

U.S. PATENT DOCUMENTS 4,233,007 A 11/1980 Karlsson
4,416,600 A 11/1983 Lecznar et al.
(Continued)

FOREIGN PATENT DOCUMENTS

CA 3010486 A1 2/2019
CN 111230132 A 6/2020
(Continued)

OTHER PUBLICATIONS

Motaman, S. et al., "Numerical and experimental modelling of back stream flow during close-coupled gas atomization", Computers & Fluids, vol. 88, pp. 1-10, Available online Aug. 29, 2013.*
(Continued)

*Primary Examiner* — David C Mellon
(74) *Attorney, Agent, or Firm* — McKee, Voorhees & Sease, PLC

(57) ABSTRACT

The broad applicability of at least certain aspects of the present invention derives from the ability to determine the critical location where secondary satellite formation occurs for any atomization system or design and allows for the rapid assessment of the effectiveness of various satellite reduction strategies, including but not limited to several embodiments detailed herein. Aspects of this invention can be utilized during initial atomization system design in order to evaluate effective chamber geometries and enabling strat-
(Continued)

egies which reduce/eliminate satelliting, or can be retrofit to existing systems and allows for economic evaluation of effectiveness based off of initial capital expenditures versus increased operating requirements/expenses.

17 Claims, 32 Drawing Sheets
(27 of 32 Drawing Sheet(s) Filed in Color)

Related U.S. Application Data

(60) Provisional application No. 62/705,347, filed on Jun. 23, 2020.

(56) References Cited

U.S. PATENT DOCUMENTS

| | | | |
|---|---|---|---|
| 4,619,597 | A | 10/1986 | Miller |
| 5,125,574 | A | 6/1992 | Anderson et al. |
| 5,228,620 | A | 7/1993 | Anderson et al. |
| 6,142,382 | A | 11/2000 | Ting et al. |
| 8,756,040 | B2 | 6/2014 | Cruz |
| 8,775,220 | B2 | 7/2014 | Maher |
| 9,718,131 | B2 | 8/2017 | Boulos et al. |
| 9,981,315 | B2 | 5/2018 | Rieken et al. |
| 2002/0125591 | A1 | 9/2002 | Jaynes et al. |
| 2008/0271568 | A1 | 11/2008 | Dunkley |
| 2013/0053796 | A1 | 2/2013 | Robinson et al. |
| 2014/0212820 | A1 | 7/2014 | Colannino et al. |
| 2018/0133793 | A1 | 5/2018 | Heidloff et al. |
| 2018/0260499 | A1 | 9/2018 | Fusco et al. |
| 2019/0193164 | A1* | 6/2019 | St-Laurent ..... B01J 2/06 |
| 2022/0219235 | A1 | 7/2022 | Dopler et al. |
| 2023/0063056 | A1* | 3/2023 | Kenworthy ..... B22F 9/082 |
| 2024/0100596 | A1* | 3/2024 | Nadimpalli ..... B22F 1/052 |
| 2024/0139818 | A1* | 5/2024 | Zelina ..... B22F 12/82 |

FOREIGN PATENT DOCUMENTS

| | | | | |
|---|---|---|---|---|
| CN | 112199902 | A | * | 1/2021 |
| EP | 0444767 | A2 | | 1/1991 |
| WO | 9201822 | A1 | | 2/1992 |
| WO | 2019232612 | A1 | | 12/2019 |

OTHER PUBLICATIONS

English translation of CN 112199902 (originally published Jan. 8, 2021), obtained from PE2E search.*

Dawes et al., "Introduction to the Additive Manufacturing Powder Metallurgy Supply Chain", Johnson Matthey Technology Review, vol. 59, No. 3, pp. 243-256, 2015.

* cited by examiner (From Dunkley and Telford, 2002---see [8] of bibliography)

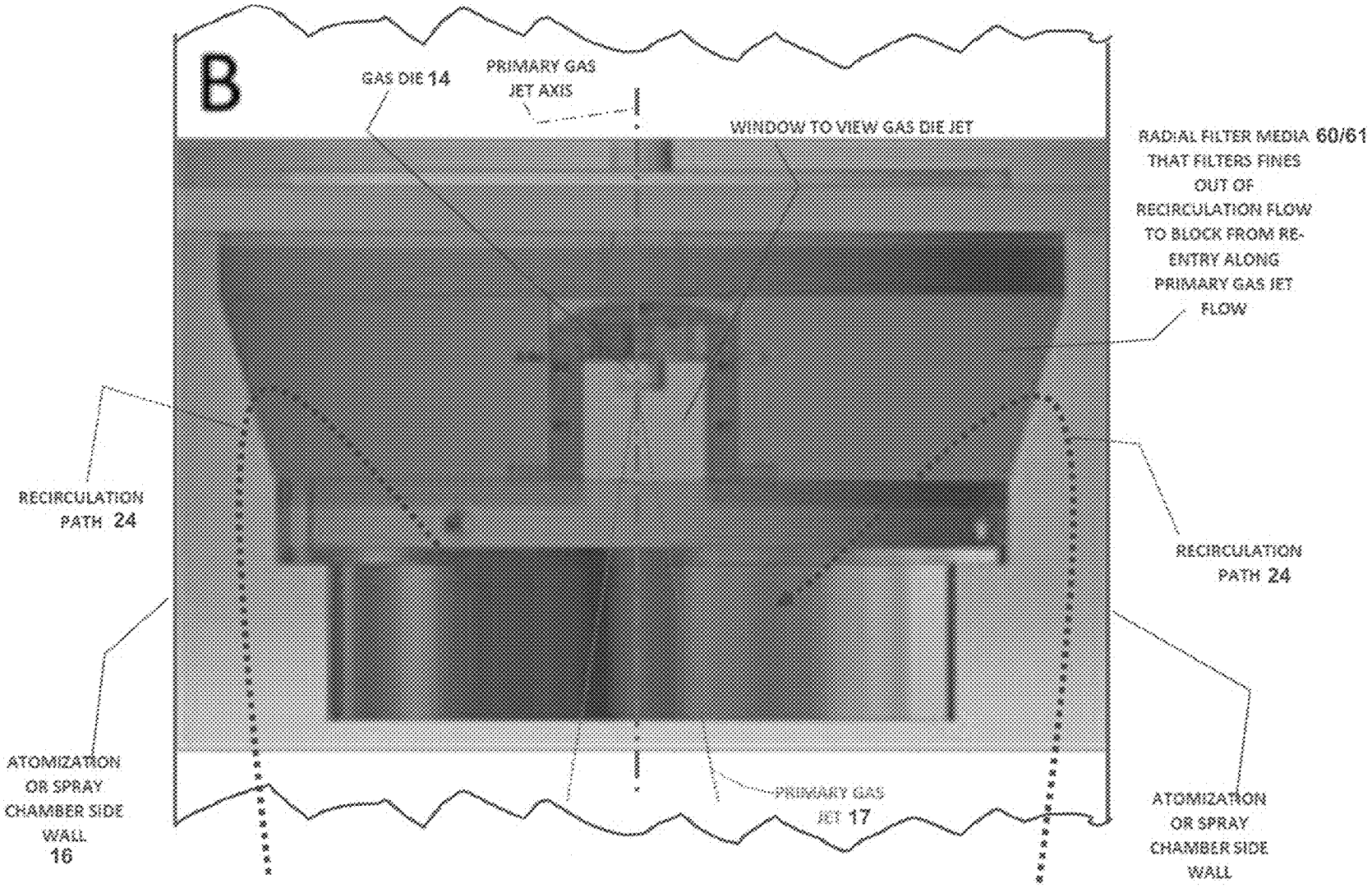
FIG. 12B (ENLARGED ELEVATION VIEW)

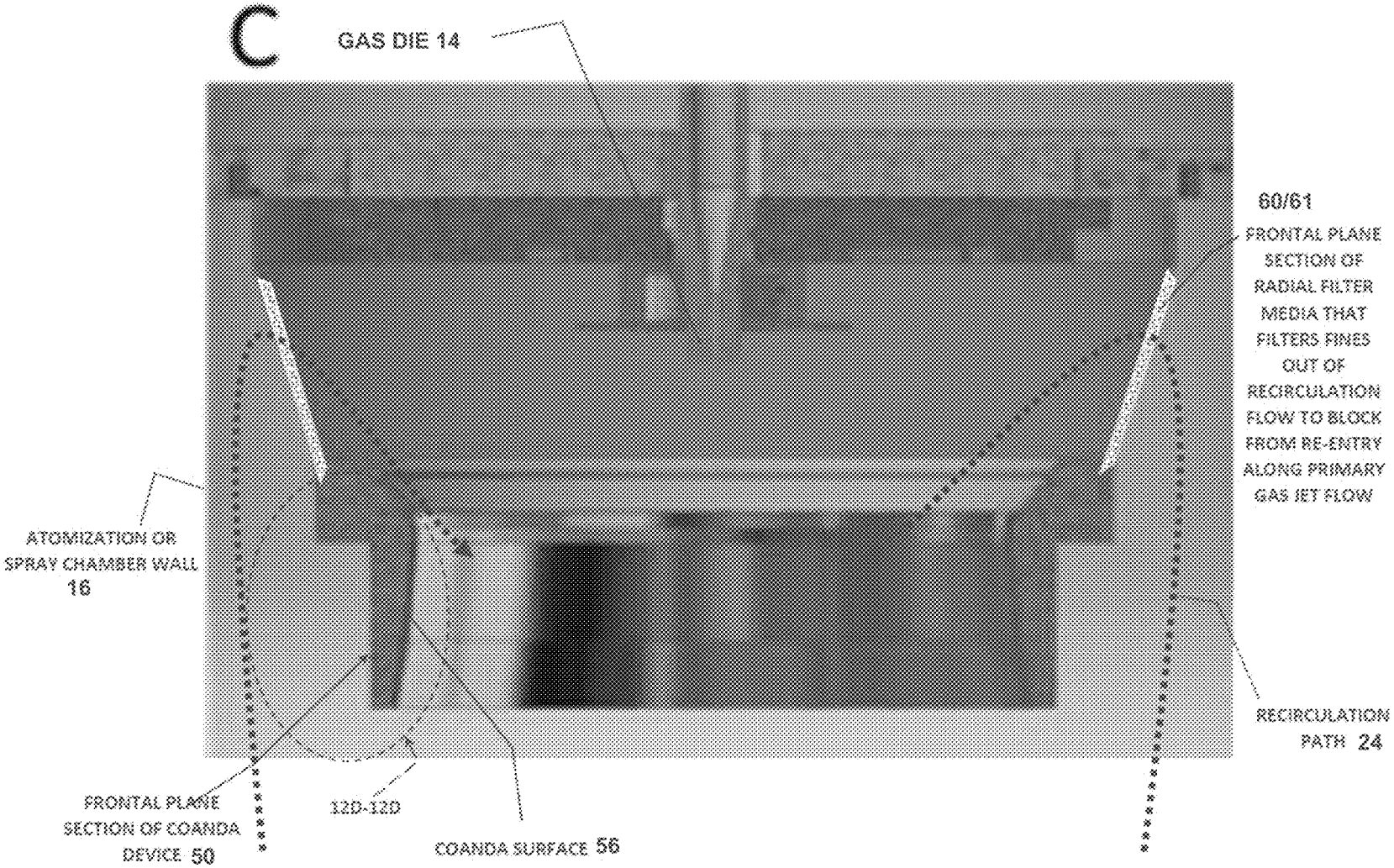
FIG. 12C (FRONTAL PLANE SECTIONAL OF FIG. 12B)

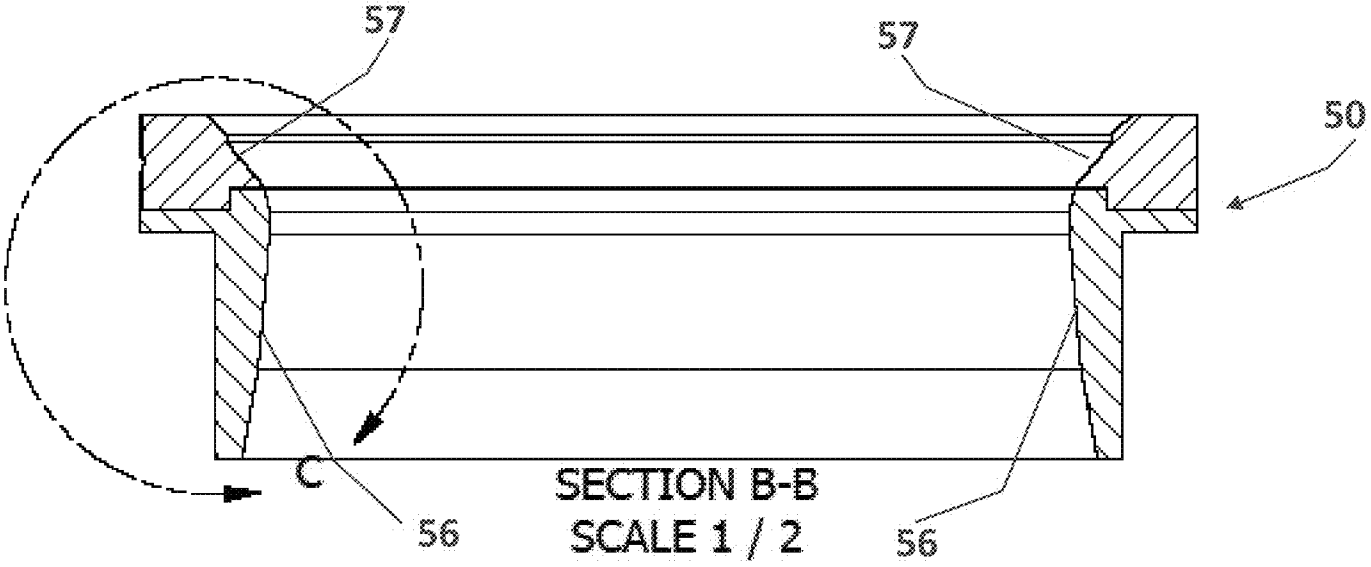
FIG. 12D (FRONTAL PLANE OF COANDA DEVICE)

POWDER SATELLITE-REDUCTION APPARATUS AND METHOD FOR GAS ATOMIZATION PROCESS

CROSS REFERENCE TO RELATED APPLICATIONS

This application is a divisional of U.S. Ser. No. 17/304,586 filed Jun. 23, 2021, which claims priority under 35 U.S.C. § 119 to Provisional Application U.S. Ser. No. 62/705,347 filed on Jun. 23, 2020, both of which are herein incorporated by reference in their entireties.

GOVERNMENT RIGHTS

This invention was made with Government support under the U.S. Department of Energy (DOE) This Contract Number DE-AC02-07CH11358. The government has certain rights in the invention.

I. BACKGROUND OF THE INVENTION

A. Field of the Invention

The present invention relates to the reduction or elimination of small, weld-attached satellite particles on the surface of gas atomized powders that are formed by contact of pre-solidified particles, typically smaller, with molten or partially solidified droplets in the spray chamber during gas atomization (GA). Non-limiting examples are embodied in several non-limiting apparatuses which were developed using a system-agnostic methodology. These disclosed exemplary apparatuses are useful for producing precision powder feedstocks that are used across the powder industry, and are able to meet the strict requirements of powder quality, primarily flowability, necessary for metal additive manufacturing (AM). A description of this method is also disclosed that is capable of analyzing an individual GA system and developing an appropriate satellite reduction apparatus and strategy based on operational and capital expense considerations.

B. Problems in the State of the Art

Additive manufacturing (AM) is an extremely active area of materials and manufacturing sciences research due to its promise to open up considerable design space and to precipitate a revolution in complex shape manufacturing. While the technical barriers for AM of polymeric materials are quickly being overcome, additive manufacturing of metallic alloys remains challenging. Material feedstocks for metal AM range from sheet to wire and powder and methods for consolidation by AM vary in at least as many ways. Fabrication methods based on metal powder exhibit the most flexibility and have been widely adopted into many industries. A spherical powder shape is preferred in high quality metallic feedstock powders for the powder bed fusion (PBF) types of AM to enhance flowability, layer spreading, and loose powder packing, where either a high-power laser or an electron beam are the heat source for the highly localized melting and solidification processes that are used to add to the AM "build." Directed energy deposition (DED) processes for AM that typically use a gas-borne powder feeder and laser melting are more tolerant of fragmented powder shapes, but smooth spherical powder also is preferred for DED to maintain a constant powder feed (i.e. mass flow rate) into the highly localized fusion zone.

As is well-known to those skilled in this technical area, PBF methods use either a laser or electron beam to melt locally and solidify a sequence of thin layers of feedstock powders together as they are spread across the build area, thereby incrementally building three-dimensional (3D) objects. The heat source is applied to particles contained within each incrementally added powder layer of a powder bed, which gradually indexes down before each layer of fresh powder is spread over the build area.

While some defects that occur during a build are build parameter or alloy design related and can be minimized or healed by post-processing, e.g., hot isostatic pressing (HIP) and/or annealing, many defects related to porosity have their origin in other "quality" attributes of powder feedstock and cannot be truly eliminated by these methods. Limits on fatigue strength and fracture toughness due to residual voids in the build are probably the most important type of microstructural defect that must be avoided for wide acceptance of critical parts made by AM, especially parts for high temperature applications [1, 2, 3, 4 of Bibliography, infra]. Thus, it is typically total void volume, void size distribution, and void shape that are characterized in detailed studies of AM build samples in an attempt to recognize an optimum "minimum void" condition [3 of Bibliography, infra]. One type of problematic (larger) porosity in AM builds can result from powder that has attached "satellites" or projections [5 of Bibliography, infra] that prevent smooth flowability and impede uniform powder layer formation during spreading of successive powder layers. FIG. 1A of the appended Drawings illustrates typical satellite content from commercially available nickel-based powders produced by gas atomization (GA) (Commercial A, B, C powders), compared with the much more expensive, satellite free powders produced via plasma rotating electrode process (PREP). In each frame of FIG. 1A, an example of a powder particle is indicated generally at "P" and satellite at "S". The images show numerous satellites S on Frames A-C, but little or none in Frame D. The large "built-in" pores attributed to satellite-originated voiding also may contain trapped hydrogen from decomposition of powder surfaces with physi-sorbed water molecules or chemi-sorbed hydroxides [6] during AM processing in comparison to alloy-dependent pores of very small size (pore dia.<<5% of powder dia.). This microporosity often results from trapped interdendritic solidification shrinkage, which is related to impeded alloy liquid feeding through a wide alloy "mushy" zone (liquid+solid) range. This mode of pore formation is also more apparent in coarser powders due to slower solidification rate [7 of Bibliography, infra], but do not typically present a problem in build microstructures, especially if healed by HIP.

Gas atomization has been identified as the leading production method for AM powders with sufficient capacity to meet the high market demand and the potential to meet tight requirements for AM metal powder feedstocks at a low cost of production, if sufficient process improvements can be made. Current commercial GA practices include free fall (FF-GA), which inherently lacks the means to improve particle size control, and close-coupled (CC-GA), which often operates within a limited (conventional/historical) set of parameters. Currently, a lack of fundamental gas atomization knowledge that can be implemented in CC-GA process control significantly limits powder manufacturers that employ CC-GA gas-dies from increasing their process yields and improving powder quality characteristics that are most useful for AM.

Extensive development of a discrete jet version of CC-GA, often termed high pressure gas atomization (HPGA), has been spearheaded by the inventors' group for several decades as illustrated by U.S. Pat. No. 5,125,574 issued Jun. 30, 1992; U.S. Pat. No. 5,228,620 issued Jul. 20, 1993; U.S. Pat. No. 6,142,382 issued Nov. 7, 2000; and U.S. Pat. No. 9,981,315 B2 issued May 29, 2018, each incorporated by reference herein. A schematic representation of a typical atomization apparatus 10 is illustrated in FIG. 1B. For further details see the patents listed immediately above. The example in FIG. 1B includes a furnace 12 in which starting material 13 for powderization is melted, a gas die 14 through which the melted starting material is forced, a spray chamber 16 in which a spray pattern 17 is contained and in which the melted starting material breaks up into droplets and begin to form powder particles P. FIG. 1B illustrates one example of a typical powder collector subsystem 18. To date, specialized gas-die designs have been developed to tailor the breakup mechanisms (including primary, secondary, and pulsatile behavior) in an effort to control the particle size distribution (PSD), minimize waste material, and reduce costs for a given application. During CC-GA, a liquid metal stream is guided by a pour tube to enter the center of a circular array of supersonic gas jets that exert a partial vacuum on the melt and cause it to fragment and transport outward toward the gas jet flow. There the melt fragments experience shear break-up into fine droplets that spheroidize to minimize surface energy and solidify into powder particles during their free-fall in the spray chamber. The historical CC-GA die designs practiced by the inventors and others have relied on high-pressure atomization gas that exits from a single circular array of "discrete jet" orifices at a fixed singular apex angle and during free-expansion the gas accelerates to supersonic velocities, which promotes intense droplet disintegration. By carefully selecting the atomization parameters, a CC-GA gas-die can operate in open-wake or closed-wake gas flow condition and can be used to gain control over particle size.

Within the above described method of producing metal powders by gas atomization, including both FF-GA and CC-GA, several mechanisms exist which contribute to the attachment of small 'satellite' particles S to the primary (larger) powders P and decrease in the quality of the resultant powders. These mechanisms can be divided into two broad classifications which are defined by the time/location and temperature required for attachment, as illustrated in FIG. 1C. First, internal satellite attachment occurs within the first moments in which the molten stream is exposed to the expanding gas jets and is attributed to the design of the atomization gas die and selection of operational parameters. This widely cited mechanism [5 of Bibliography, infra] attributes satellite S attachment to the (unavoidable) "rendezvous" of fine (primarily) solidified particles with coarser, less-solidified particles during their flight downstream within the atomization spray "cone" 17. It was proposed that the smaller droplets would cool and solidify before larger ones and would accelerate faster in this high velocity gas flow, eventually impinging/welding onto the larger (fully or partially) molten droplets. External satellite S attachment (illustrated in FIG. 1D) considers spray chamber designs typical for industrial production of metal powders and is due to the confinement and recirculation of small (solidified) powders within an atomization chamber, especially if the recirculated fines become entrained in the initial (liquid droplet) portion of the atomization spray.

The expanding gas jets used to break up the primary melt create a low pressure region near the gas die 14 (denoted by 'L' near the top of FIG. 1D) that "pulls" an upward flow of process gas (dashed lines following the walls of the spray chamber 16 in FIG. 1D in critical region 20 for satellite formation that is annotated to include typical particle temperature values for forming droplets/particles, namely, $T_m$ for melt temperature, $T_l$ for liquidus temperature, and $T_s$ for solidus temperature) and any suspended fine powders within the atomization chamber 16 to fill this partial vacuum (see dashed lines 24 indicating global flow path). Additionally, the turbulent expansion of process gas from the atomization gas die 14 creates recirculation eddies 22 along the primary flow path. Both of these features encourage upward recirculation of the finest powders inside (and adjacent to the walls of) the atomization chamber 16, subsequent entrainment within the droplet spray 17, and attachment of the fine powder "satellites" S to the liquid or partially solidified droplets. As anecdotal evidence, anyone who has watched a gas atomizer 10 in operation through a side viewport of a (typically large diameter) spray chamber is aware that a vertical upward flow of fine powders will always be visible along the chamber walls that continues to feed fines into this recirculating cloud.

FIGS. 1C-D, therefore, illustrate the following: FIG. 1C, the extent of satellite S formation via collisional attachment determined via time and temperature. FIG. 1D, the mechanism of recirculation-driven satellite formation. Fine particulates produced via CC-GA become suspended in the upward recirculation flow in an atomization chamber and are driven to the critical satelliting region 20 of the atomization spray via pressure driven flow (to fill the partial vacuum created by the atomization gas die) and are assisted by turbulent-eddy driven flow on the spray exterior and any downstream flow restrictions.

The present invention resulted from the inventors' effort to increase the yield of metallic powders in the size range and quality necessary for AM processing by optimizing the system design and process controls during CC-GA with the intent of reducing or eliminating recirculated fines which lead to satelliting while maintaining close control of particle size and yields. To this end, the method of optimization and subsequent embodiments pursuant to the invention includes:

(1) Simulation modelling of gas atomization system operation to identify locations in need of intervention to suppress satelliting. See, e.g., FIG. 2A. In one specific modelling embodiment (FIG. 2B), a robust Lagrangian particle tracking simulation technique is used that includes both droplet cooling and solidification models, applicable to any atomization system, in order to determine the critical satelliting region and judge the efficacy of various techniques of reducing the recirculation of fines within this region.

(2) Satelliting suppression interventions. See, e.g., FIG. 3. Several different types of apparatus/embodiments follow which can be implemented to reduce these satellites, both passive and active, and can be applied based upon the system constraints, especially the opportunity to re-design the spray chamber and the availability of capital vs operational expense tradeoffs.

As can be seen, the inventors have identified there is room for improvement in this technical art.

II. SUMMARY OF THE INVENTION

A. Objects, Features, and Advantages of the Invention

A primary object, feature, or advantage of the present invention is to provide methods, apparatus, or systems which solve or improve over problems or deficiencies in the state of this technical art.

Further objects, features, or advantages of the present invention is to provide methods, apparatus, or systems which:

a. Mitigate, reduce, or eliminate external satellite recirculation and attachment in GA.
b. Promote improvements in powder flowability, resulting in reduced as-built part porosity for AM applications, and in powder packing, resulting in greater particle packing density in capsules for hot isostatic pressing (HIP).
c. For substantially any GA spray chamber one can predict, through computerized simulation and modeling, critical areas for anti-satellite interventions to optimize efficacy of these suppression efforts.
d. Effective design and implementation of passive and active devices for installation in a GA spray chamber to suppress external satellite recirculation and spray attachment.
e. Balancing of operational, cost, and system requirements for effective mitigations.

B. Aspects of the Invention

This present invention relates to the reduction of small satellite particles on powders produced via gas atomization. More particularly, this invention relates to several apparatuses which were developed using an atomization system-agnostic methodology for the production of reduced or satellite-free powders, which are critical for improving powder flowability and compaction in many powder metallurgy (PM) applications, including additive manufacturing (AM) and HIP consolidation.

In one aspect of the invention, droplet cooling and solidification models incorporated into a robust Lagrangian particle tracking simulation allow for the determination of the critical regions of the atomization chamber in which droplets are between fully liquid and fully solid and are at the greatest risk for satellite formation. Different active and passive techniques can then be applied in these critical areas to inhibit recirculated ultrafine (typically dia.<20 μm) particulate from entering these regions within the atomizer. This invention differs from current state-of-the-art due to the atomizer-agnostic ability to pinpoint critical regions of interest inside of any atomization system and to optimize the application of the appropriate suppression apparatus based on capital expense vs. operational requirements necessary for a given design. Multiple non-limiting apparatuses for satellite suppression are disclosed based upon implementation of this technique under different atomization and industrial requirements.

These and other objects, features, advantages, and aspects of the invention will become more apparent with reference to the accompanying specification and claims.

III. BRIEF DESCRIPTION OF THE DRAWINGS

The patent or application file contains at least one drawing executed in color. Copies of this patent or patent application publication with color drawing(s) will be provided by the Office upon request and payment of the necessary fee.

The appended drawings include figures and illustrations which are referred to in this disclosure and are summarized as follows:

FIG. 1A is scanning electron microscope (SEM) micrographs showing commercially-available examples of metal powder particles P, some of which exhibit a substantial proportion of satellited particles S. Ni-based commercial A, B, C powders were produced via gas atomization and exhibit significantly satellited particles, while the Ni-base PREP powder illustrates satellite-free powder but at a substantially higher price. These commercially available powders are from multiple vendors available at the time of this disclosure. Commercial A, B, C exemplars are produced via gas atomization (GA). Ni-based PREP powder utilizes a dramatically more costly process but exemplifies the 'gold standard' for low-satellite concentration powder.

FIG. 1B is a schematic view of a typical atomization apparatus for practicing CC-GA, and which can be used in embodiments of the present invention.

FIGS. 1C-D are diagrammatic illustrations of the mechanisms of satellite formation during typical CC-GA. FIG. 1C is a diagrammatic illustration from Ref [8] of the bibliography, infra., of the relationship between temporal duration within the atomization region 16 and particle cooling effects on the mechanisms which lead to satellite formation. FIG. 1D is an illustration of how FIG. 1C could be applied to a typical GA system and used to define the critical locations of satellite formation. The red box 20 denotes the critical solidification zone and is the region of interest for the present invention.

Figure 1A:
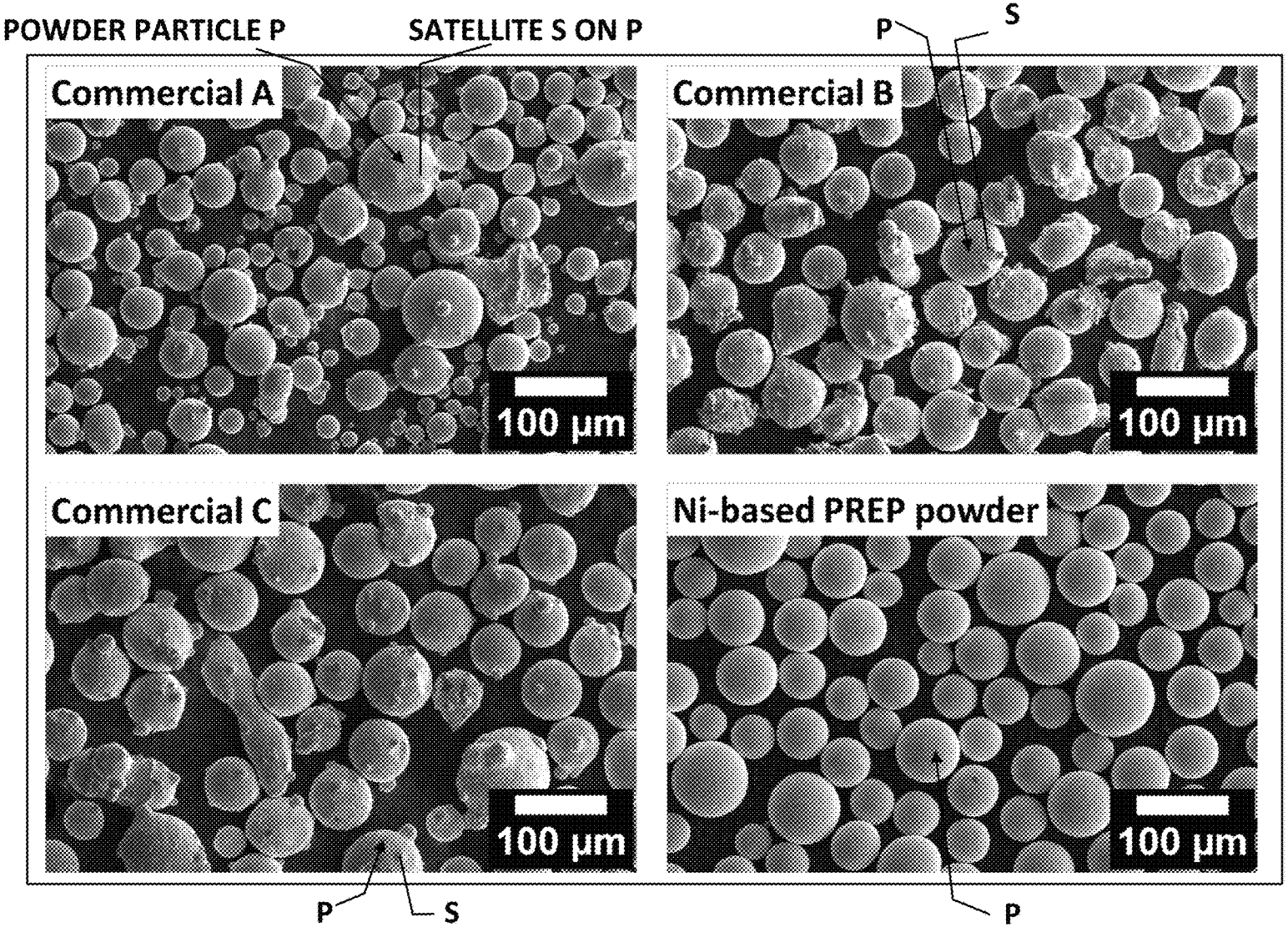
FIG. 1A (PRIOR ART)
Figure 1B:
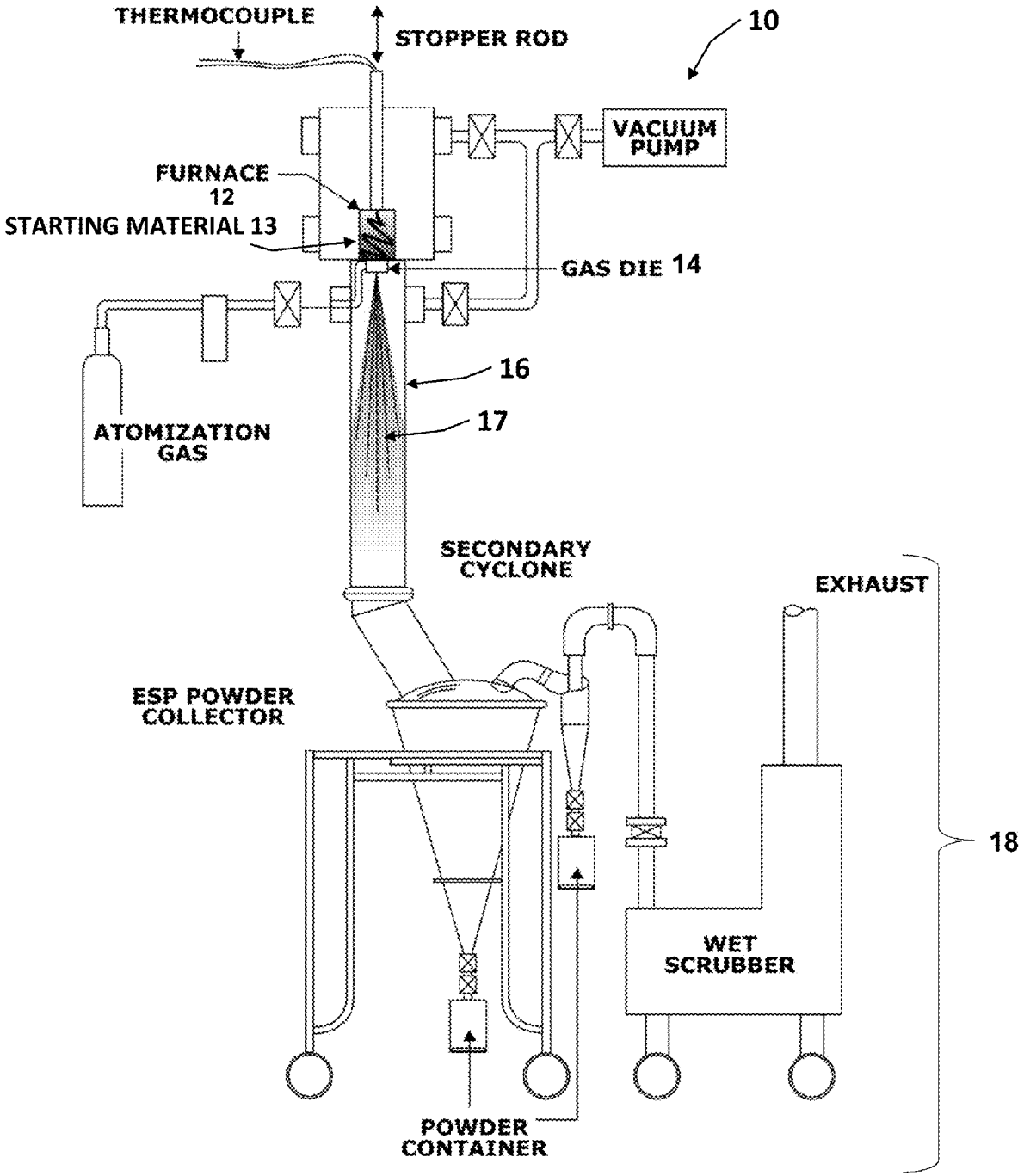
FIG. 1B (PRIOR ART)
Figure 5:
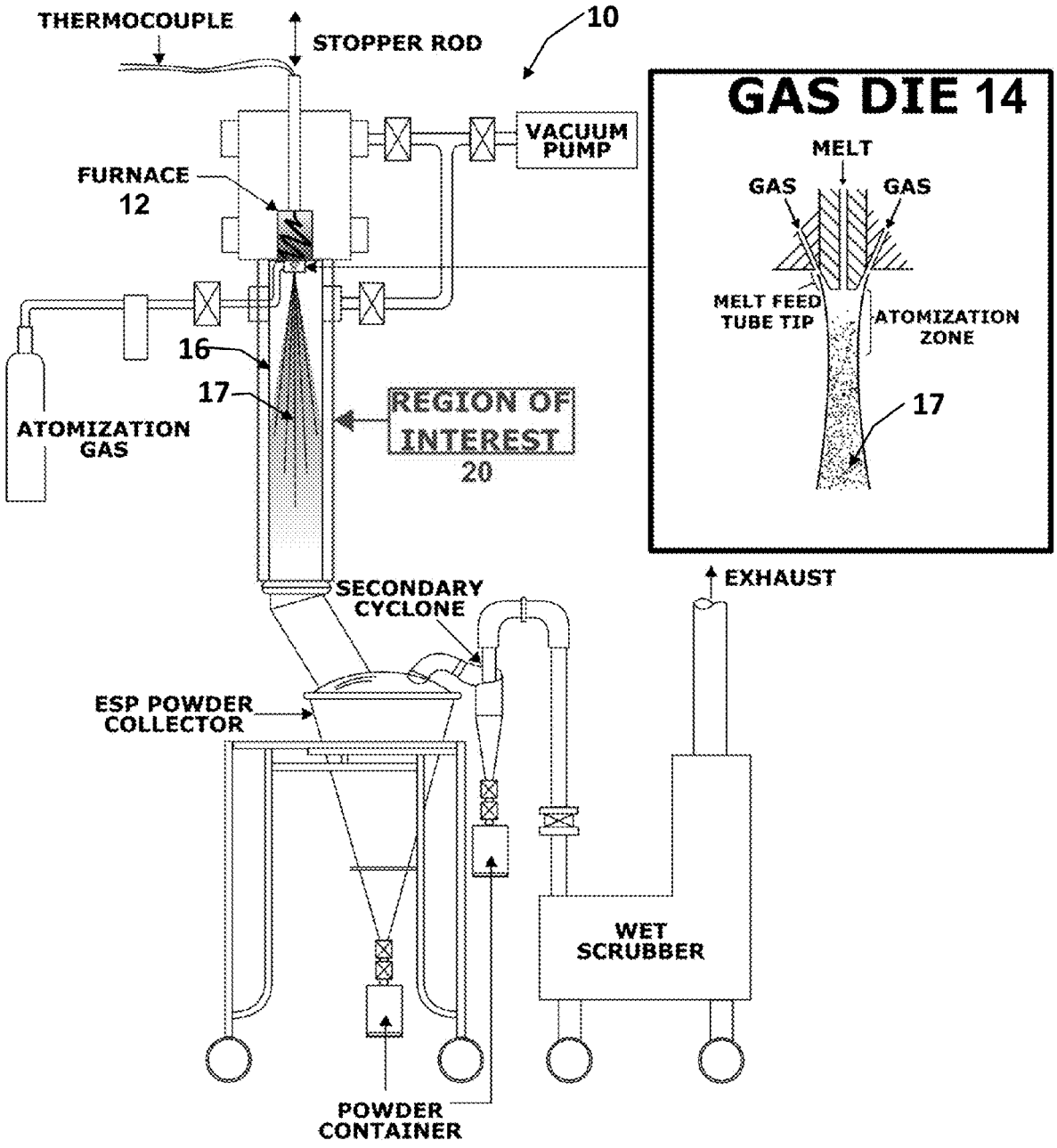

FIG. 5 is a schematic view of an atomization apparatus according to an exemplary embodiment of the invention utilizing a narrow spray chamber compared with the baseline shown in FIG. 1B. This schematic view of an atomization apparatus utilizing a narrow spray chamber (see FIG. 1B) has the relevant area 20 of investigation called out for practicing certain embodiments of the invention. An enlargement of gas die 14 is shown.

Figure 6:
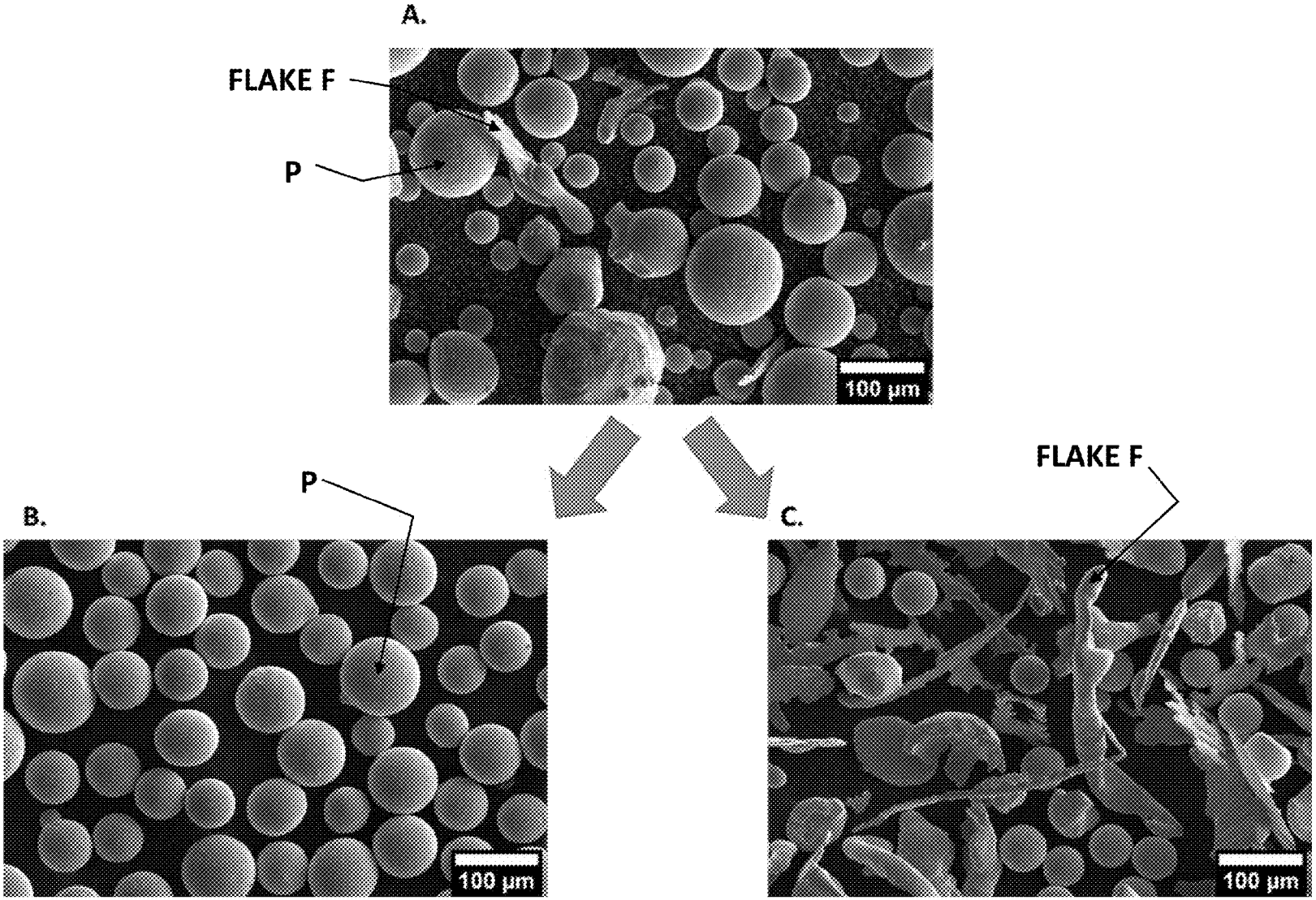

FIG. 6 is SEM micrographs of exemplar satellite-free Ni-base powder produced via low pressure gas atomization in a 1-foot chamber (run number: ASC-1-29) with the apparatus of FIG. 5. Image C includes a "flake" micrograph. Essentially, the low-pressure atomization causes production of highly-spherical, low satellite powder—but also produces 'flake' F which must be removed through a time and energy intensive process. This shows Ni-base powder produced via "process control" mitigation strategies, using low pressure atomization in a 1-foot chamber (Run: ASC-1-29). Low pressure atomization is a successful strategy to produce highly spherical, satellite free powders, however, significant 'flake' F is also produced. Image A is a SEM micrograph image of the As-Atomized powder. Images B. and C. are the post-processed 'clean' powder and recovered 'flake', respectively.

Figure 1C:
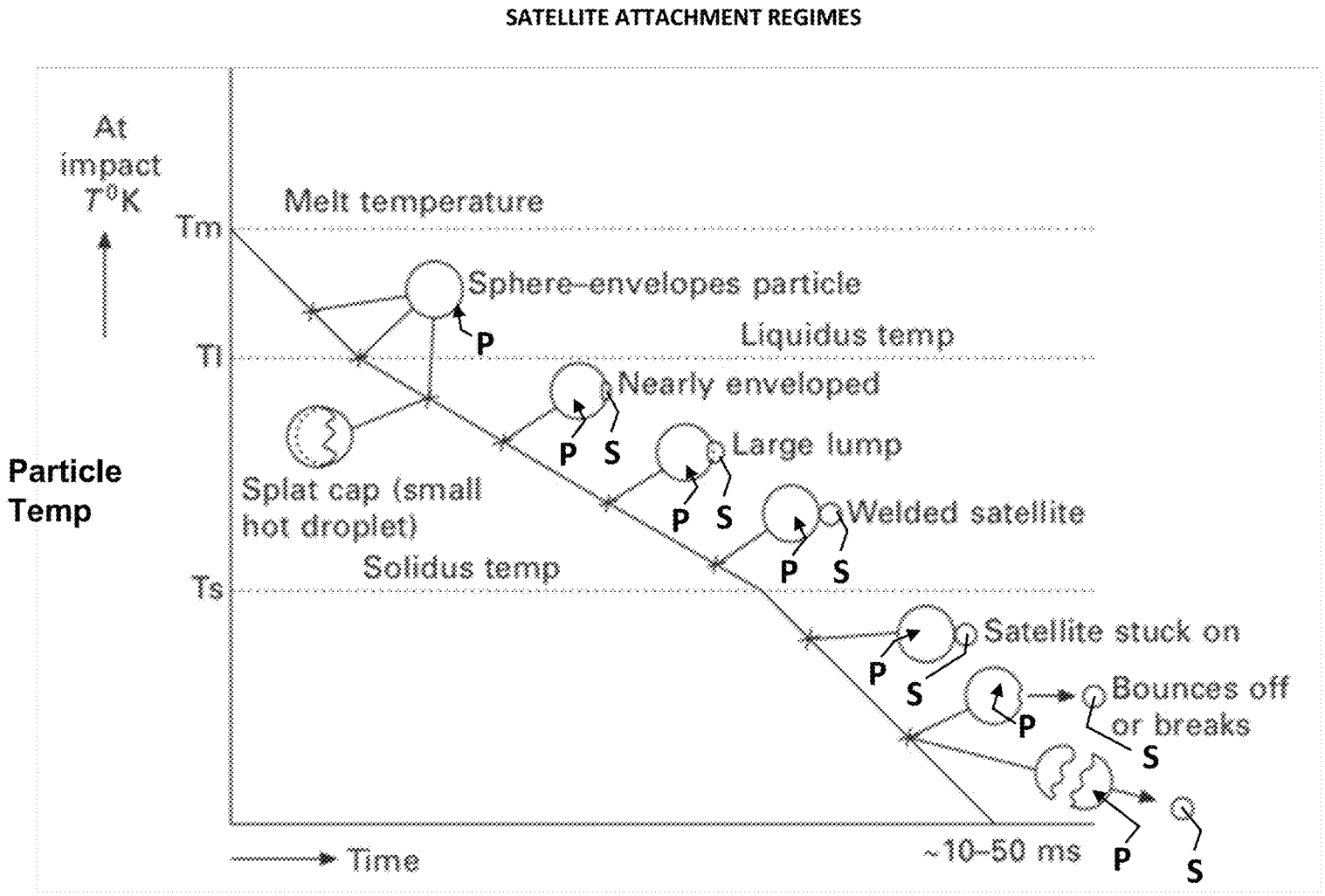
Figure 1D:
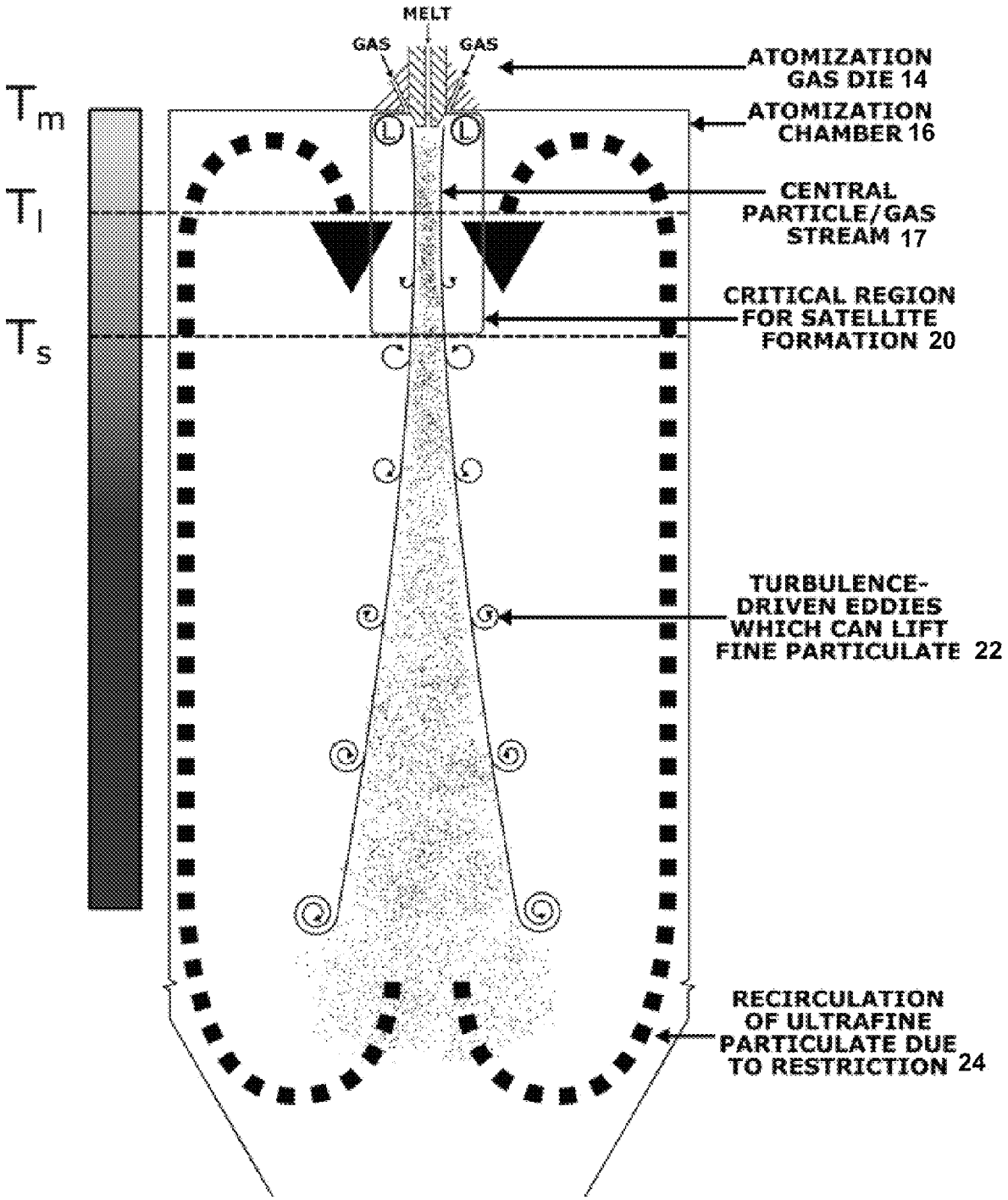
Figure 7A:
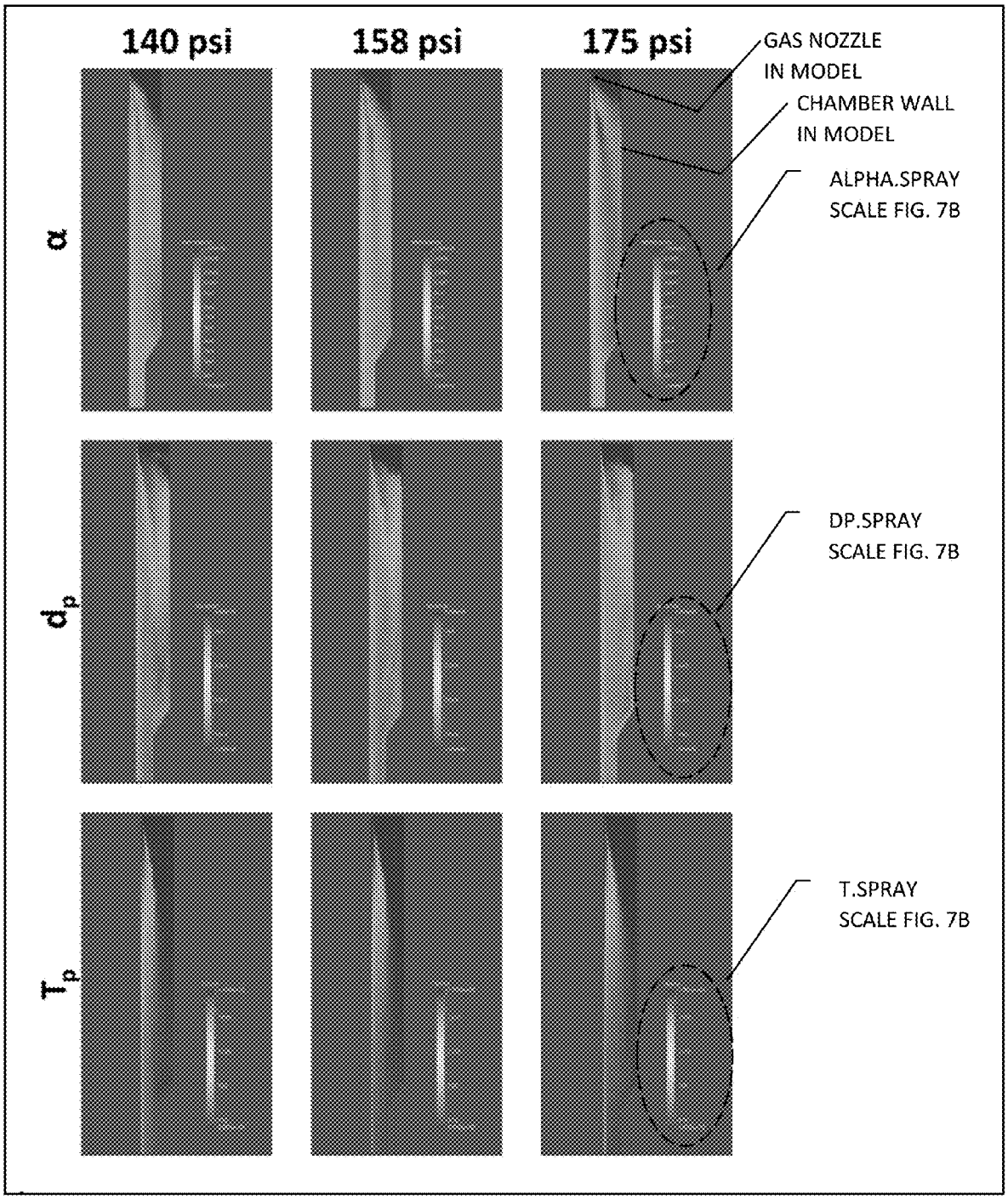
Figure 7B:
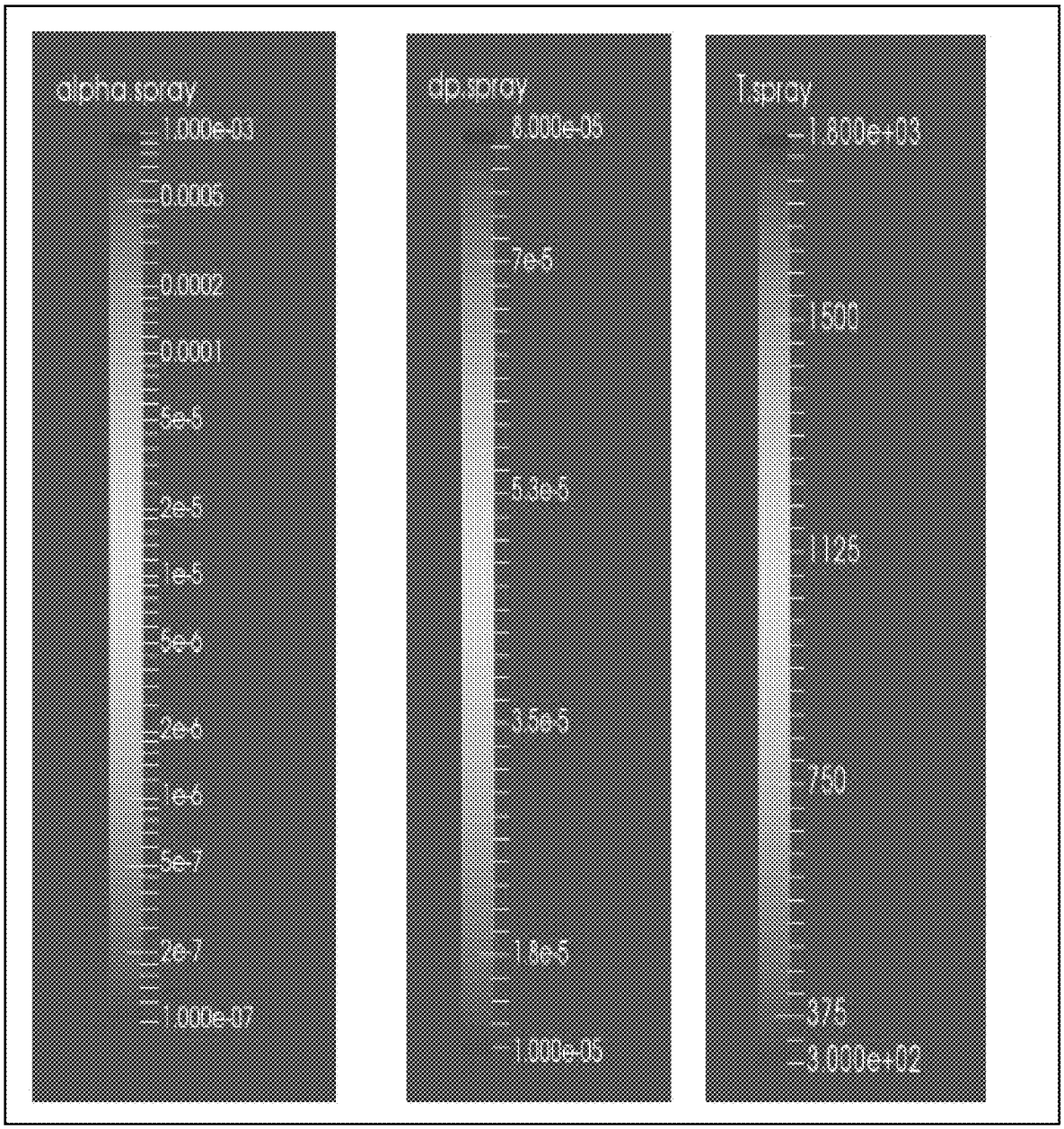

FIG. 7A is simulation results for a Pilot Scale Atomizer (see FIG. 1B) at different operating conditions according to another exemplary embodiment of the present invention. This figure helps to describe the method of the invention (such as examples in FIGS. 2A and B), and the embodiment shows how slight changes to process parameters can modify the extent of re-circulation & satelliting. The location of critical satelliting will be dependent on the properties of the material being atomized (solidus temperature, particle size) and process (gas-to-metal ratio, specific heat ratio of the process gas) which determine cooling rate and define the 'critical' region which must be protected. By comparing the Tp plot and looking for where the temperature drops below solidus (see, e.g., $T_s$ of FIGS. 1C-1D), and comparing it to the 'alpha' (essentially a measure of where particles are at), we can understand how successful a mitigation strategy might be. These simulation results apply one embodiment of this invention to analyzing different operating conditions on the propensity to form satellites within a 2-foot atomization chamber. The location of critical satelliting is material and process dependent. By locating where $T_p$ drops below solidus and comparing it to the particle volume fraction, $\alpha$, predictions can be made of the success of a given mitigation strategy. FIG. 7B are enlargements of the scales used with the images of FIG. 7A.

Figure 8A:
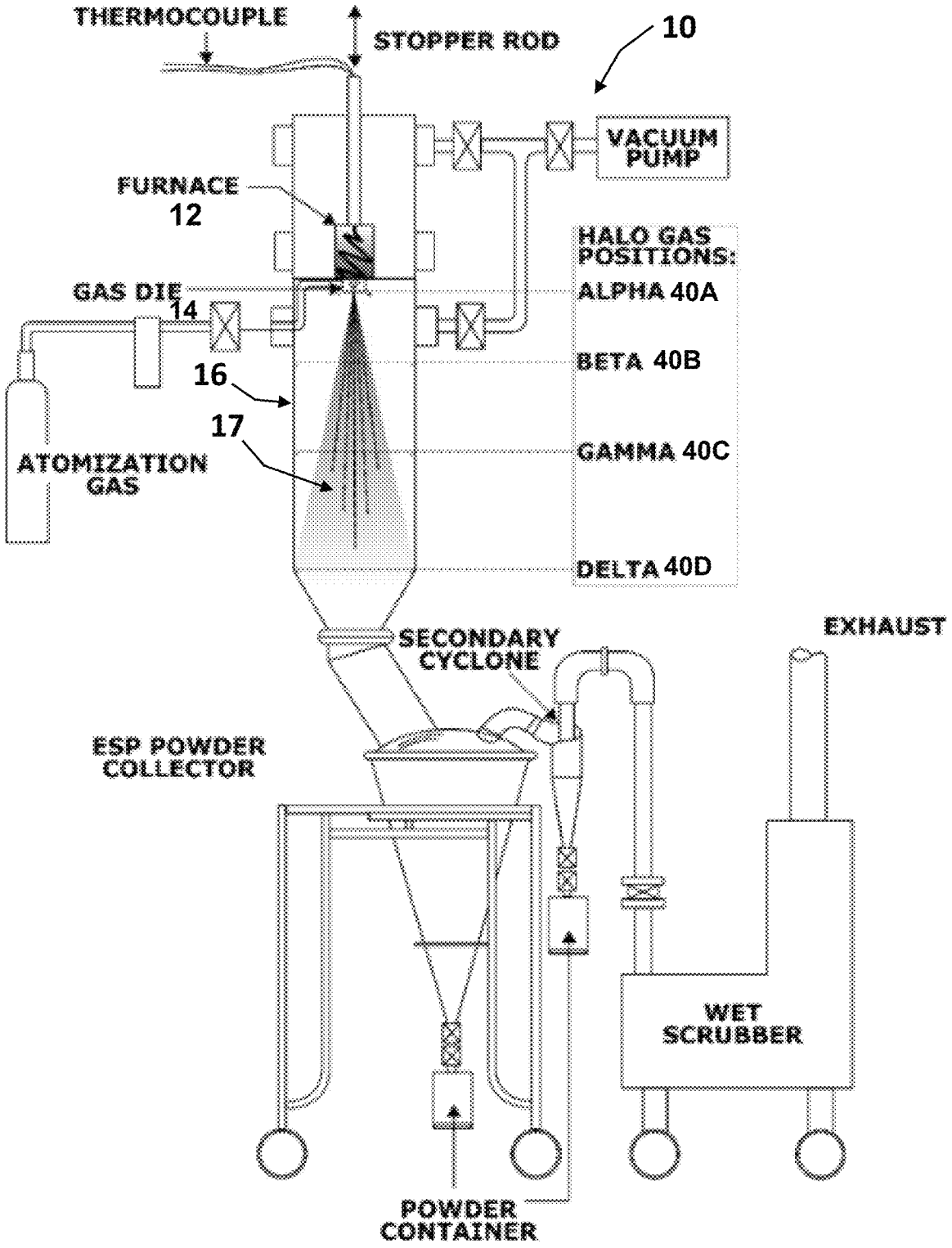
Figure 8B:
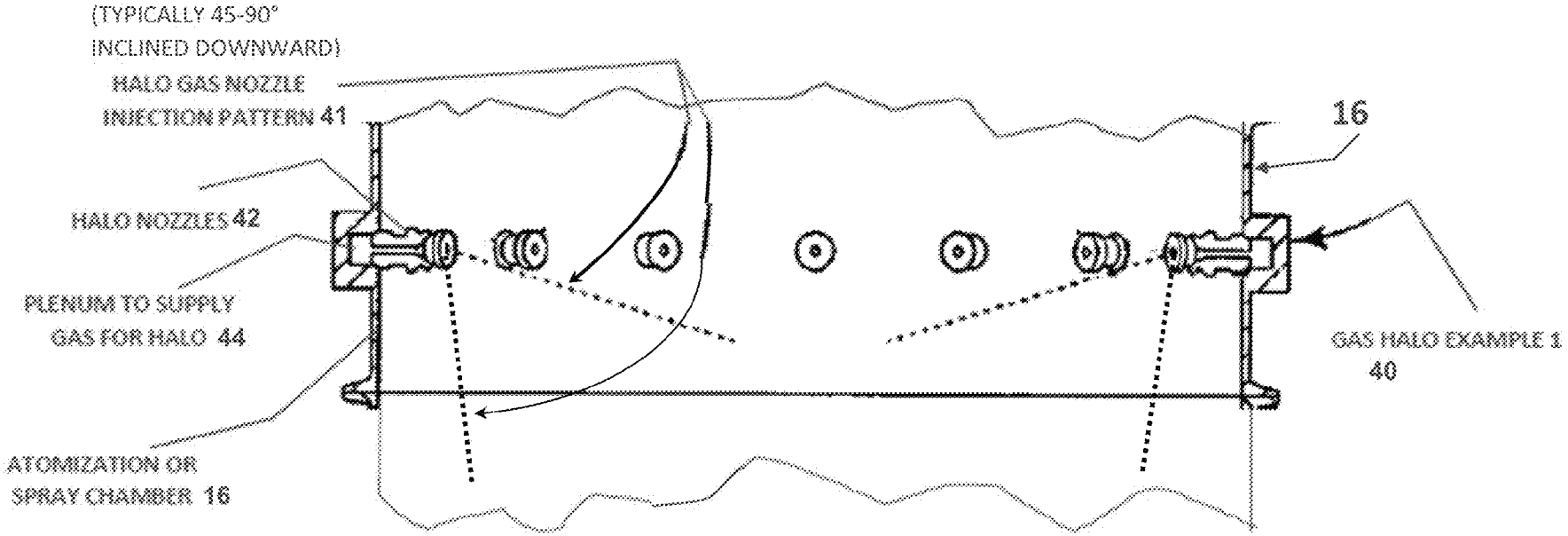
Figure 8C:
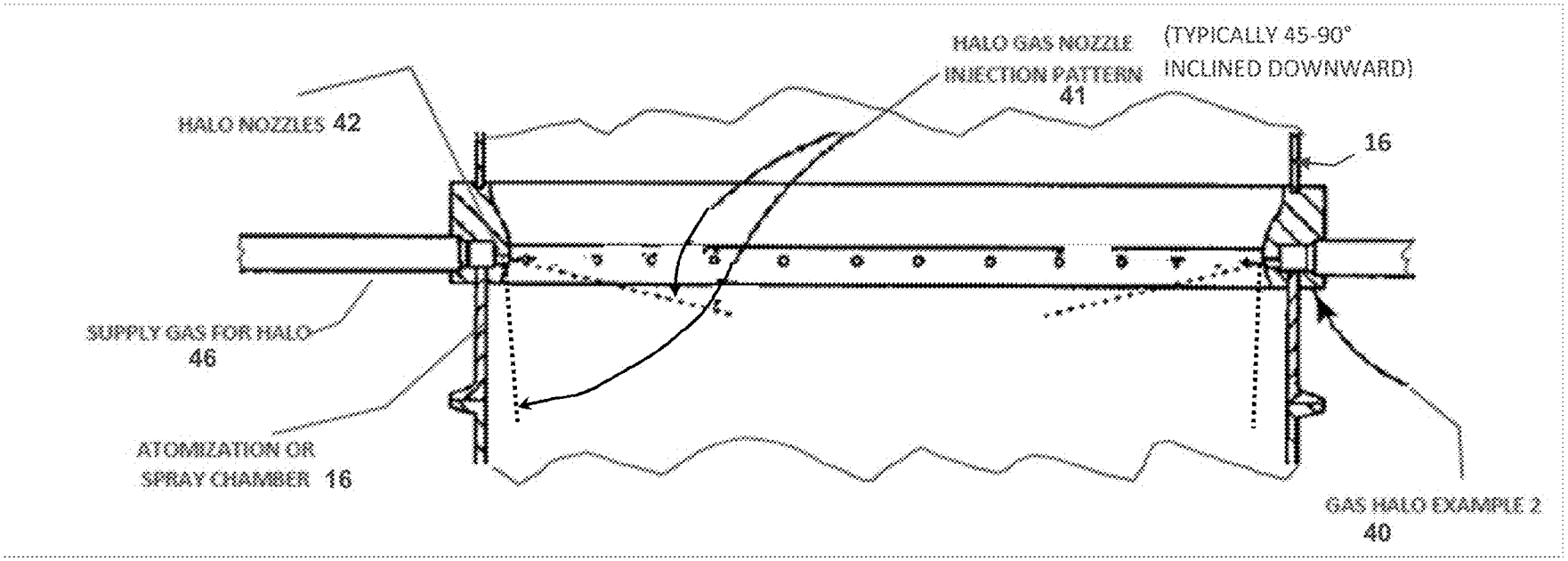

FIG. 8A is a schematic view of an atomization apparatus 10 utilizing a 2 foot diameter spray chamber 16 and including various supplementary gas 'halos' 40 for increased cooling and satellite reduction objectives according to another exemplary embodiment of the invention. FIGS. 8B and C are enlarged frontal plane sectional views of examples from US Published Patent Application 2018/0133793A1 which is incorporated by reference herein, to illustrate the basic concept of gas halos. In the embodiments according to the invention, however, the jets would typically point somewhere between 45-90° inclined downward into the flow of the process spray 17 in order to suppress recirculation of powders, as compared to the gas halos of US2018/0133793A1 where the jets are pointed at 0° incline (basically in the plane of the ring of the halo).

Figure 9:
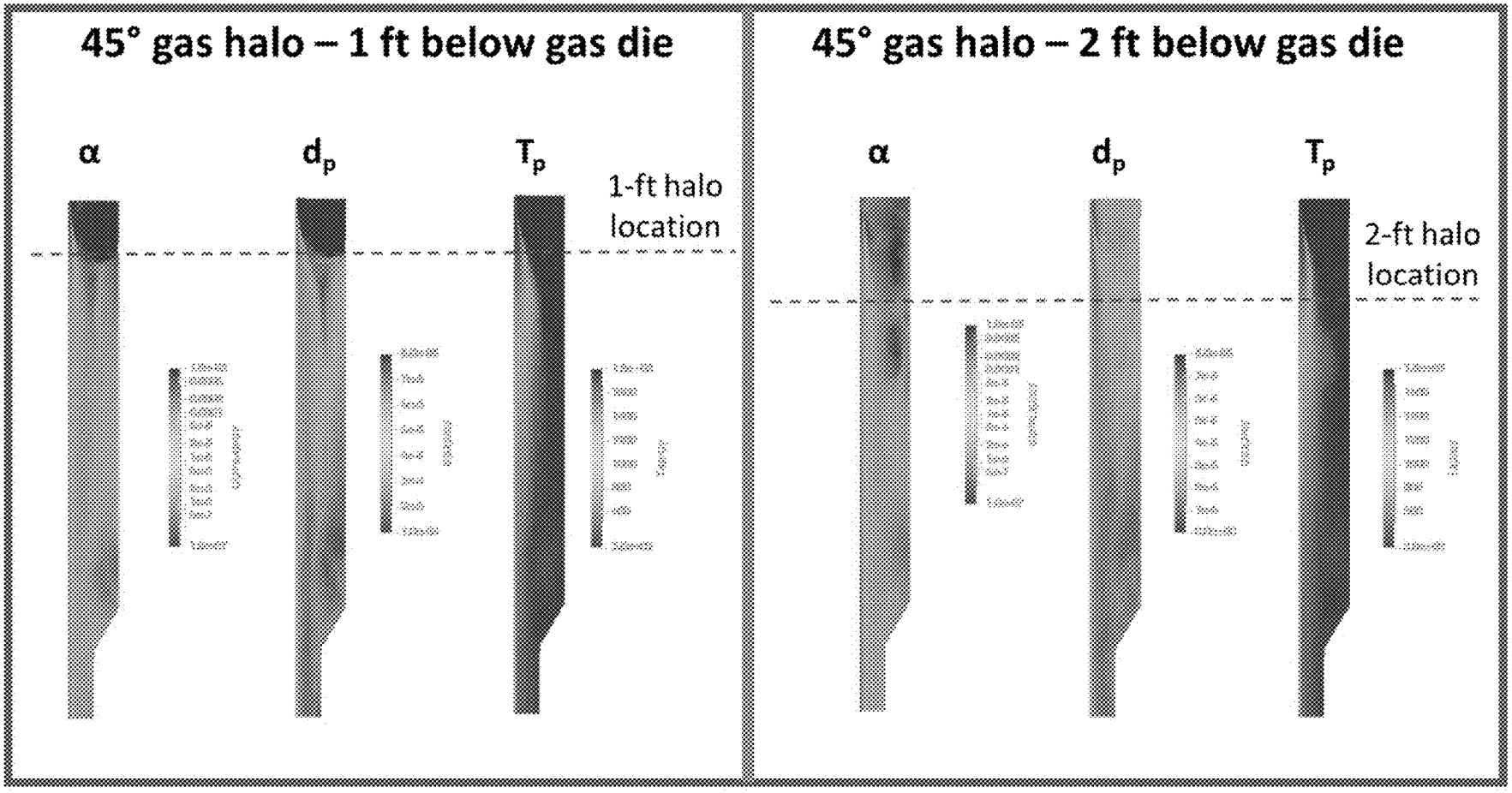

FIG. 9 is computational fluid dynamics (CFD) modelling simulation results of the utilization of a single gas halo 40 at various chamber 16 heights to reduce satelliting according to another exemplary embodiment of the invention. These CFD results are of the utilization of a single gas halo 40 at various chamber heights to reduce satelliting.

Figure 10:
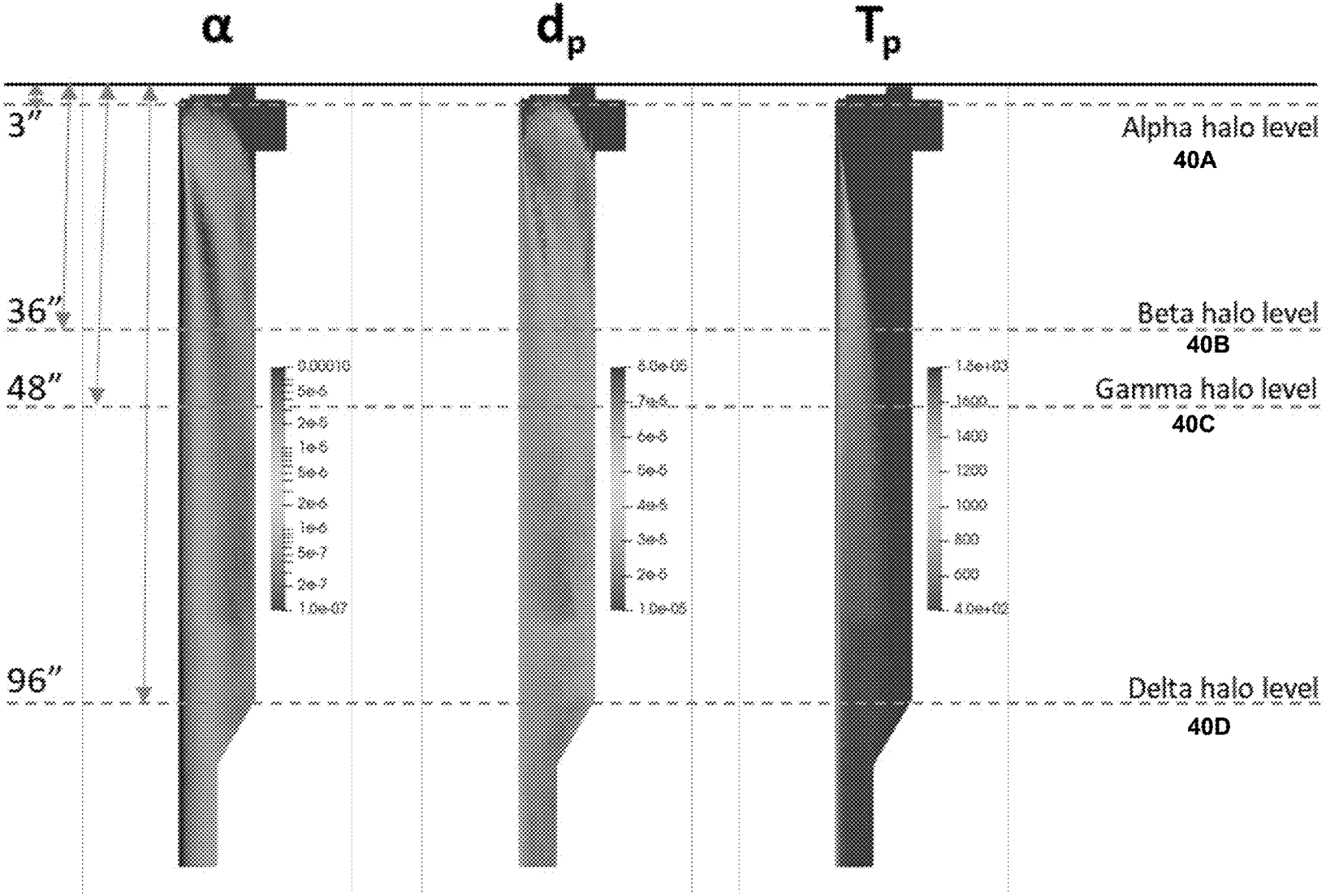

FIG. 10 is CFD modelling results of the utilization of multiple gas halos at various chamber 16 heights typical of normal operation of this atomization apparatus according to another exemplary embodiment of the invention. These CFD results are of the utilization of multiple gas halos 40A, B, . . . at various chamber 16 heights typical of historical operation of this atomization apparatus (Run ASC-1-45). As can be observed, this is a non-optimal configuration for satellite suppression but illustrates the utility of this method in determining placement of halos for maximum satellite suppression efficiency. Note: Alpha, Beta, and Gamma halos 40A, 40B, and 40C are oriented in the direction of flow (at or near 90° down or parallel to the central axis of spray 17) while the delta halo 40D is oriented at a 45° angle along the chamber 16 reducer section.

Figure 11:
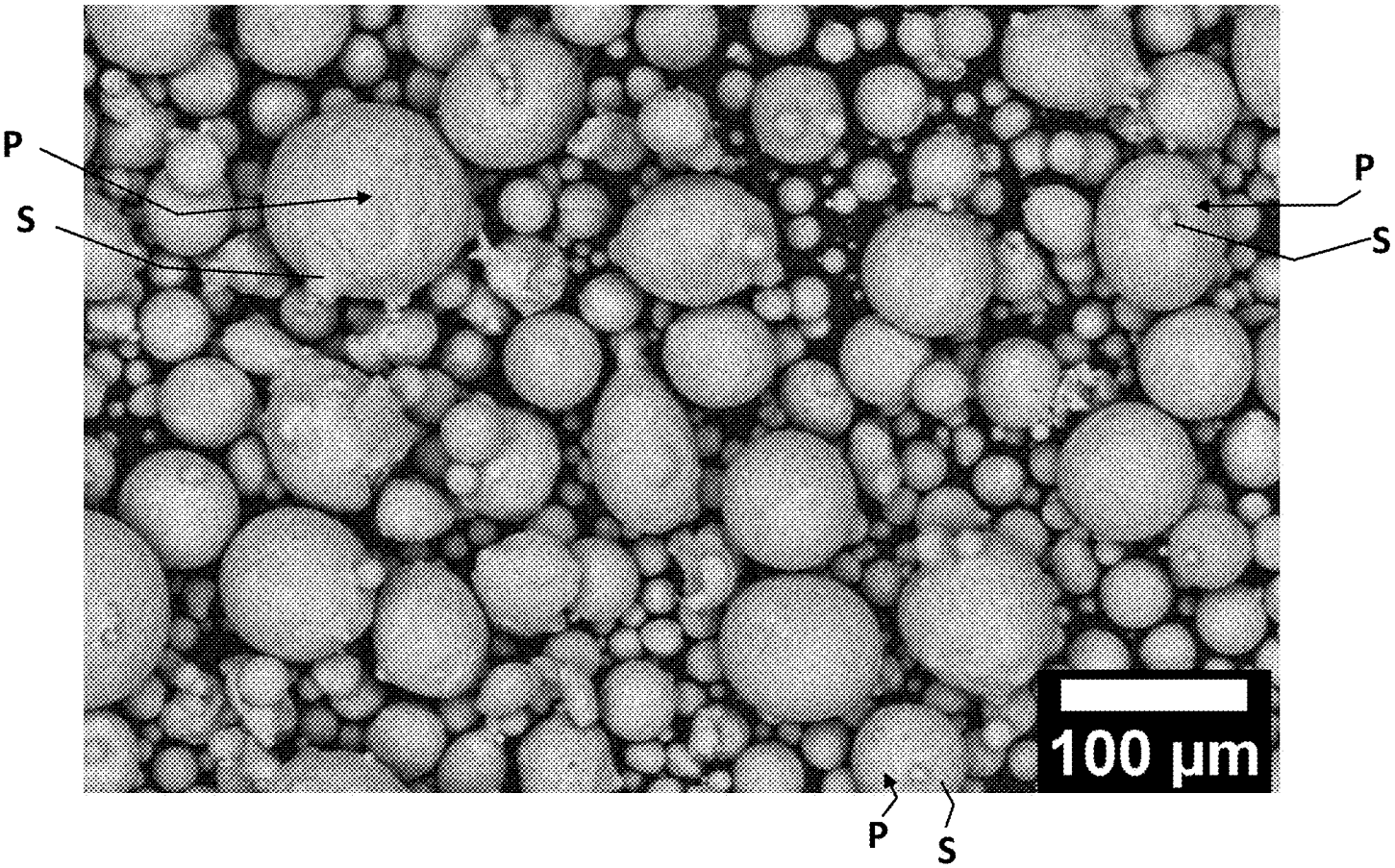

FIG. 11 is a SEM micrograph of Ni Powder (45-106 μm), showing increased satelliting S from 4-halo case (ASC-1-37) according to another exemplary embodiment of the invention.

Figure 12A:
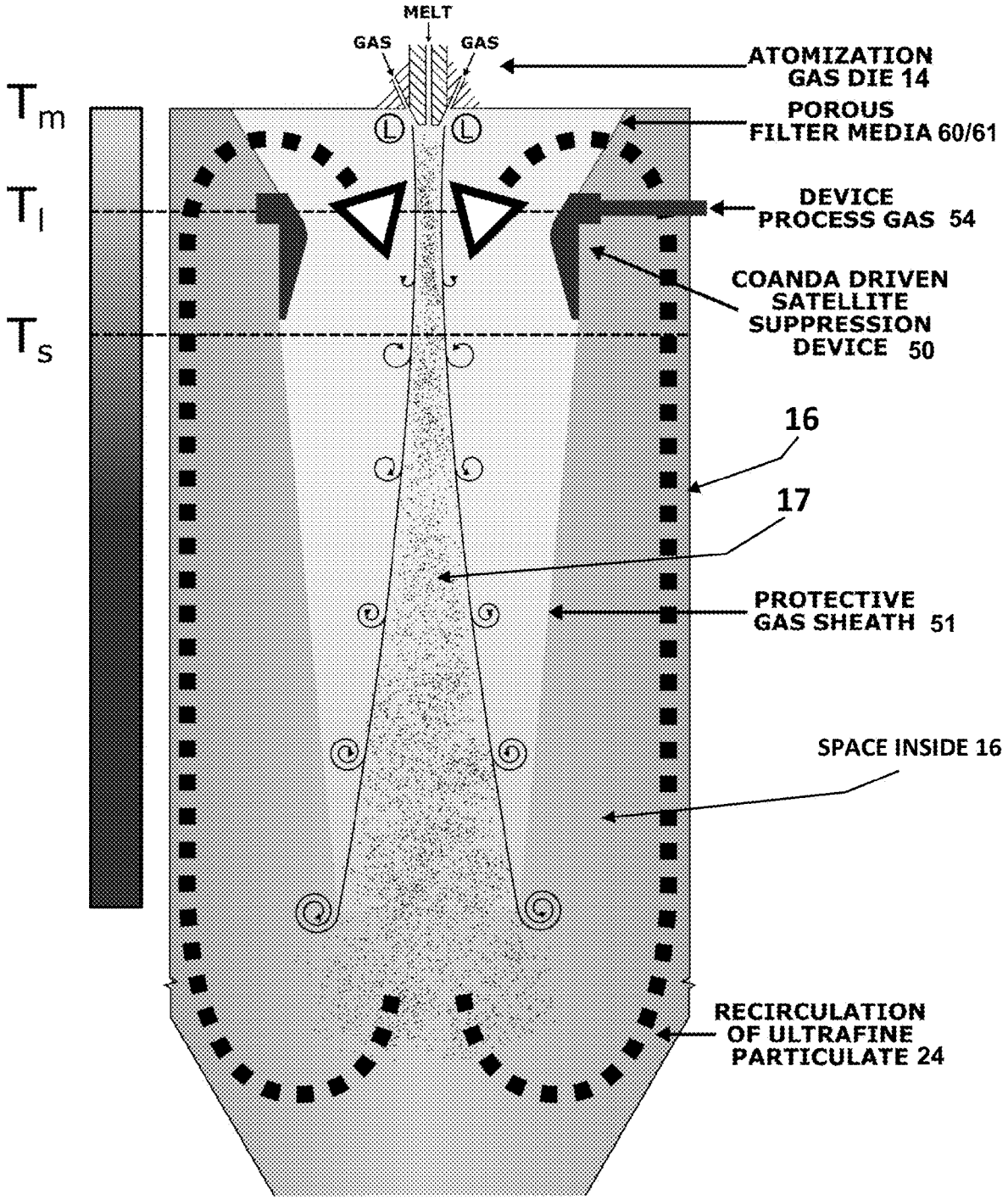
Figure 12E:
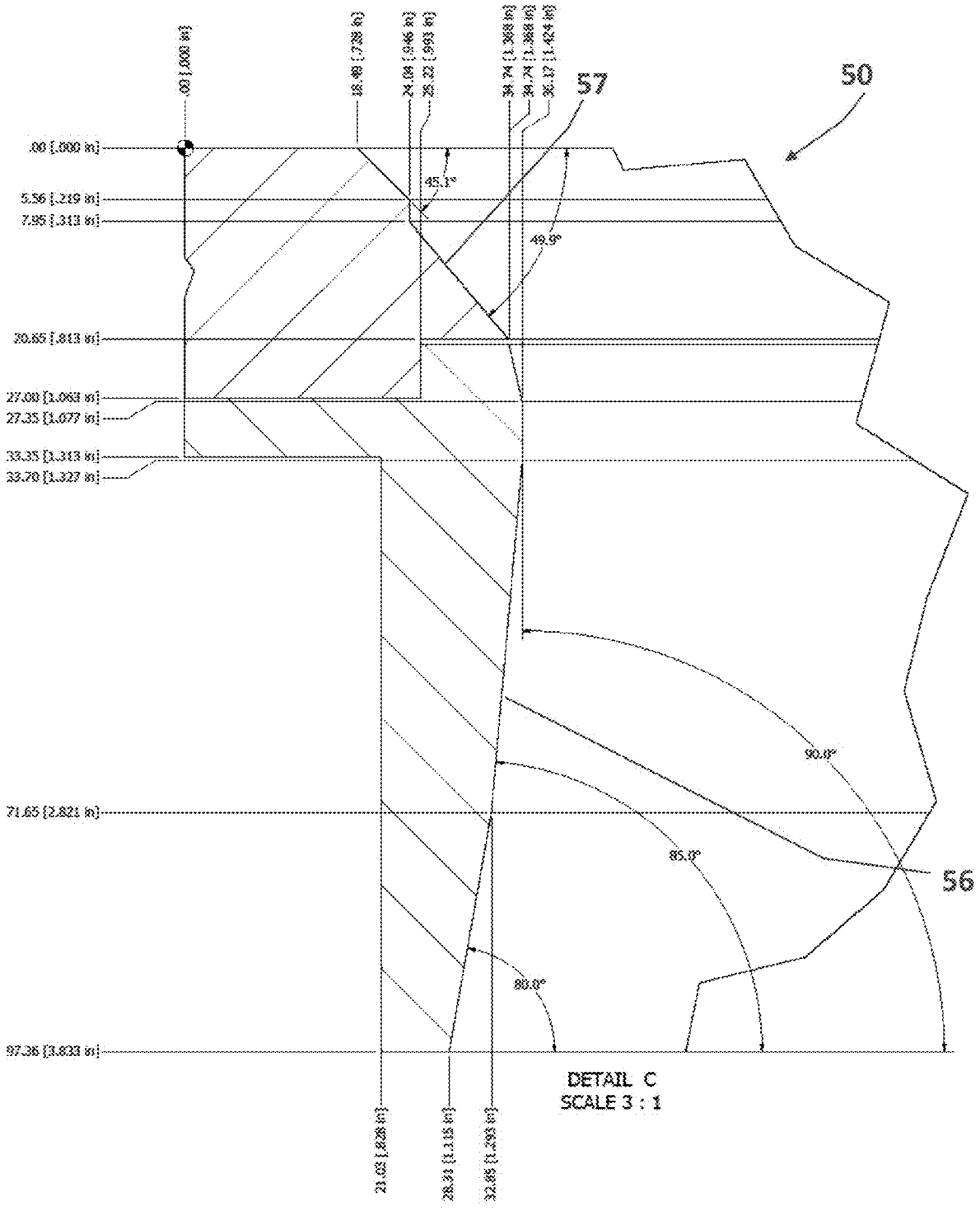
Figure 12F:
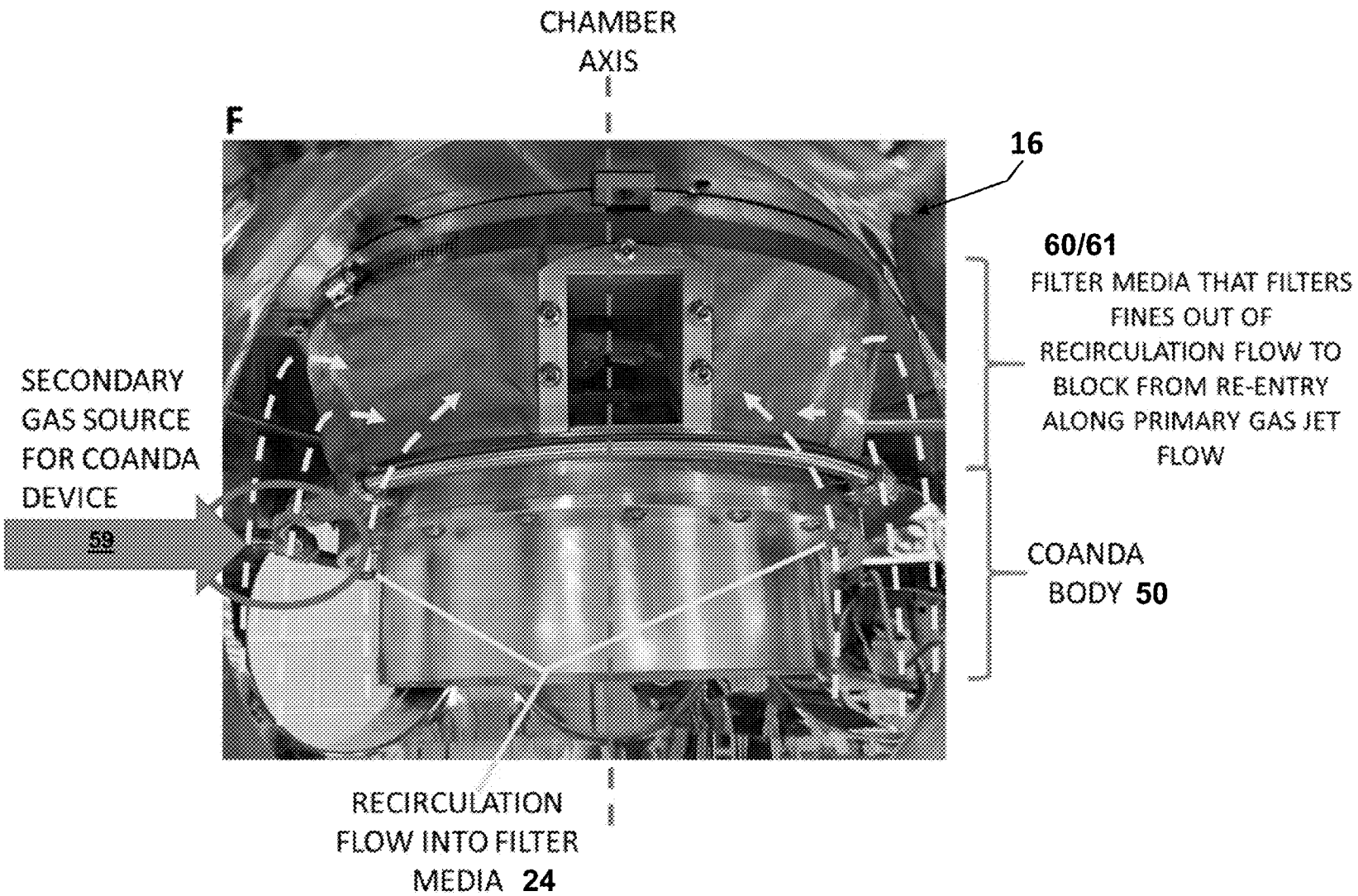

FIG. 12A is a schematic of an apparatus utilizing active/passive hybrid approach toward satellite suppression according to another exemplary embodiment of the invention. FIG. 12B is an enlarged isolated elevation of an assembly including a Coanda device 50 and a filter 60 (with filter media 61) for satelliting intervention. FIG. 12C is a frontal plane section of FIG. 12A. FIG. 12D is a still further enlargement of the Coanda device 50 of FIG. 12C. FIG. 12E is a simplified perspective view of the general form factor of a Coanda device 50 with example of possible dimensions (angles from top left to bottom left are 45.1°, 49.9°, 90.0°, 85.0°, and 80.0°, respectively). FIG. 12F is a simplified perspective view of the filter/filter media 60/61 that intercepts and filters recirculating particles. FIGS. 12A-F is an example of a combination of interventions according to the invention, a satellite suppression apparatus utilizing an active/passive hybrid approach. FIG. 12A is a diagrammatic illustration of atomization chamber with particle-recirculation flows and proposed impact of filtered, Coanda-driven sheath flows. FIGS. 12B and C are illustrations of key components associated with the active/passive apparatus for reducing satelliting. FIGS. 12D and E are drawings of key dimensions associated with the Coanda flow profile of this example. FIG. 12F is an image showing implementation of a hybrid active/passive flow device according to an exemplary embodiment of the invention. The drawing illustrates how particle laden flow is intercepted via the filter media to allow 'clean' flow of gas in the critical satelliting region.

Figure 13:
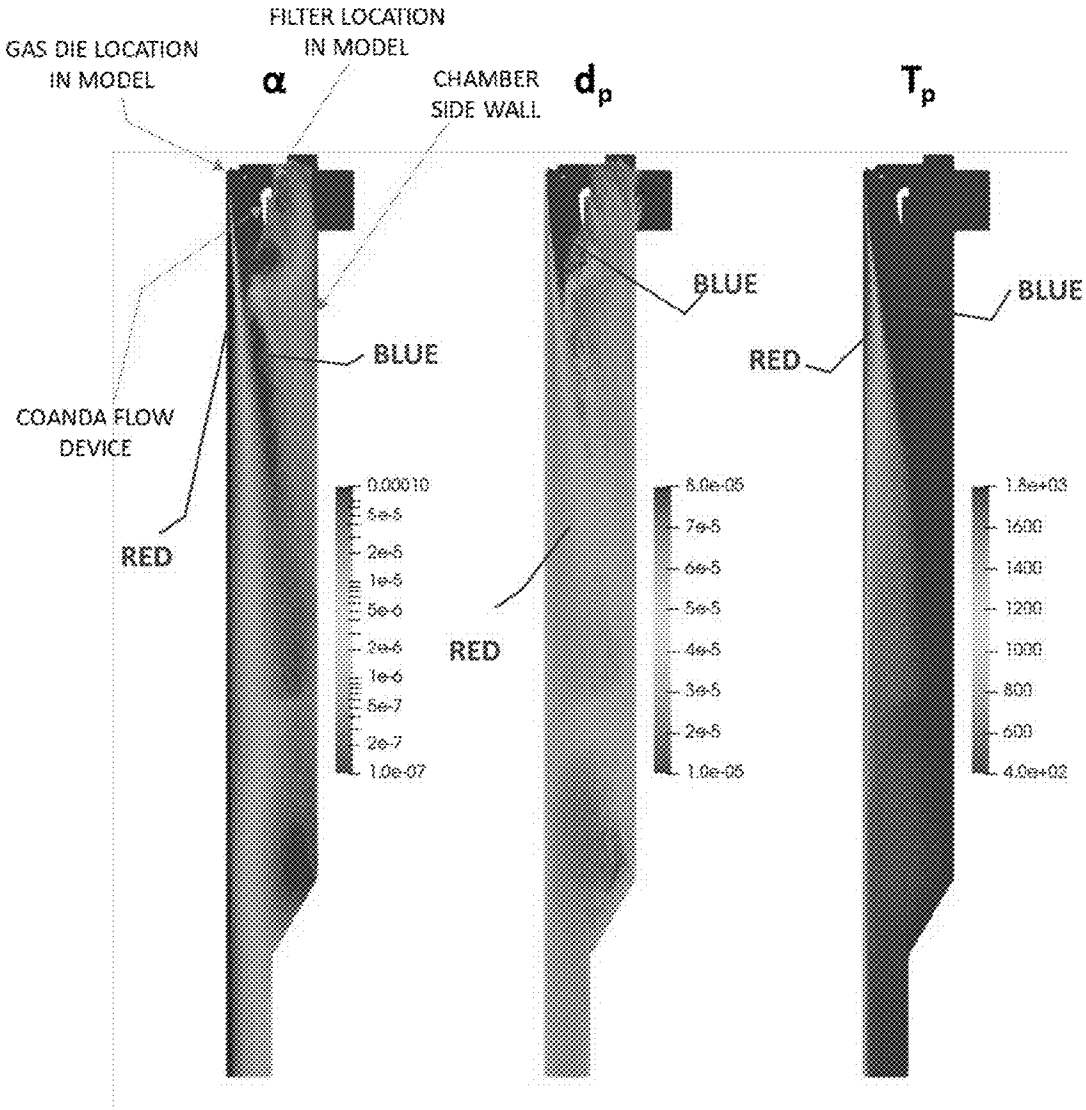

FIG. 13 is simulation results for the internal particle filter and Coanda-driven sheath satellite suppression system such as in FIGS. 12A-F according to another exemplary embodiment of the invention. These simulation results are for an internal particle filter 60/61 and Coanda-driven 50 sheath satellite suppression system according to an example of the invention.

Figure 14:
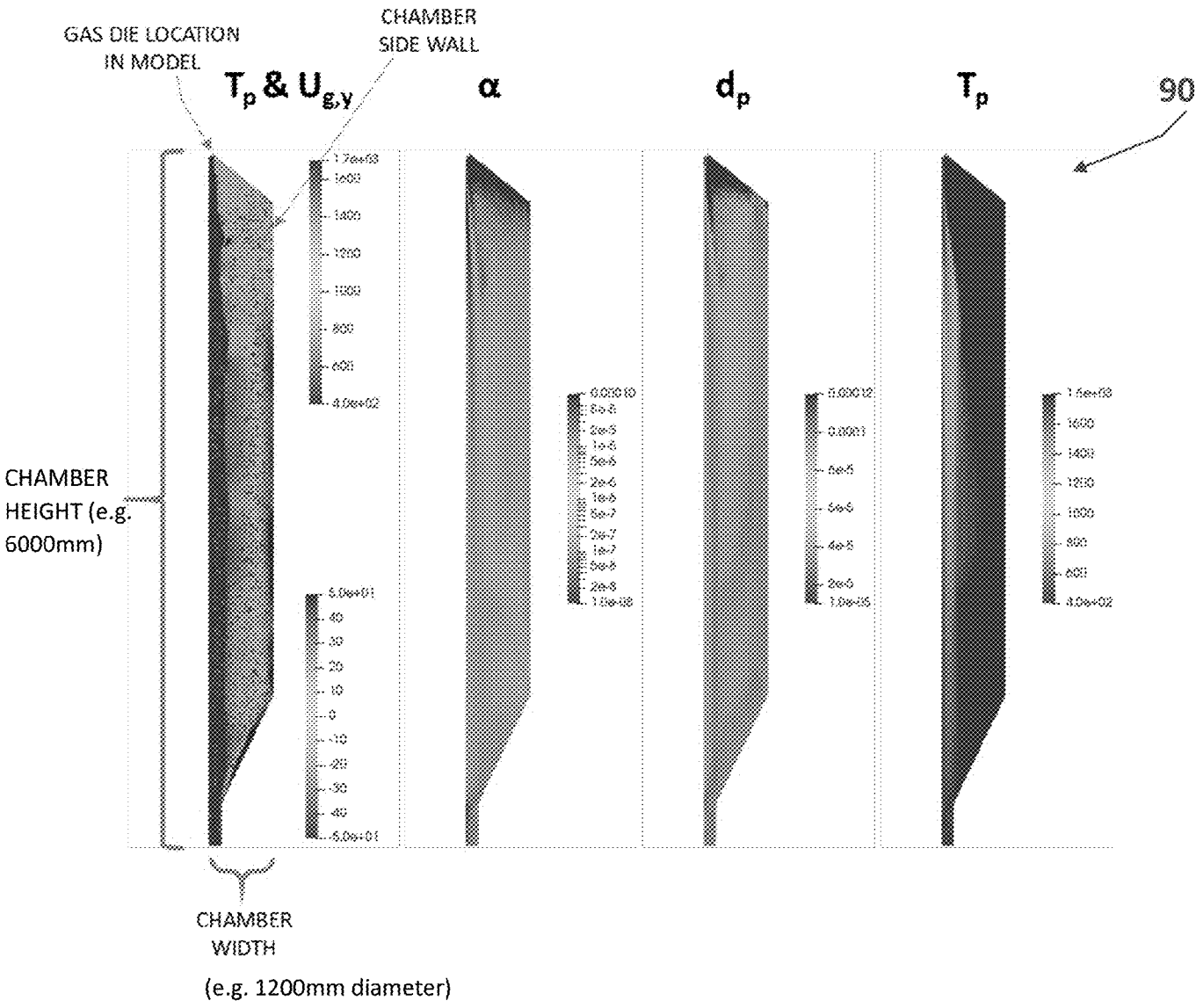

FIG. 14 is an example of simulation results of a commercial spray chamber with common design according to another exemplary embodiment of the invention. This example simulation results are of a commercial spray chamber 16 with common design. The values $T_p$ and $U_{g,y}$ illustrate the time averaged particle temperature and vertical gas flow velocity. The value $\alpha$ is the time averaged particle volume fraction. The value $d_p$ is the time averaged particle diameter.

Figure 15A:
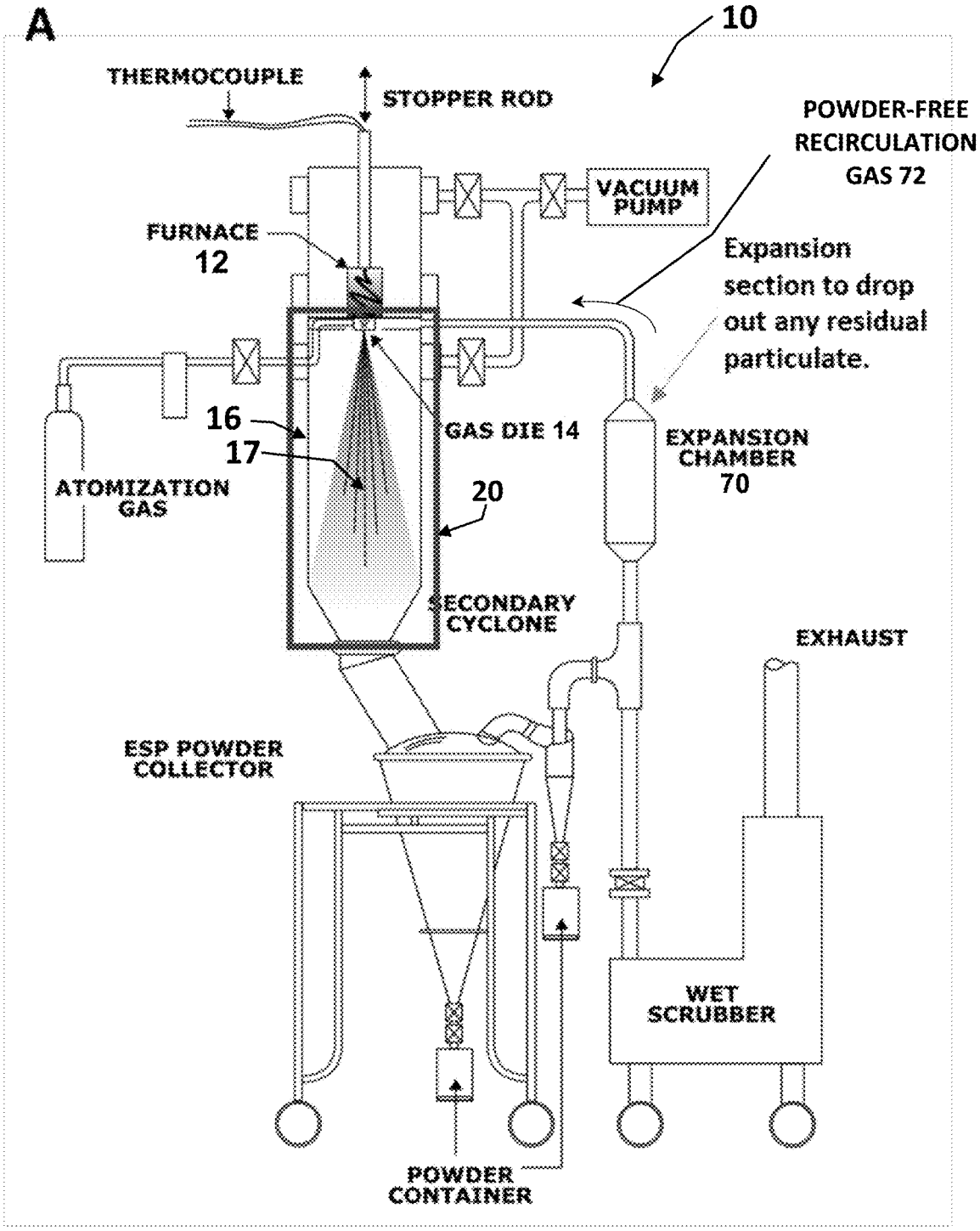
Figure 15B:
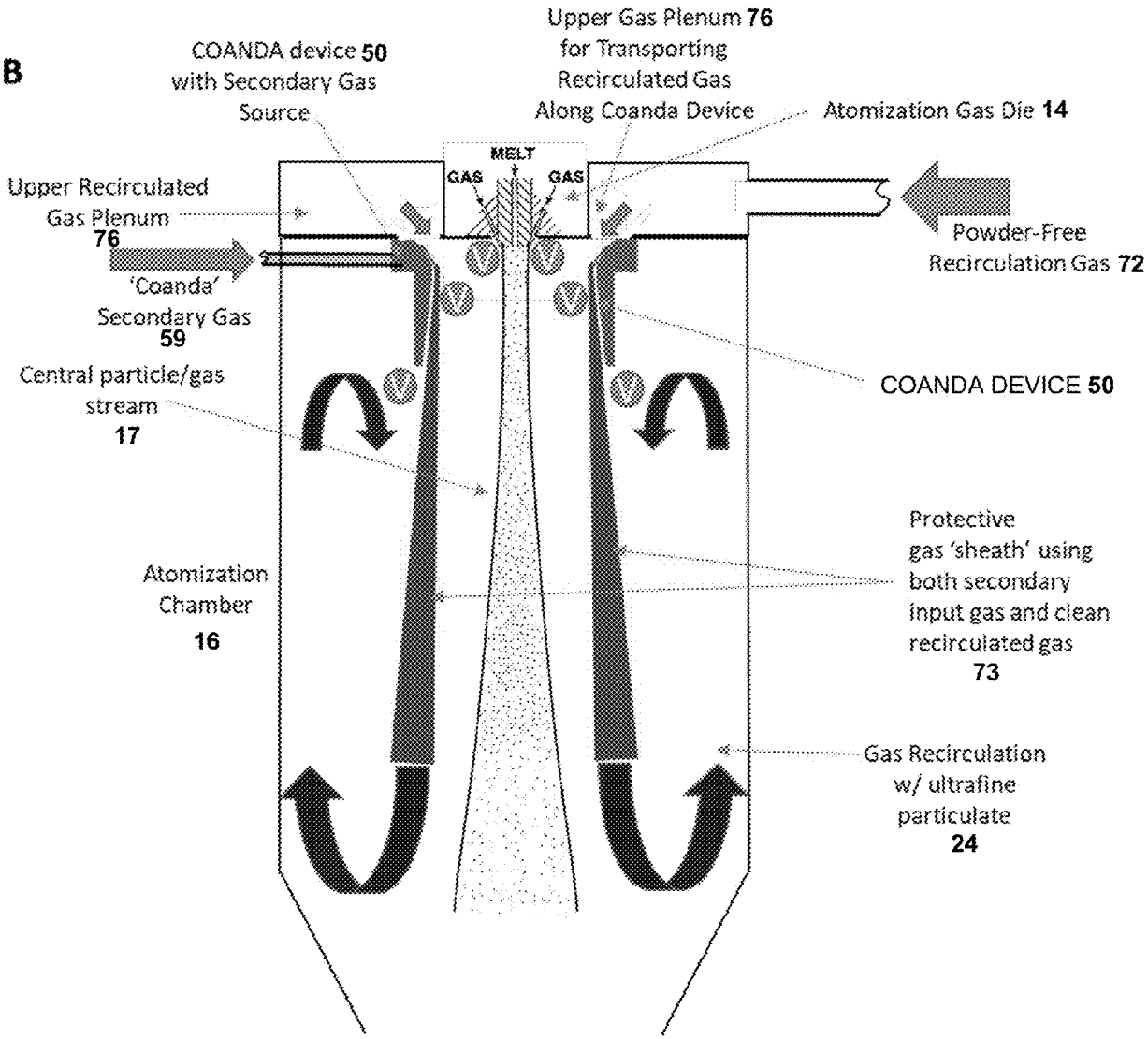

FIGS. 15A-B are illustrations of an apparatus for satellite suppression via external clean process gas recirculation and Coanda-driven gas sheath flows according to another exemplary embodiment of the invention. The Coanda flow device 50 is same as used in FIG. 12 with the modification that the screen/filter 60/61 is removed and the Coanda device 50 is mounted directly to the recirculation baffle. A big key here is use of 'free' recirculated, clean gas 72 from downstream in the process. Other patents have done similar, however required booster pumps or similar to force the recirculation. In this example, the difference includes the clean recirculated gas is being driven by the Coanda ring 50 and primary atomization gases, rather than requiring additional process inputs through pumps or other. Additionally, we include an 'expansion' section 70 in the recirculated clean gas section in order to allow the gas velocity to decrease and any particulate not captured in the ESP or Secondary Cyclone to drop out for truly powder-free recirculated process gas. FIG. 15A is a diagrammatic representation of a 2-ft atomization chamber 16 and method of clean process gas recirculation 70/72, including cyclonic separation and vertical expansion sections. FIG. 15B is a schematic view of the mechanism of satellite suppression via external process gas recirculation 70/72 and Coanda-driven 50 gas sheath flows. The powder-free recirculation gas could be supplied before the wet scrubber but after the cyclonic powder separation, or otherwise produced. Expansion chamber 70 (e.g. see FIG. 15A)

could be included in the recirculation gas flow path to allow for decreased velocity of the gas flow to drop out any final particulate matter.

Figure 16A:
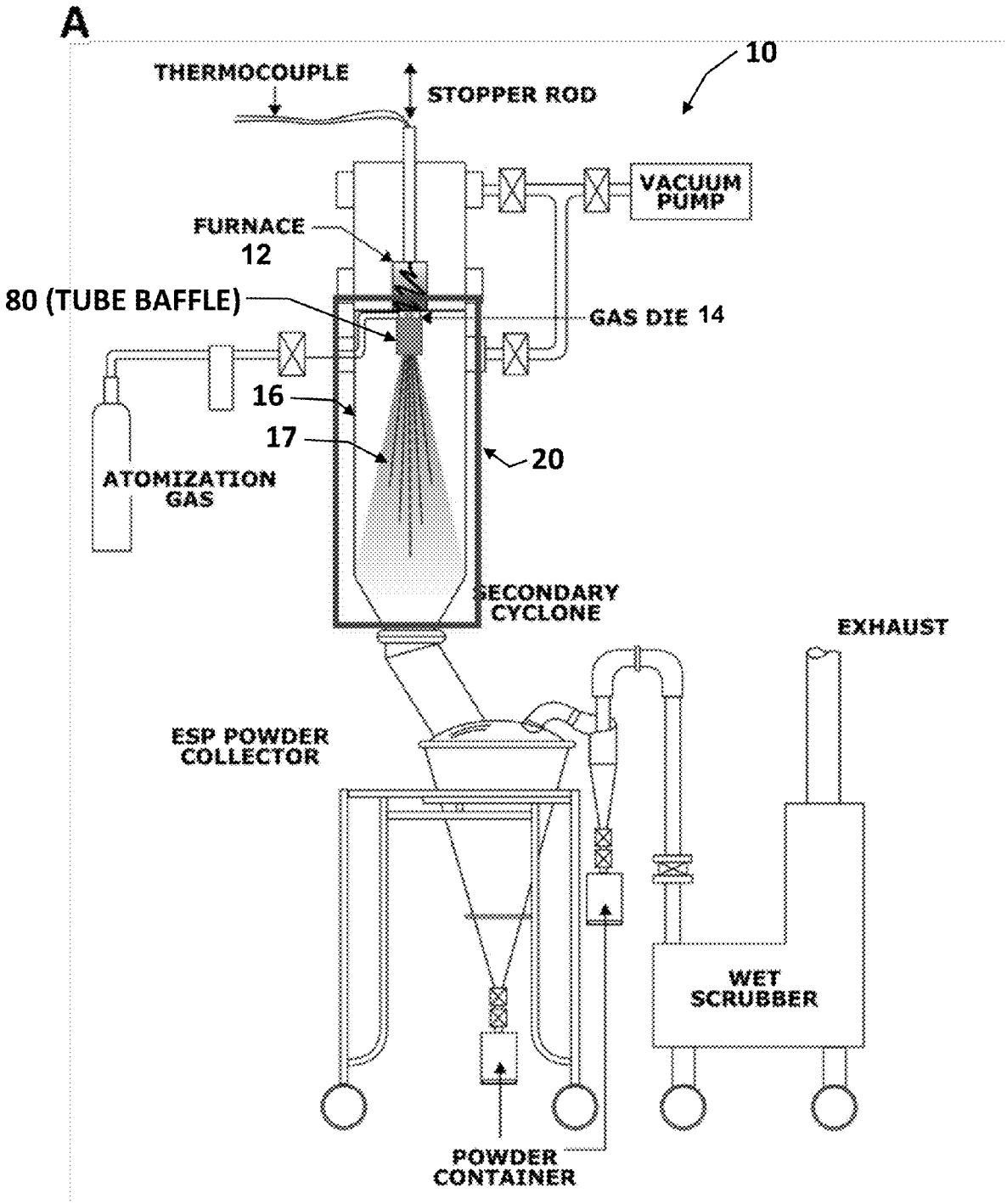
Figure 16B:
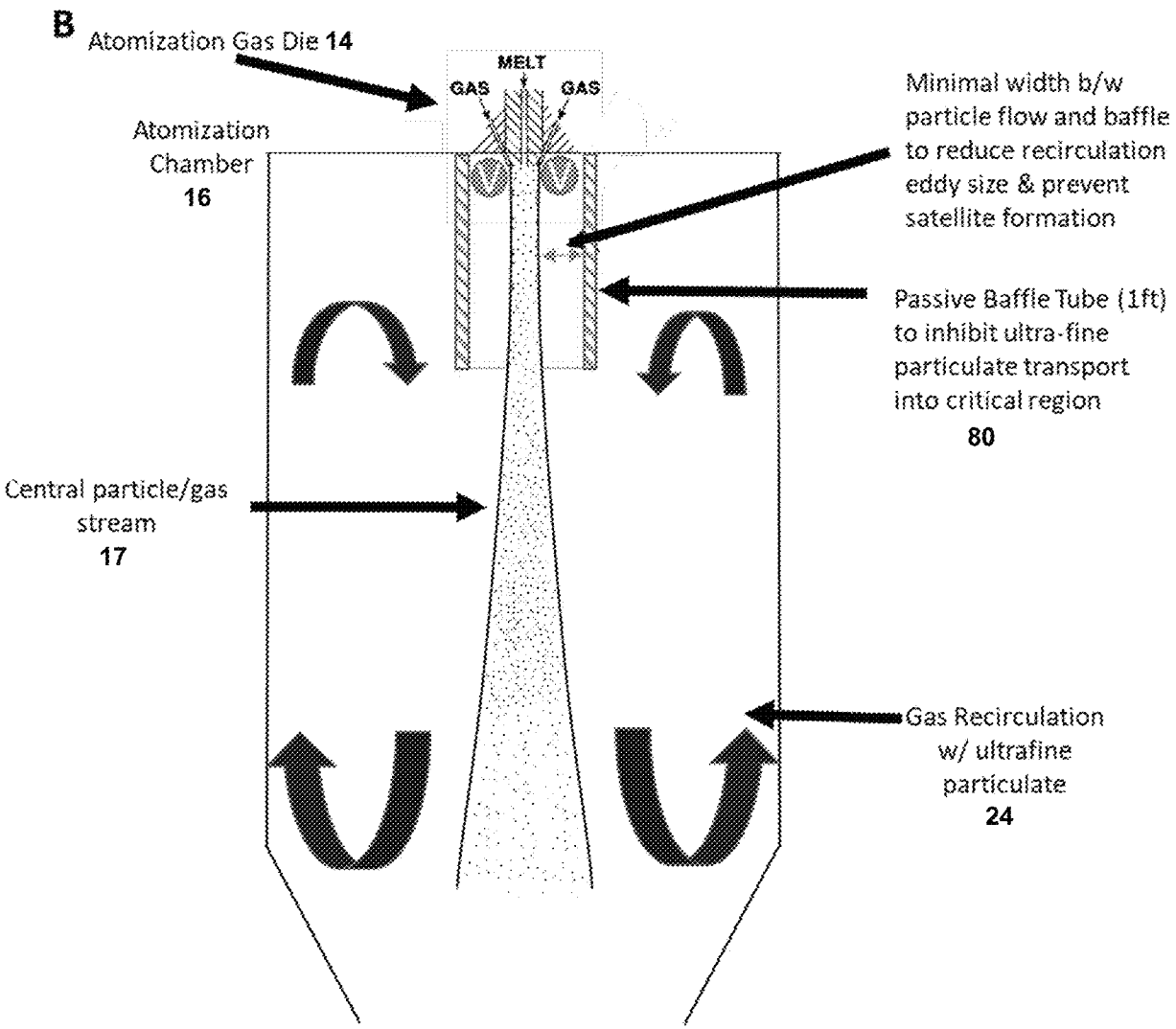
Figure 17A:
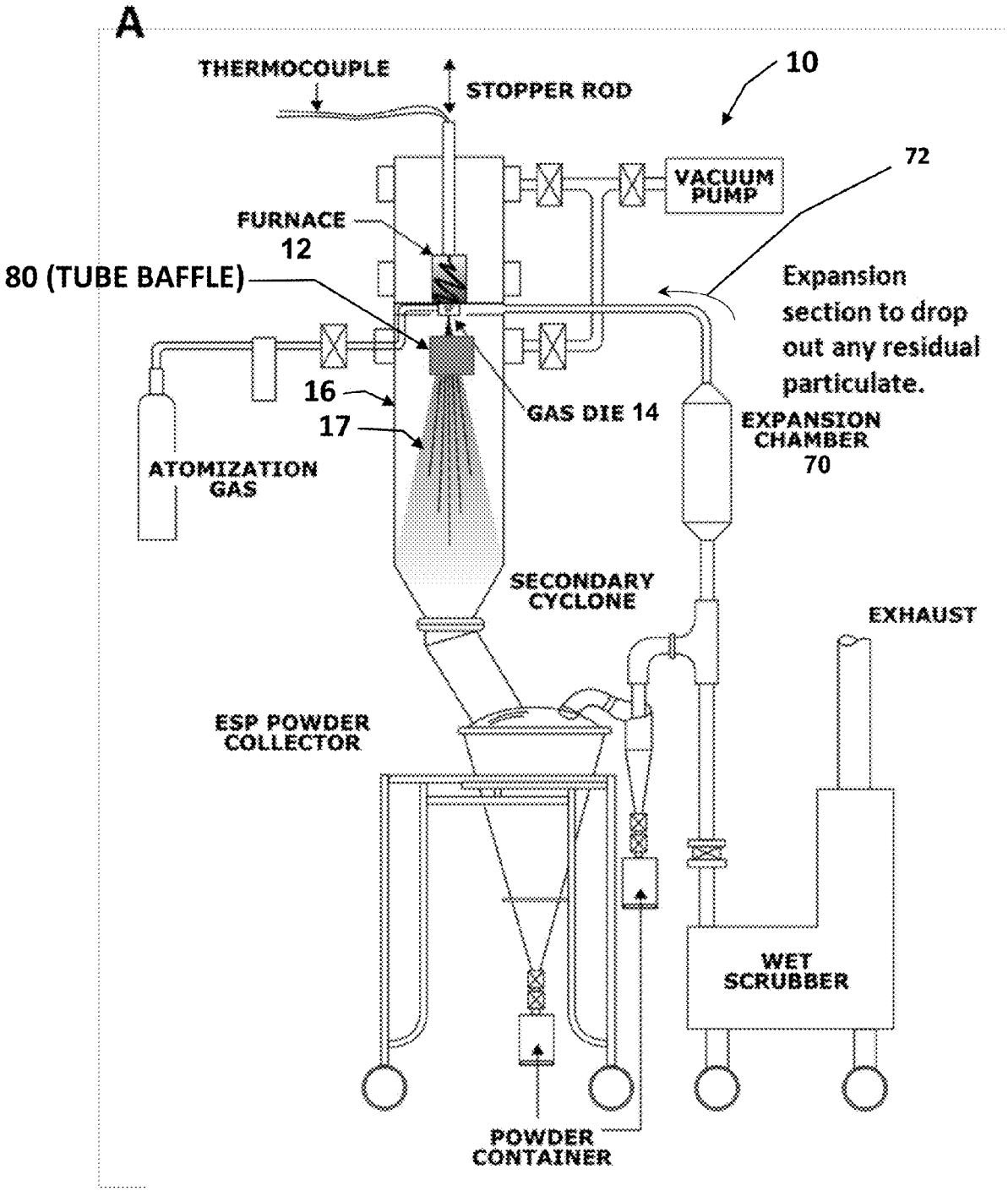
Figure 17B:
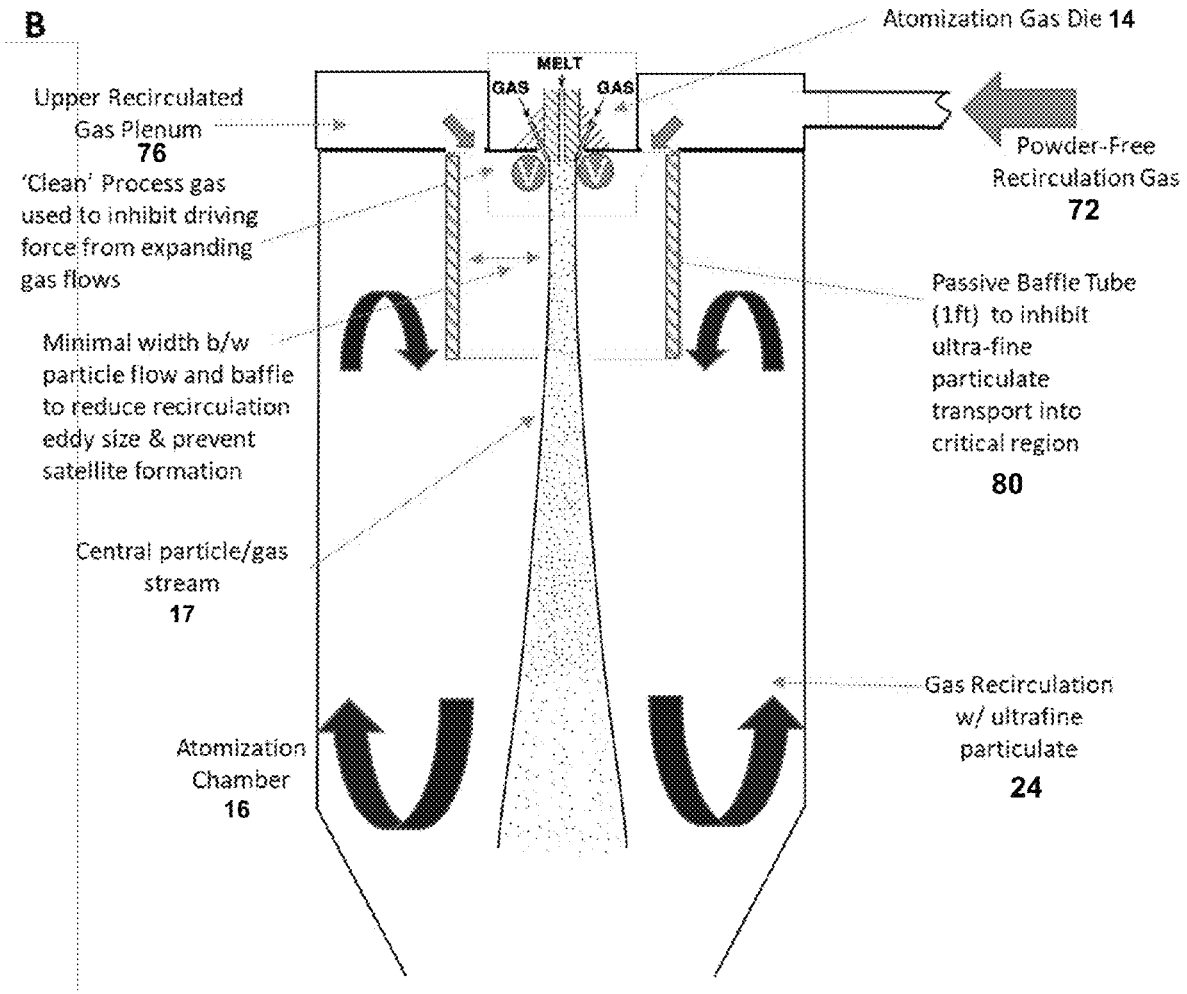

FIGS. 16A-B and 17A-B are illustrations of an apparatus for satellite suppression in a Pilot Scale Atomizer with a 2 foot chamber utilizing passive baffle(s) 80 according to another exemplary embodiment of the invention. FIG. 16B is an enlargement and detailed view of the baffle 80 of FIG. 16A. This is a first example of a passive baffle 80. A flow baffle 80 can be as simple as a metal cylindrical tube (~1 ft dia.) mounted around the primary flow path. In this example the satellite suppression in Ames Lab Pilot Scale Atomizer w/2-ft chamber using passive baffles. FIG. 16A is a diagrammatic representation of the 2-ft atomization chamber particular region of interest. FIG. 16B is an expanded view of region highlighted in FIG. 16A. illustrating the mechanism of satellite suppression via a 1-ft diameter passive baffle tube. FIG. 17B is an enlarged illustration of a passive baffle like that of FIGS. 16A-B for satellite suppression according to another exemplary embodiment of the invention based on the view of FIG. 17A. This is a second example of a passive baffle. In this example satellite suppression is via both External Clean Process Gas Recirculation 70/72 and passive baffle 80. FIG. 17A is a diagrammatic representation of the 2-ft atomization chamber and method of clean process gas recirculation, including cyclonic separation and vertical expansion sections. FIG. 17B is a schematic view of the mechanism of satellite suppression via external process gas recirculation and a 1-ft diameter passive baffle tube. The figures show two different implementations of the use of baffles: FIGS. 16A-B is direct mounting of a smaller diameter (~1 ft) metal cylinder 80 around the atomization chamber 16 to reduce the scale of the recirculation eddies and reduce access to the critical satelliting region for recirculation flows. FIGS. 17A-B is the direct mounting of the cylindrical baffle 80 to the same external clean process gas recirculation flow 70/72 described in FIGS. 15A-B. This incorporates the benefit of a baffle 80 but also aids in suppressing the vacuum created by the expanding gas jets from the primary atomization region. One additional feature that could be included would be an expansion chamber in the upward flowing pipe which allows for decreased velocity of gas flows to drop out any final particulate matter. See FIGS. 15A-B. Essentially, this is one of the easiest implementations of this is to use a cylindrical baffle 80 of a much narrower diameter than the spray chamber and suspend it across the critical satelliting region. Significant anti-satelliting has been observed with extremely narrow spray chambers (i.e. 1 ft diameter), but cannot often be used for the entire spray chamber due to the spray pattern hitting a narrow chamber prior to solidification. However, if a narrow baffle 80 is put in just where critical satelliting can occur, this can provide similar advantages in terms of anti-satelliting.

IV. DETAILED DESCRIPTION OF EXEMPLARY EMBODIMENTS OF THE INVENTION

A. Overview

For a better understanding of the various aspects of the invention, several examples of how those aspects can be practiced are set forth now in detail. It is to be understood that these are exemplary; they are neither inclusive nor exclusive of all forms and embodiments the aspects of the invention can take. For example, variations obvious to those skilled in this technical art are a part of the invention and its aspects.

Some of the examples are discussed in the context of specific GA set-ups or operation, or specific AM applications. As will be appreciated by those skilled in this art, at least certain aspects of the invention can be applied in analogous ways to other such set-ups, operations, or applications.

As will be appreciated by those skilled in this technical art, the exemplary embodiments provide details regarding at least the following apparatus and method aspects of the invention in terms of suppression of satellites:

A) spray chamber geometrical design (limiting extra free volume in diameter for macro recirculation and smoothing exit flow to limit an abrupt change in cross-section that promotes flow reversal)

B) passive flow devices/baffles to redirect ultrafine particle flow, preventing intersection with molten/semi-molten region of atomizer spray, and C) active flow devices (e.g. Coanda ring flow shield around initial portion of atomizer flow) that use supplemental gas flows to redirect particle-laden recirculation flow away from critical region of atomizer spray.

The following references are each incorporated by reference herein and provide background information for aspects of the invention:

U.S. Pat. No. 5,125,574 issued Jun. 30, 1992
U.S. Pat. No. 5,228,620 issued Jul. 20, 1993
U.S. Pat. No. 6,142,382 issued Nov. 7, 2000
U.S. Pat. No. 9,981,315 B2 issued May 29, 2018

The following are prior art publications or patents, each incorporated by reference herein, that provide background information about others' work in this technical field.

Dawes et al., *Introduction to the Additive Manufacturing Powder Metallurgy Supply Chain*. Johnson Matthey Technol. Rev, 2015, 59, (3), 243-256

U.S. Pat. No. 4,233,007
U.S. Pat. No. 4,619,597
U.S. Pat. No. 9,718,131

The following are patents, each incorporated by reference herein, that provide background information about certain techniques or components that are used in exemplary embodiments according to the invention.

U.S. Pat. No. 8,756,040
U.S. Pat. No. 8,775,220
US 2018/0260499 A1
US Published Patent Application 2018/0133793A1
US Published Patent Application 2014/0212820 A1
US Published Patent Application 2013/0053796 A1
US Published Patent Application 2002/0125591 A1 issued Sep. 12, 2002
US Published Patent Application 2008/0271568 A1 issued Nov. 6, 2008

B. Generalized Embodiments

At a general level, methods, apparatus, and systems according to at least certain aspects of the invention can be made and used as follows.

The broad applicability of at least certain aspects of the present invention derives from the ability to determine the critical location where external satellite formation occurs and where conditions exist that promote external satellite formation for any gas atomization system or design and allows for the rapid assessment of the effectiveness of various satellite reduction strategies, including but not limited to several novel embodiments detailed herein. Aspects of this invention can be utilized during initial atomization system design in order to evaluate effective chamber geometries and enabling strategies which reduce/eliminate satelliting, or can be retrofit to existing systems and allows for economic evaluation of effectiveness based on initial capital expenditures versus increased operating requirements/expenses.

1. Computational Fluid Dynamics (CFD) Methodology

Figure 2A:
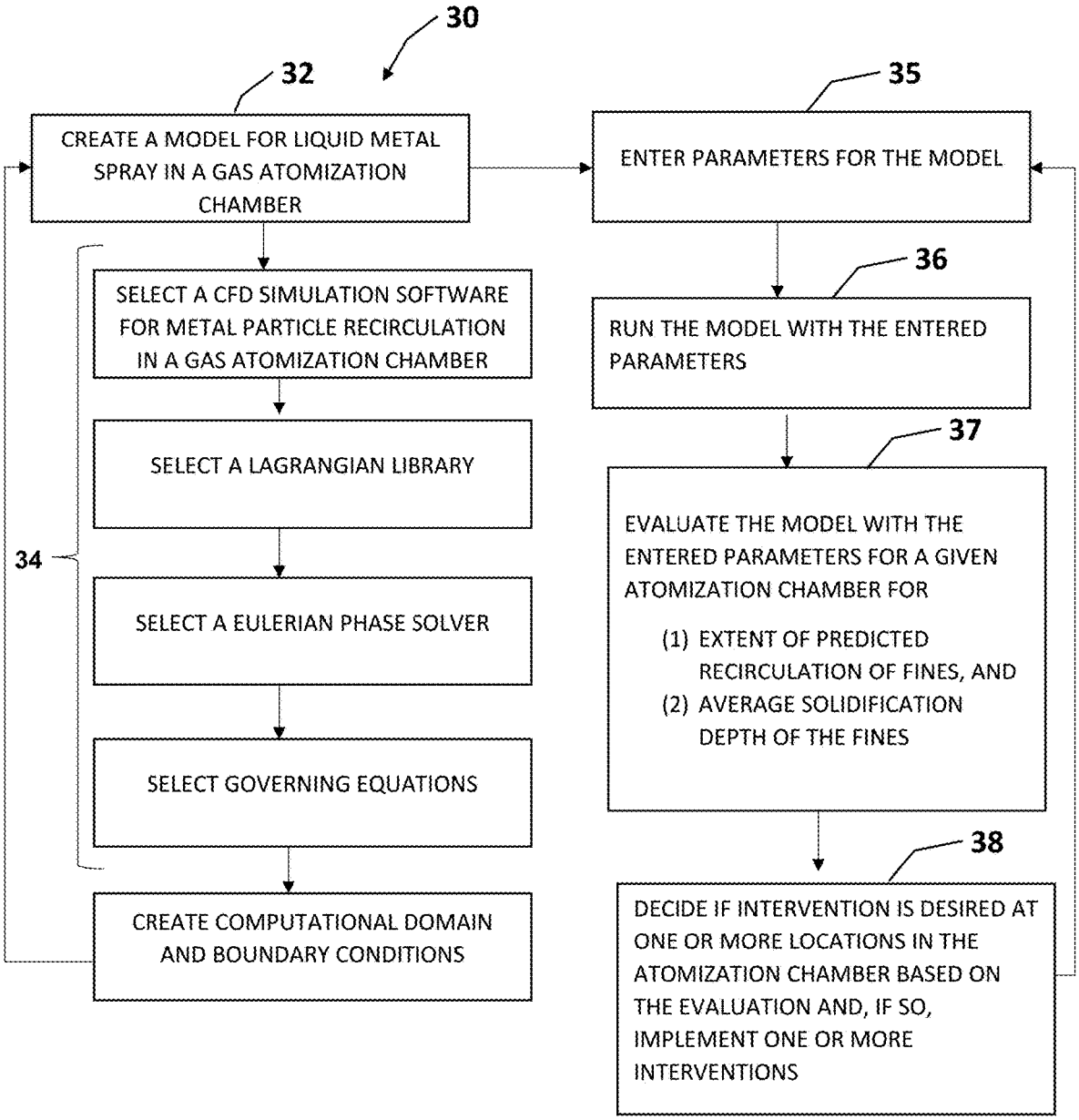
FIG. 2A is a high level generalized block diagram of a method 30 of identifying locations in a gas atomization chamber for intervention to deter satelliting by recirculation of fines according to an exemplary embodiment of the present invention.

One aspect according to the invention utilizes CFD simulation software to track metal particulate recirculation in an atomization spray chamber. FIG. 2A provides a high level generalized method 30. Method 30 creates a model that simulates particle P formation in a gas atomization system for a given set of operational and system parameters. It can therefore be used for a wide variety of possible powderization by gas atomization techniques. The model can be built according to selected parameters, including a simulation software, a mathematical model, computational domains and boundary conditions, and other characteristics selected by the designer. The model is powerful in the ability to provide information that can be used to identify techniques and locations for possible intervention to suppress satelliting.

Once the model 32 is designed, the parameters for a given GA set up can be entered. See 35, and the model run to simulate the GA operation. See 36. The simulations can be used to evaluate conditions relevant to creation of satelliting (per FIGS. 1C-D). See 37. This can include locating where $T_p$ drops below solidus and comparing it to the particle volume fraction, $\alpha$, and then predictions can be made of the success of a given mitigation strategy. See 38.

As will be appreciated, the modelling can take different forms and embodiments. For example, non-limiting examples of some features of the modelling are illustrated in FIG. 2A at 34. In one example, the metal droplets/particles, i.e., in the disperse phase, are simulated with a Lagrangian library and coupled to a gas Eulerian phase solver, a pressure-based transonic compressible flow solver. Governing equations are used to create a model for liquid metal spray. A computational domain and boundary conditions for an atomization chamber were designed and used in the simulations to reduce computational overhead.

As such, a computational baseline for critical sources/locations of satelliting behavior can be created. Parameters about the powderization process (e.g. type of material, size and characteristics of the gas atomization chamber system, atomization pressure, etc.) are programmed into the model. Analysis of thermochemical properties of the alloy, including liquidus and solidus temperatures, are compared with simulation model results to identify areas in which to address satelliting. The modelling can reveal locations in need of process enhancement, including interventions, regarding deterring satellite formation. For example, the modeling can reveal such things as (a) the extent of predicted recirculation of fines and (b) average solidification depth.

Intervention techniques can be designed based on the results of the simulation. They can include active and passive techniques, or combinations of the same, including to reduce fines recirculation. The results are economical process optimization to produce powder feedstock for AM or other uses by promoting highly spherical gas atomized powders with minimal satellite content.

2. Atomization Chamber Interventions to Mitigate Satelliting

In one aspect according to the invention, the atomization chamber includes passive, active, or combined passive and active anti-satelliting apparatus or techniques, sometimes called herein "interventions". The unifying concept is that each in some manner disrupts, modifies, or diverts the fine powder recirculation away from critical satelliting regions in the chamber in a manner to mitigate satellite formation there.

Figure 3:
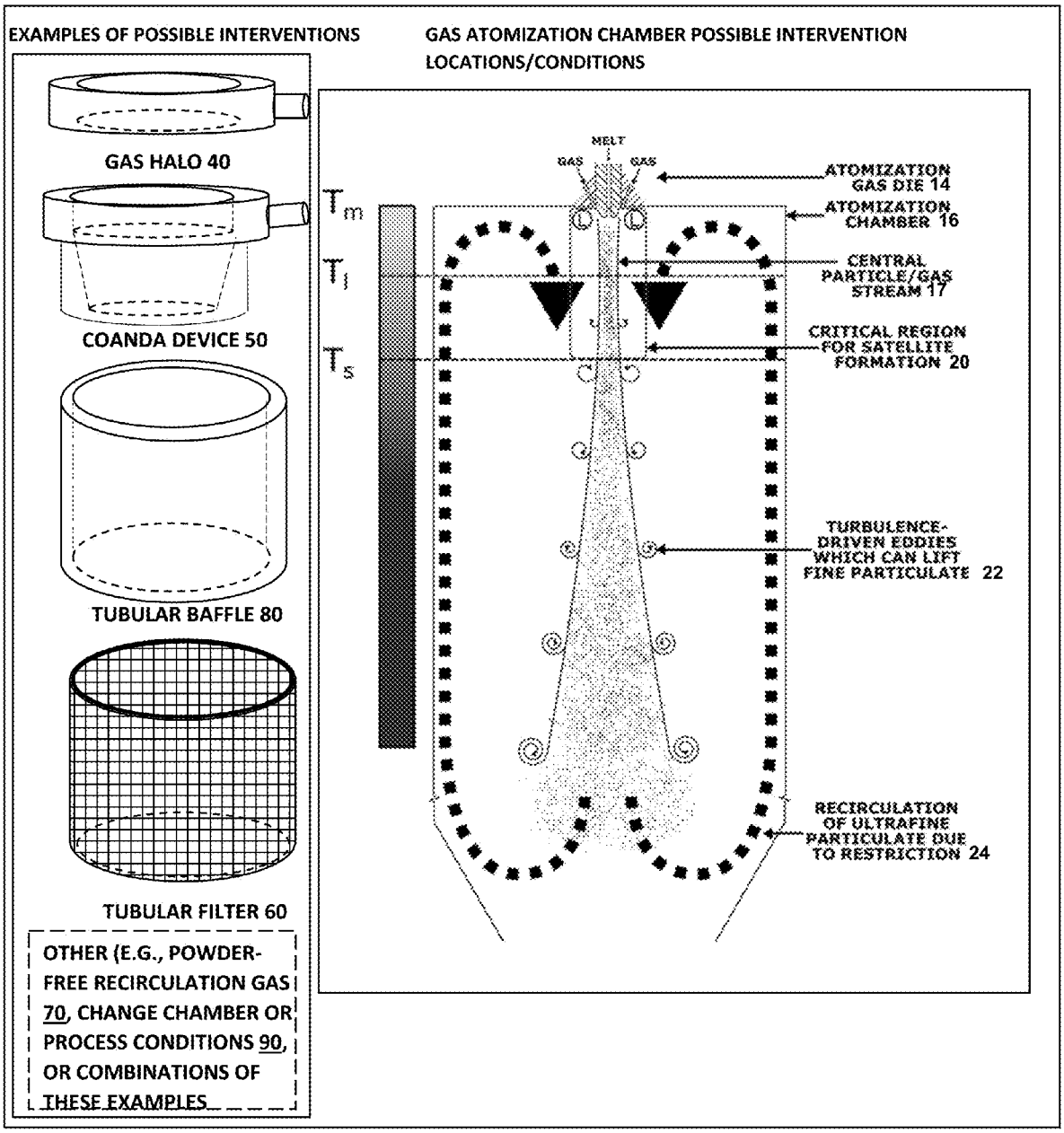
FIG. 3 is a high-level diagram of examples of satelliting interventions for consideration of placement in or with a gas atomization system according to exemplary embodiments of the present invention.

FIG. 3 gives non-limiting examples of interventions according to exemplary embodiments of the invention. Those examples include gas halos 40, Coanda devices 50, filters 60, powder-free recirculation gas 70, tubular baffles 80, and other techniques (e.g. design of GA chamber 16 and processing parameters 90). They can be used individually or on combinations. They can be influenced by simulating proposed GA processing with the model of FIG. 2A. As such, this aspect of the invention is powerful in satelliting suppression, both with respect to effectiveness of suppression to improve the ultimate powder output, but in the flexibility to adapt to and address, and even optimize, the options for satelliting suppression in efficient and economical ways.

Technical problems in the state of the art have been summarized supra. There are a number of ways to convert metal-based feedstock to metal powder. See, for example, Dawes et al., Johnson Matthey Technol. Rev, 2015, 59, (3), 243-256, incorporated by reference herein. However, there are a variety of competing factors involved. Some of them are antagonistic with one another. Balancing of cost, complexity, end powder requirements, ability to adapt/vary to different processing set-ups and requirements are some of those factors. Gas atomization (GA) is one powder conversion technique, but with GA itself there are many competing factors including those listed above. There is considerable variability in set-ups, size/scale, and effectiveness for certain powder requirements. One particular issue is satelliting, which itself is dependent on a variety of different factors. This is recognized in Dawes et al., *Introduction to the Additive Manufacturing Powder Metallurgy Supply Chain*. Johnson Matthey Technol. Rev, 2015, 59, (3), 243-256 as a significant issue with GA. Thus, technical problems in the state of the art relating to effective control of satelliting in GA is neither trivial nor predictable.

The present invention pertains to solutions to the technical problems in the state of the art in several aspects.

In a first aspect, solutions according to aspects of the invention addresses satelliting caused by recirculation of fines and ultra-fines during GA processing with interventions against it or at selected locations of the atomization or spray chamber of the GA set-up. Such interventions can be passive, active, or a combination of both.

At a general level, passive apparatus/techniques can include, but are not necessarily limited to:

a. gas flow controlling devices or surfaces such as passive baffles that can disrupt, revise, or otherwise modify typical spray chamber macro-recirculation in a manner effective to mitigate satelliting in the critical regions; or b. Coanda-effect-based surfaces that can disrupt, revise, or otherwise modify typical recirculation in a manner effective to mitigate satelliting in the critical regions; or c. filters emplaced in the recirculation pathway in a manner effective to allow recirculation gas flows to continue, but to reduce or remove particles that cause satelliting from reaching the critical regions; or d. combinations of any of the foregoing.

At a general level, active apparatus can include, but are not necessarily limited to:

a. controlled and directed fluids (gas phase) that can disrupt, revise, or otherwise modify typical recirculation in a manner effective to mitigate satelliting in the critical regions; or b. controlled and directed fluids (gas phase) that can block or wall off recirculation in a manner effective to reduce or remove particles that cause satelliting from reaching the critical regions, including sheath flows; or c. combinations of any of the foregoing; or d. combination of any of the foregoing with any of the passive apparatus or techniques.

While such apparatus/techniques may add somewhat to the cost or complexity of a system set-up or operational expenses, the benefits of effective satellite mitigation can be substantial. For example, intervention passive, active, or in combination along the primary axial gas flow from the gas die in GA can influence satellite-causing flow eddies along the primary axial gas flow to deter ultra-fines moving to crucial regions that result in satelliting. Another example is intervention by interposing in the recirculation of fines that tends to occur in GA from the primary axial gas flow back up to low pressure regions at or near the gas die. One example is a filter that blocks such particle from re-entering the axial flow. Another is sheathing or walling off such return with secondary gas flows.

3. Combination of Prediction Method and Intervention Apparatus/Technique

Another aspect according to the invention is the combination of both the computerized modelling and an intervention apparatus/technique as individually described above. This promotes optimization of satellite mitigation by generating a rapid evaluation of any given GA set up via acquisition of the required data and use of the relevant modelling methodology (with these input parameters) to identify the critical regions. This promotes optimization of satellite mitigation by enabling selection of an intervention apparatus or technique that is deemed most effective for mitigation, cost, and practicality for a given application.

As discussed above, method 30 can inform both design and operation of GA set ups to reduce satelliting. In one aspect computer-based simulation modelling, using insights and discoveries of the inventors, allows for rapid evaluation of almost any GA set up and with efficient use of computer processing resources.

In one aspect according to the invention, effectiveness of intervention can be improved by predicting the critical area(s) for intervention in a given GA atomization chamber. At a general level, effective predictions are accomplished by combining:

a. droplet cooling and solidification modelling related to GA for a given feedstock (e.g. metal or metal alloy); and b. computer-related Lagrangian particle tracking simulations related to a given GA set-up (gas atomization die geometry/type and atomizer spray chamber) and its operating conditions for the given feedstock.

Based on the foregoing, critical areas for satelliting mitigation intervention can be predicted. The prediction can be used to select an intervention, or in some cases, beneficial modification of processing parameters with no additional intervention.

In addition, the foregoing can also be used to evaluate/predict the magnitude of any satelliting issues for the given feedstock and given GA set-up with or without an intervention.

Then, the result of evaluation based on the simulations from the modelling allows the designer the option to select satelliting interventions as needed or desired.

As such, the generalized embodiments provide for individual improvements of satellite mitigation, as well as combined interventions and symbiotic improvement, according to need. As will be appreciated by those skilled in the art, the number of parameters and factors that are involved in GA are many (e.g. feedstock, pour tube orifice size, pour temperature, chamber diameter/length/form factor, gas die pressure, gas die jet area, gas mass flow, melt mass flow, gas/metal ratio, gas jet apex angle, average particle diameter, etc.). It is an inherently complex and unpredictable technology. Variation in one of these parameters can affect, sometimes adversely, one or more others. The inventors' specific modeling methodology combines specific method steps and features that allow practical and effective critical-area-predictions and intervention strategies for any GA set-up and operating parameters.

Similarly, complexity and variability of these numerous GA factors makes introduction of additional structural barriers or influences into the atomization chamber during operation inherently difficult. Adding a surface, structure, filter, or air flow can affect, sometimes adversely, the GA operation. The inventors' interventions thus may have counter-intuitive aspects.

C. Specific Embodiments

For further understanding of the generalized aspects of the invention, specific examples of how they can be made and used will now be set forth. Reference will frequently be made to the figures in the appended Drawings. For a better understanding of examples of possible anti-satelliting interventions, an example of the methodology that can be used to assist in placement and/or estimating efficacy of any such intervention for a given GA set-up is discussed first.

1. Method of Determining Critical Areas for Intervention

With particular reference to FIGS. 2A-B to 7A-B, methods and techniques for practicing the method are set forth.

a. Computational Fluid Dynamics (CFD) Methodology

Figure 2B:
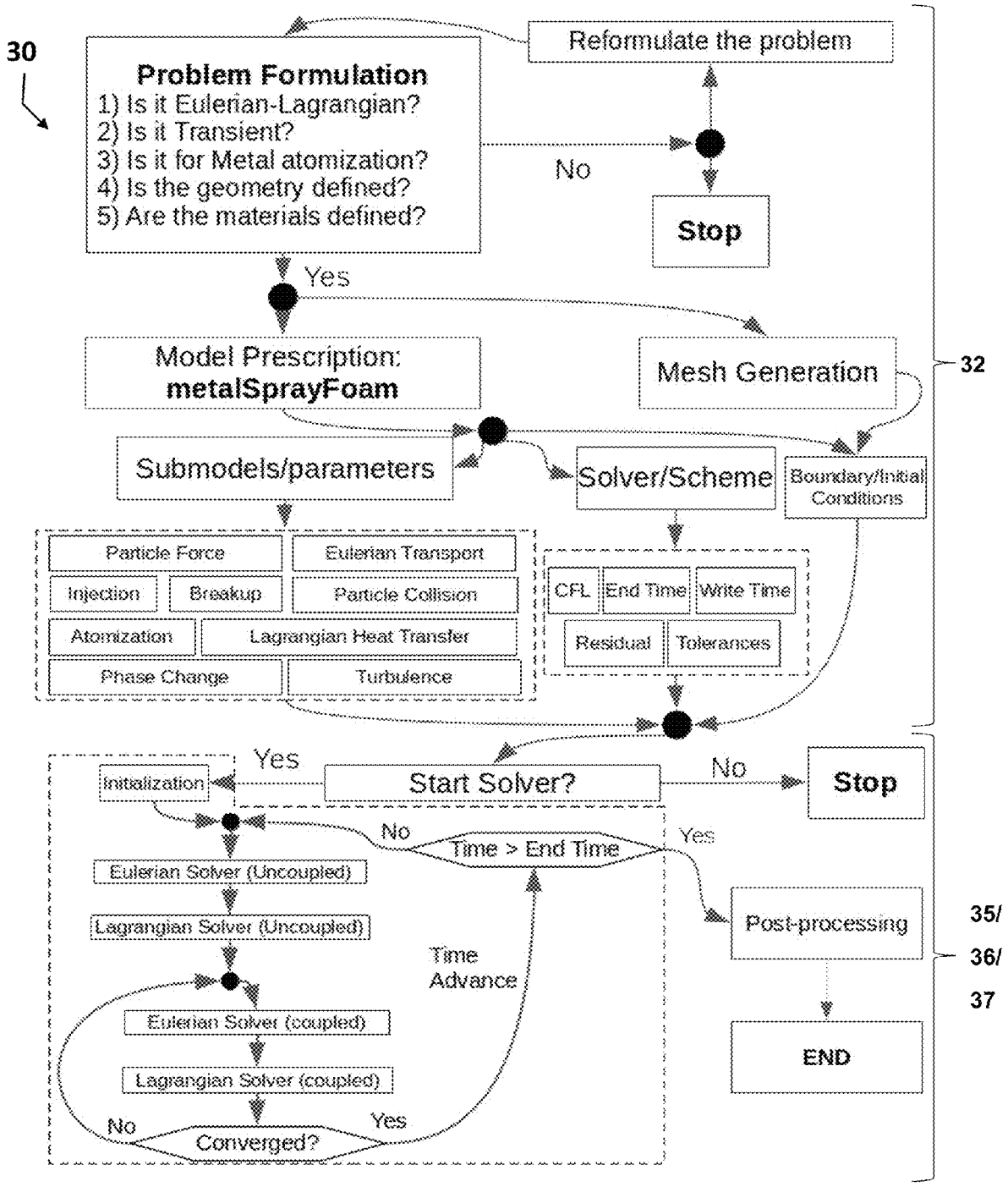
FIG. 2B is a high-level diagram of one specific example of a computer simulation/modeling method 30 according to an exemplary embodiment of the invention.

With reference to FIG. 2B, a specific example of a simulation model 30 is disclosed. A detailed CFD simulation code 32 used to track metal particulate recirculation in the atomization spray chamber was developed based on OpenFOAM, an open-sourced CFD package [see, e.g., openfoam.org]. More specifically, the metal droplet/particles, i.e., the disperse phase, are simulated with the Lagrangian library in OpenFOAM, and coupled to a gas Eulerian phase solver, which is based on sonicFoam, a pressure-based transonic compressible flow solver in OpenFOAM. In the following, the governing equations solved in this model for liquid metal spray are introduced, and the relevant constitutive models are briefly discussed.

Background information on CFD modeling and simulations is discussed at U.S. Pat. No. 8,756,040, incorporated by reference herein; openFOAM™ as CFD simulation software at U.S. Pat. No. 8,775,220, incorporated by reference herein; and Lagrangian particle tracking modelling at US 2018/0260499 A1, incorporated by reference herein.

For the Lagrangian phase, the droplet position, momentum, and temperature are governed by the following three equations, $$\frac{dX_d}{dt} = u_d \quad (1)$$

$$\frac{du_d}{dt} = \frac{1}{\tau_d}(u_d - U_g) + g \quad (2)$$

$$\frac{dT_d}{dt}\left[(1-f)c_{p,l} + fc_{p,s} - H_f\frac{df}{dT_d}\right] = -\frac{6h}{\rho_d d_d}(T_d - T_g) - \frac{6\epsilon}{\rho_d d_d}\left(\sigma T_d^4 - \frac{G}{4}\right) \quad (3)$$

where $X_d$ is the droplet position at a given time, $u_d$ is the droplet velocity, $U_g$ is the gas velocity. $\tau_d$ stands for the drag relaxation time scale and is calculated using the standard empirical correlations for a rigid sphere particle. The energy equation for droplets, Eqn. 3., includes both convection and radiation heat transfer, in which $T_d$ and $T_g$ are the droplet and gas phase temperature respectively. h stands for the heat convection coefficient and is calculated using conventional Ranz-Marshall correlations. E is the emissivity, $\sigma$ is the Stefan-Boltzmann constant, and G is the local irradiation, which is solved with the conventional P1 model. P1 model is a known regression-type statistical model that predicts probability of presence or absence of a relationship between pairs of data (see, e.g., P1 is the simplest model to compute irradiation. Other options are more computationally expensive. A P1 regression-type statistical model for radiation is well known in the literature and has been cited for decades.). We also consider partial solidification in the model. $c_{p,l}$ and $c_{p,s}$ stand for the heat capacity of liquid and solid metal, respectively, $H_f$ is the latent heat of fusion, and f is the solid fraction in a droplet, which is calculated with Scheil's solidification theory [see, e.g., etheses.whiterose.ac.uk/14831/1/366334.pdf; and a fundamental reference at: E. Scheil, "Bemerkungen Zur Schichtkristallbildung," Z. Für Met., 34(3), 1942, pp. 70-72, both incorporated by reference herein] as, $$f = 1 - (1 - f_r)\left(\frac{T_M - T_d}{T_M - T_L}\right)^{\frac{1}{k_e - 1}} \quad (4)$$

where $T_M$ is a reference temperature depended on the metal species, $T_l$ is the liquidus temperature, $f_r$ is the solid fraction at the end of recalescence. The atomization and breakup processes near the nozzle can also be modeled in this code, however verification and validation of the available models are needed for simulation of liquid metal droplet breakup (with, e.g., high melting temperature and surface energy) since they were developed for liquid fuel sprays. Therefore, in the example simulations given below, the particles were injected with prescribed size distribution near the edge of the atomization gas die, which was obtained from one of the experimental measurements. The method is illustrated in FIG. 2B. In particular, this code is based upon the open-source code OpenFOAM, implemented to modify the base package to include modules most relevant to modeling the satellite formation problem shown here.

The governing equations of the gas phase include the transport equation of mass, momentum and total energy of the gas:

$$\frac{\partial \rho_g}{\partial t} + \nabla \cdot (\rho_g U_g) = S_{pg} \quad (5)$$

$$\frac{\partial (\rho_g U_g)}{\partial t} + \nabla \cdot (\rho_g U_g U_g) = -\nabla p + \rho_g g + \nabla \cdot \tau_g + M_{pg} \quad (6)$$

$$\frac{\partial (\rho_g U_g)}{\partial t} + \nabla \cdot (\rho_g U_g E_g) + \nabla \cdot (U_g p) = -\nabla \cdot q + \nabla \cdot (\tau_g \cdot U_g) + \rho_g g \cdot U_g + H_{pg} \quad (7)$$

where $\rho_g$ is the gas density, $U_g$ is the gas velocity, p is the pressure, g is gravity acceleration, $\tau_g$ is viscous stress tensor, total energy $$E_g = e_g + \frac{1}{2}|-U_g|^2$$

with $e_g$ being internal energy, and q is heat flux. The term, $S_{pg}$, $M_{pg}$, and $H_{pg}$ are the mass, momentum, and energy source terms due to the coupling with the spray. The gas thermal properties are calculated by using JANAF (see janafinist.gov from National Institute of Standards and Technology) thermochemical tables, and viscosity is calculated using Sutherland model.

b. Implementations of the Approach

Figure 4:
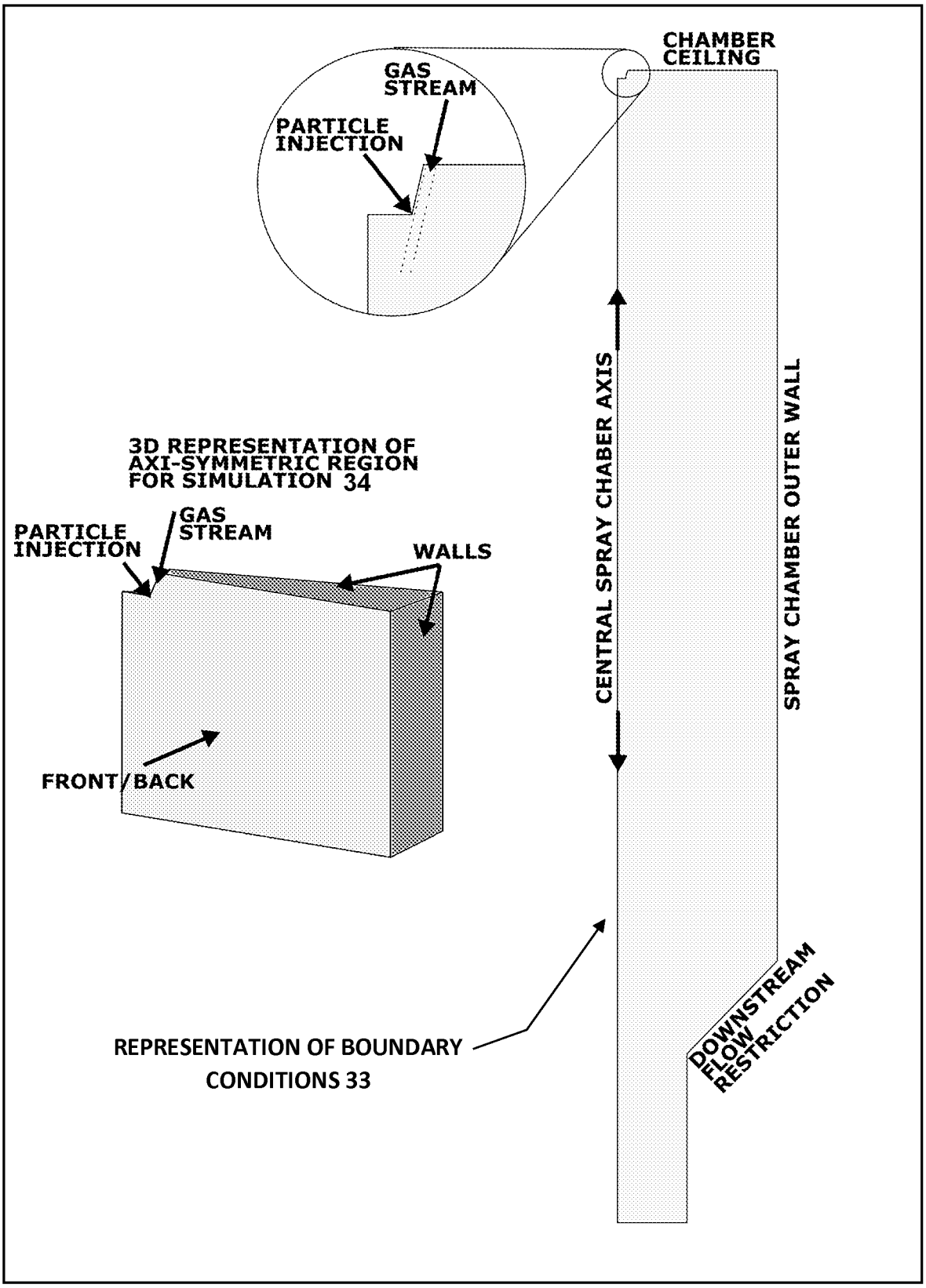
FIG. 4 is diagrammatic illustration of the axi-symmetric computational domain and boundary conditions used with an exemplary embodiment of a method according to the invention such as in FIG. 2B. This represents a wedge shape volume of the spray chamber and is used for assessment of recirculation and satellite suppression effectiveness.

Due to the high computation cost of full 3D simulations, a 2D axisymmetric "wedge-shaped" computational domain with a 4° angle is used in the simulations of the atomization spray chamber, as illustrated in FIG. 4. FIG. 4 is an illustration of the computation domain 34 and boundary conditions 33 relevant to the approach for a small portion of the spray chamber. The mesh was generated with blockMesh provided by OpenFOAM, and the process was further enhanced with Python scripting to reduce the case setup time. For the investigations disclosed, the material is assumed to be Nickel, with the appropriate thermophysical properties included in the simulations in order to match the experimental validation studies.

c. Example 1: Experimental Baseline Investigation of Satelliting in Ames Lab Pilot Scale Atomizer Using Narrow 1-Foot Chamber This example is discussed with particular reference to FIGS. 5 and 6. FIG. 5 is a schematic view of an atomization apparatus 10 utilizing a narrow spray chamber 16 compared with a baseline device. FIG. 6 is a baseline Ni-base powder produced via low pressure atomization in a 1-foot chamber (ASC-1-29). FIG. 6, image A is a micrograph of a grab sample of powder produced showing the effect of "splatting" on the chamber wall. Red circles (an example at F) represent flakes which are undesirable for AM powders. FIG. 6, image, is a micrograph of as-processed powders which were sieved (45-106 μm) and 'deflaked' revealing minimal (nearly zero) satellite decoration.

Historical efforts in metal powder process improvements, especially for CC-GA atomization gas dies, were largely applicable for producing small powders (<45 μm), useful for many traditional powder metallurgical processes. This technique utilizes high atomization gas pressures and large gas jet apex angles in order to cause rapid disintegration of the melt to particles that quickly cool and solidify within the atomization chamber. The use of a narrow (i.e. 1 ft) atomization spray chamber for these processes was advantageous to inhibit recirculation and thereby suppress fine powder recirculation and gain control over external satelliting mechanisms. As can be noted from FIG. 5, in this method, a consistent chamber diameter is utilized to transport the powder and process gas to the primary powder collector and encourages uniform flow through the chamber 16. With increased demand for AM powders with larger particle sizes (45-106 μm), the practicality of using a narrow spray chamber for satellite suppression is not as desirable due to the greater spread of the atomized spray "cone" due to the reduced energy of the atomization gas flow needed for the reduced intensity of the droplet breakup mechanism. If a narrow chamber is used for this lower energy gas atomization, there is a greater propensity for liquid droplet collisions with the chamber wall and generation of undesirable splats or flakes in the generally spherical powder yield.

The basis for this example was built on several decades of experience with gas atomization of a wide variety of metals and alloys, but was focused on atomization of a pre-alloyed nickel-based superalloy utilizing ultra-high purity argon as the atomizing gas and relied upon a gas die with 36-jets sized 0.0635-inches in diameter and an apex angle of 20°. Low pressures (down to ~40 psi) were utilized in order to enhance the production of larger particles most suitable for AM applications. The specific benefit of the narrow spray chamber design (that minimized upward recirculation volume) for satellite suppression appeared to be amplified significantly by moving from traditionally high atomization gas pressures to very low pressures and this was demonstrated by the ability to maintain spherical smoothness of the resulting powder as shown in FIG. 6. However, there are considerable limitations for satellite suppression by the narrow spray chamber design for producing this larger size range of powders, including the need to avoid "splatted" particulate from premature collision with the spray chamber wall, especially during this low energy atomization process that produces a broader spray cone. Significant powder sorting effort was required to remove the "splatted" particulate which was inter-mixed with the satellite-free particles, thus providing further evidence that this spray chamber design method of intervention needed to be augmented by other types of intervention to suppress satellites to make the benefits more universal, independent of spray chamber design and atomization gas die design and operating parameters.

As noted, FIG. 5 is a schematic view of atomization apparatus 10 utilizing a narrower spray chamber 16 compared with the baseline device. FIG. 6 is images of baseline Ni-base powder produced via low pressure atomization in a 1-foot chamber (ASC-1-29), and in particular: FIG. 6, image A is a micrograph of grab sample of powder produced showing effect of "splatting" on chamber wall. Red circles represent flake F which is undesirable for AM powders. FIG. 6, image B is a micrograph of as-processed powders that were sieved (45-106 μm) and 'deflaked' revealing minimal satelliting.

d. Example 2: Computational Baseline Investigation of Satelliting in Ames Lab Pilot Scale Atomizer w/2 Foot Chamber Example 2 sets forth the baseline analysis of the critical sources/locations of satelliting behavior in a Pilot Scale Atomizer utilizing a 2 foot atomization chamber 16. The increase in chamber diameter provides a longer path length for the large particles to solidify before any potential impact with the chamber wall and is intended to limit the formation of 'flakes' and 'needles' in the resultant powder collected. In contrast to Example 1 however, the increase in chamber diameter and necessity to include a 2 foot to 1 foot reducer prior to the powder collection system creates a 'bottleneck' at the exit of the chamber 16 which creates a pressure differential in the system and encourages recirculation of process gas and ultrafine (typically dia.<20 μm) particulate up the chamber walls. Many commercial-scale systems utilize similar reducers within the atomization spray chamber which create similar bottleneck—recirculation driven flows.

The basis for this application of the CFD analysis methodology was focused on typical operational conditions for pure nickel atomization utilizing ultra-high purity argon as the atomizing gas and relied upon a gas die with 30-jets sized 0.082-inches in diameter at a 14° apex angle. Liquid metal temperature was assumed to exit from the melt transport tube at 1878 K at a flow rate of 0.164 kg/s which is typical for this gas die configuration and selected metal. Critical satelliting regions were investigated for three different atomization pressures, as shown in FIGS. 7A-B. In FIGS. 7A-B all values represent steady state flow conditions and a represents the time-averaged particle volume fraction, $d_p$ is the time-averaged mean particle diameter, and $T_p$ is the time-averaged particle temperature. Understanding the thermochemical properties of the metal or alloy, including the liquidus and solidus temperatures, as critical data input to the simulation model, along with the spray chamber dimensions and all operating parameters enables the model to provide a clear indication of the extent of intervention that is needed for effective satellite suppression. As can be seen across all cases, the average particle volume fraction (a) shows recirculation of the (cool and solidified) fine particulate upward along the chamber wall, being pulled towards the venturi vacuum created by the expanding gas jets from the atomization gas die 14. Any solution to limit these external satelliting mechanisms must be able to prevent the flow of the ultra-fine particulate to the area of the flow where the (generally coarser-sized) particulate temperatures are above the solidus temperature, i.e., at least semi-molten. Furthermore, it can be seen that higher gas pressures create a strong upward recirculation due to the overall pressure gradient inside of the atomization chamber, from the higher pressure of the constricted chamber outlet to the lower pressure of the region around the atomization gas die.

The $T_p$ represents the average particle temperature. Knowing the thermophysical properties of this material (nickel), we can identify the solidus temperature $T_s$ and probe the simulation results to determine regions above this critical temperature where satellite attachment could occur. As noted, FIG. 7A reveals simulation results for the Pilot Scale Atomizer at different operating conditions, and in particular, $\alpha$ is the time-averaged particle volume fraction after reaching steady state flow conditions, colored with a log scale. $d_p$ is the time-averaged mean particle diameter after reaching steady state flow conditions. Tp is the time-averaged particle temperature after reaching steady state flow conditions.

As can be seen from the foregoing, the spray chamber modeling methodology (e.g. FIG. 2A or 2B) meets one or more of the stated objectives of the invention. It provides a way to efficiently and rapidly characterize any GA set-up (e.g. chamber diameter, length, and form factor; feedstock for powdering, operating parameters, atomization pressure, etc.) relative to predicting location of critical satelliting regions in the atomization spray chamber 16. This can inform the user regarding evaluation of how urgently intervention is needed and where. As discussed, knowing the critical regions can allow effective evaluation and development of mitigation strategies.

As discussed above, the modeling can predict the critical regions in the chamber 16. One way is showing where the average solidus temperature would likely be for a given set-up and operating parameters. As discussed with respect to FIGS. 1C-D, deriving average solidus temperature allows prediction of the critical region of satellite formation. Having an accurate, detailed 2D axisymmetric representation 33 of the gas atomization spray chamber, as schematically illustrated in FIG. 4, allows prediction of placement for possible interventions in terms of height in the chamber, as well as relative to the primary gas stream from the gas die and the chamber sidewall. As can be seen in FIGS. 7A_B, the modelling and simulation can allow visualization of the specific GA set-up, including the 2D representation 33 of the chamber (including general form factor, height, diameter, gas die location). For example, FIG. 7A shows a set-up with a constriction narrower than the main chamber at the bottom exit, along with the side wall of the chamber. As indicated in other figures, these simulations include graphic scales matched to color to visualize operating parameters such as $\alpha$, $d_p$, and $T_p$ as discussed herein.

But further, it can allow optimization of effective interventions during initial design of a system. The computationally-efficient simulations allow the variables to be easily and quickly adjusted to allow comparison between interventions during retrofit design. The method can be used to compare different set-ups and operating parameters with the inclusion of possible interventions to predict whether the intervention will be effective, before any funds are spent on installation of an intervention and on GA trials. For example, a proposed gas halo can be simulated in terms of its placement and operating parameters and in the context of a given GA set-up and operating parameters. The modelling can provide information by which the designer can predict if the proposed gas halo will be effective.

As will be appreciated by those skilled in this technical art, the magnitude of satelliting reduction that is needed or desired can vary. For example, in some applications, any predicted or actual reduction of satelliting compared to operating without an invention will be considered satisfactory. In other applications, a significant reduction of predicted or actual satelliting will be considered satisfactory. For purposes of the invention, the term "effective" regarding reduction of predicted or actual satelliting will mean any predicted or actual reduction of satelliting compared to operating without the proposed intervention(s). But as shown herein, aspects of the invention can result in very significant satellite suppression over operating without the proposed intervention. In at least one example, the reduction can be quantified by a significant difference in various types of powder flowability measurements, e.g., Hall flowmeter, for powders that have dia.>45 μm.

There are several ways to define efficacy of this invention. One such method is through analysis of high-resolution micrographs of the powders using image analysis tools and actually performing a count of the average number of satellites per particle. Advances in machine learning are making this task much easier and informative way of quantifying the effectiveness of these strategies.

Additionally, powder rheometry/powder flow testing can effectively measure the flowability of a powder and is an external test which can be applied to qualitatively access the improvements from anti-satelliting strategies. These tests can be affected, however, by humidity in the air, oxide formation on the surface of the powders, or even static 'cling' making interpretation of these results a bit difficult at times.

The satellites S can be counted (manually or digitally) for a given number of particles P in a sample. Then, all the samples will give one statistical value, say X % content is satellited. The X % with apparatus and without apparatus are compared. The relative change in percentage could be the reduction or increase per use of the invention properly or wrongfully, or the lack of use.

As can be further seen, the methodology allows for a highly flexible and effective way to characterize any GA set-up in terms of critical satelliting regions. The simulations can be generated for different operating conditions and GA setups. It allows for side-by-side visualizations/comparisons. It can efficiently and automatically or at least semi-automatically predict the critical region(s) for a set-up. Thus, the prediction(s) are effective to help optimize an intervention.

As will be appreciated by those skilled in the art, the foregoing method meets or exceeds at least one or more of the stated objectives of this aspect of the invention. The precise steps of the methodology can vary. FIG. 2A indicates in general diagrammatic form one embodiment of the methodology. FIG. 2B gives a specific example. As indicated there, any GA set-up can be initialized into the modelling, as can a given set of operating parameters. The software would simulate the process, including particle tracking in the primary gas stream as well as eddying and recirculation of fines and ultra-fines that can cause satelliting. The process states can be derived, as in $\alpha$, $d_p$, and $T_p$ in the CFD results illustrated in the figures; all in the context of the specific physical boundaries of the given GA set-up (e.g. chamber height, diameter, and form factor; gas die location, and chamber sidewall). As such, predictions of where the critical regions of a given set-up are, and where particles are relative to chamber and process conditions in the chamber can be made. The modeling also reveals many more variables including gas and metal velocities in the various planes, gas temperature, and can even be used to create videos of the flow for performing transient analysis of startup or other such events. These three time-averaged variables, however, have proved to be most informative in the context of this invention.

2. Atomization Chamber Interventions to Mitigate Satelliting

Whether or not the method of predicting critical regions is utilized, examples of several specific interventions are now described. Some are passive. Some are active. Some combine passive and active. These examples will be discussed with particular reference to FIGS. 78A-F to 17A-B.

a. Example 3: Satellite Suppression in Ames Lab Pilot Scale Atomizer w/2 Foot Chamber Utilizing Downstream Gas Halos The atomization apparatus 10 commonly used by the applicants in proof of concept of at least this exemplary embodiment includes a single bottom-pour crucible capable of shorter duration batch runs when compared with more commonly used industrial 'tilt-pour' melting systems with a heated tundish. A tundish is a smaller reservoir with a small open bottom orifice and a large top receiver opening into which a large batch of molten metal is slowly poured. The open bottom orifice is mated to the ceramic pour tube which delivers the molten liquid to the atomization gas die 14. Due to the low quantity of material typically which can be run in a bottom pour crucible, in this embodiment of the invention, unlike many industrial atomizers which utilize a water jacket to keep the chamber walls sufficiently cool, the applicants utilized additional 'gas halos' 40 downstream in order to increase the rate of particle cooling, ensure chamber walls are maintained sufficiently cool, and provide the added benefit of allowing addition of different gas species and compounds to the spray chamber atmosphere to control the surface chemistry on the particles. Furthermore, the careful placement of these halos 40 can help to control the recirculation of fines within the spray chamber 16 and thereby reduce the external satelliting effect. Alternatively, incorrect placement of the halos 40 can result in a worsening of any constriction at the spray chamber exit and cause increased satelliting from recirculated powders. For example, adding too many halos or too much flow of supplementary gas into the spray chamber can overwhelm the exit capacity of the chamber 16 and add to the pressure driven flow dynamics inside the chamber. In general, supplementary halos 40 should be a) placed so as to divert the full chamber recirculation flows and to limit the upward transport of solidified ultrafine powders that are available for satelliting and b) placed such that a gas "curtain" is able to redirect secondary powder flows away from the critical satelliting regions.

Essentially, in an industrial tilt-pour system, hundreds of pounds of material are melted and poured into a smaller crucible—the tundish—which is connected to the ceramic pour tube that delivers the molten metal to the atomization gas die. This allows for industrial practitioners to run for many hours, even swapping the large metal bath in the middle of the run, or continually feeding this molten pool for continuous operation. Thus it is necessary for industrial practitioners to supply additional means of removing excess heat (the water jacket). A bottom pour crucible is a batch process with a limited volume of material which can be atomized and thus a limited duration of the run. Typically, the gas halos 40 are sufficient and beneficial to cool the atomizer components and prevent over-heating, as described later herein.

Generally, these passivation processes are known or in published literature or patents (including by the present authors). Gas species can include tightly controlled oxygen concentrations (ppm level), fluorinated compounds such as SF6 or 3Ms Novec 612, etc. This 'reaction gas' could be included in COANDA flow, another intervention option, discussed infra.

As will be appreciated, the correct placement can be informed by simulation results from the predicting method based on the computer-assisted modeling as previously described. Here, again, the effectiveness of placement means that it is at least approximately at or near to a position in the modelled chamber. As will be appreciated by those skilled in the art, to be effective the placement can be approximate. But as will be further understood, modeling or evaluation of modelling can allow for quite specific dimensional resolution for a given chamber. For example, a critical zone upper and lower boundaries predicted by average liquidus and average solidus temperatures $T_l$ and $T_s$ respectively can be typically resolved to within plus or minus 6 inch(es) in the scale of chambers in the specific exemplary embodiments, which are between 1 ft. and 2 ft. diameter and between 8-10 ft. in height. Similar resolution is envisioned to be likely for larger scale chambers. But, further, effective placement refers just to predicting where in a chamber 16 an intervention should be placed. The modelling allows variation in input parameters to then predict the effectiveness of the invention relative to satelliting, which has been discussed earlier. Actual empirical testing can then be used to test actual effectiveness of anti-satelliting. Furthermore, once an intervention is positioned, whether in simulation or actual testing, further simulation or empirical testing of the invention in different positions from that original one can be used to optimize effectiveness of the invention.

Resolution is dictated both by grid size of the simulation and the accuracy of the heat transfer and solidification models used. Grid size is only limited by the total number of grid points that can be accommodated by the computational resources and time allotted to solve the problem. Using either a high-performance desktop system or high performance computing resources, the 2D axisymmetric case is not too computationally expensive to run and so grid resolution can be quite fine.

Ultimately, the question then becomes accuracy of the heat transfer and solidification models to predict the critical region successfully. For well-known materials (pure metals, well studied alloys, etc.) these models can be robust and provide a very reliable approximation of the critical satelliting region. For novel alloys with less thermophysical information known, these become less accurate overall. Thus, one skilled in the area of heat and mass transfer and thermodynamics should be able to make an informed decision as to the accuracy of the results and the appropriate 'safety factor' to place on the calculated critical satelliting region. The basis for proof-of-concept testing for this embodiment was focused on analyzing the effect of using multiple gas halos, 'traditionally' placed inside of the atomization chamber for the purpose of chamber cooling and powder passivation, on increasing or decreasing satelliting behavior for pure nickel atomization utilizing ultra-high purity argon as the atomizing gas and relied upon a gas die with 30-jets sized 0.082-inches in diameter at a 14° apex angle.

For both purposes of experimental investigation and CFD simulation of satelliting behavior due to the use of gas halos 40, atomization gas was supplied at 158 PSI. Liquid metal temperature was assumed to initiate at 1878 K at a flow rate of 0.164 kg/s which are typical for this gas die configuration and selected alloy. Two cases utilizing gas halos were explored utilizing the critical region predicting method discussed supra with experimental results provided for one of the prediction cases. First, a CFD study (per the critical region predicting method discussed supra) utilizing a single halo at various chamber heights was used to optimize the position for increased satellite reduction. Then, utilizing a series of four gas halos 40A, B, C, and D (as illustrated in FIG. 8A) typical of normal operation of this atomization apparatus was explored to understand the satellite formation pathways of the normal operation of this atomization apparatus.

As discussed above, the authors have previously used gas halos for introduction of chemically passivating gas species, to increase the particle cooling rate, and for cooling of the atomization chamber walls. The current effort demonstrates the first effort to utilize these supplemental gas halos for the purpose of mitigating satelliting on the powders. As can be seen from the modeling results, the 'traditional' configuration to maximize chamber and particle cooling actually yielded unfavorable results for satelliting, and the correct placement of a single halo actually proves to be a better implementation of this strategy. We include both cases in this document to illustrate the utility of the modeling approach coupled with the experimental validation. As noted, FIG. 8A is a schematic view of atomization apparatus utilizing a 2 foot spray chamber (e.g. the general type) and including various supplementary gas 'halos' 40 for increased cooling and satellite reduction objectives. Specifics regarding each halo are discussed infra.

Gas halos are essentially ring-shaped plenums 44 operatively connected to a pressurized fluid (gas phase) source 46 with multiple radially-inward pointing outlets or nozzles 42 around the ring which are oriented according to a specified angle relative to the direction of flow 41. The fluid source pressure can be controlled to modify the overall gas flow rate. The design of these gas halos can be as simple as bending a copper tube into a fixed diameter circle and drilling holes at a fixed angle around the entire length of the tubing and mounting it at the appropriate height inside the atomization spray chamber. Alternatively, the gas halos can consist of unique chamber sections with integrated gas plenums and tapped holes about the entire inner circumference of the gas plenum. Discrete gas jets at fixed angles can then be mounted to each tapped whole and can be designed with jets based upon the jet orifice size, spray angle, or other desired features. In general, the halos can be designed regarding number, orifice size, and nature so as to influence the "spray pattern" and coverage both individually and collectively. Examples of gas halos to inject reactive gases into a GA chamber are described at US Published Patent Application 2018/0133793A1, incorporated by reference herein, and at FIGS. 8B and C. Other examples of gas halos used for injection reactive gases into a GA chamber are shown and described at A U.S. Pat. Nos. 5,125,574 and 5,228,620. As will be well appreciated by those skilled in the art, the gas injectors of US Published Patent Application 2018/0133793A1, U.S. Pat. Nos. 5,125,574, and 5,228,620 would be modified according to principles of the exemplary embodiments. They would at least be positioned relative to the chamber height according to different criteria and the jet injection angle would be optimized relative to the product stream flow direction (generally between 45 to 90° inclined downwardly).

In contrast, the reactive gas injectors in the above-cited patents inject the reacting gas straight towards the center of the chamber to ensure maximum mixing of the reaction gas with the powders to passivate the surface. The halos used here use an angle of the gas jets either coflowing with the process stream or at a 45° angle inward.

As noted, this combination of halos 40 not only influence satellite mitigation at the critical region inside the chamber, but can also supplement cooling in other parts of the chamber. Such cooling can have at least the following benefits: (a) influencing particles to stay in the primary gas stream from the gas die to deter upward movement or recirculation to the critical region; (b) promote complete solidification of the droplets before collision with the chamber walls or the bottom. As will be appreciated by those skilled in the art, the specific form factor, number of openings, directions of jets (e.g. angle to a lateral plane through the chamber), gas source, and pressure can vary according to need. Typically, the design would at least be effective to promote droplet cooling and solidification.

b. Single Halo at Various Chamber Heights

CFD modeling of a single gas 'halo' 40 was investigated for two different positions (1 foot and 2 foot) downstream from the atomization region (illustrated by halo 'Beta' in FIG. 8A) and flowing 3.5 kg/min Ar gas. In practice, this halo would consist of a copper tube formed into a 2-foot ring and 80-0.029" holes angled 45° downstream drilled in order to cut off the flow of particles to satelliting.

As can be seen from the results of the CFD study in FIG. 9, the halo 40 located 1-foot below the gas die serves to limit the recirculation of powder up the chamber wall and isolates the flow path to the critical satelliting region. The halo 40 located 2-foot below the atomization region however creates an additional bottleneck in the chamber and encourages even greater recirculation of powders and increased satelliting. In this figure all values represent steady state flow conditions and $\alpha$ represents the time-averaged particle volume fraction, dp is the time-averaged mean particle diameter, and Tp is the time-averaged particle temperature.

As discussed above with reference to FIG. 9, computer modeling according to the previously discussed methodology, predicts that, for this particular set-up and operating conditions, the above-described gas halo at 1-foot below the gas die is better at reducing satelliting than at 2-foot below. This proof-of-concept can, of course, be used in analogous ways to investigate the same thing for other gas halo set-ups, other GA set-ups, and other operating conditions and parameters. It will be further be appreciated by those skilled in this technical area that modelling does not require high precision or resolution between compared set-ups and operating parameters to be effective. In this example, the comparison was between gas halo placement in just two locations and those locations were substantially spaced apart relative to the overall size of the chamber. Differences between one or more of the modelling results can be compared and contrasted, and decisions made as to gas halo placement between the two modeled placements according to need. In this example, the 1-foot below gas die 14 placement has clear predicted benefits regarding anti-satelliting.

But, importantly, proof-of-concept of the two position modelling can be extrapolated. For example, three, four, five, or more alternative halo placements can be modelled and the results compared. Theoretically, the number of placement options is unlimited. Using many possible placements, with differences just inches or factions of an inch apart, would allow much more minute resolution of analysis. Of course, there are also practical limitations on how many choices would be modeled and compared. Similarly, more choices and variability between choices could be modelled for the other variables of such systems. As mentioned, non-limiting examples include halo orifice diameter and direction, gas pressure and rate, gas source and characteristics. And, then, chamber and operating parameters can be varied. The modelling would allow relatively easy, efficient, and economical variation of many variables.

As such, from cruder comparisons between a limited number of choices, to much more refined resolution between many more choices, this aspect of the invention is shown to promote one or more objects of the invention, including identifying critical regions of almost any GA set up, and then help in selection of an intervention for the purposes of the invention.

c. Four Halos

CFD modeling of a case where four gas 'halos' 40 was investigated utilizing typical experimental heights and flows (illustrated in FIG. 8A). In this case, the 'Alpha' halo 40A consisted of a copper tube formed into a five-inch diameter ring an 60-0.029" holes drilled in it and was located one inch below the atomization die 14 and flowed Argon with ppm level oxygen as a reaction gas at 1.25 kg/min. 'Beta' halo 40B was a 2-foot diameter halo with 80 holes in a downward orientation located 36" downstream and ran Argon at 1.2 kg/min. 'Gamma' halo 40C was a 2-foot diameter halo with 80 holes in a downward orientation located 48" downstream and ran Helium at 1.5 kg/min. Finally, 'Delta' halo 40D was a 2-foot diameter halo with 80 holes oriented at 45° to encourage cooling of the reducer section and was located directly above the 2-foot to 1-foot reducer. This halo 40D had a flow rate of 1.5 kg/min. CFD results for this case are shown in FIG. 10. In this figure all values represent steady state flow conditions and α represents the time-averaged particle volume fraction, dp is the time-averaged mean particle diameter, and Tp is the time-averaged particle temperature. FIG. 11 shows typical powder morphology from the experimental validation of this case and reveals significantly more satelliting compared with Example 1.

FIG. 10 illustrates CFD results of the utilization of multiple gas halos 40 at various chamber 16 heights typical of normal operation of this atomization apparatus. Here α is the time-averaged particle volume fraction after reaching steady state flow conditions, colored with a log scale. Dp is the time-averaged mean particle diameter after reaching steady state flow conditions. Tp is the time-averaged particle temperature after reaching steady state flow conditions. FIG. 11 illustrates Ni Powder (45-106 μm) in a micrograph showing increased satelliting from 4-halo case. (ASC-1-37).

The proof-of-concept of FIGS. 10 and 11 demonstrate how the invention can be expanded to multiple possible variations of GA set ups, operating parameters, and interventions. Comparisons in the modeling can be used by the designer to select an intervention for a given GA set up and its operating parameters.

d. Example 4: Satellite Suppression Via Internal Particulate Filter & Coanda-Driven Gas Sheath Flow Injector Example 4 details a hybrid apparatus consisting of both active and passive methods of satellite reduction. This apparatus consists of a combination of (a) a Coanda-type surface 50 installed in the inside wall of the atomization chamber 16 in the critical region and (b) pressurized gas 54 injected so that it exits on the inner-facing Coanda surface 56/57 (see FIGS. 12D-E) creating a sheath flow around the primary atomization flows.

The Coanda effect is the tendency of a fluid jet emerging from an orifice to follow and adjacent flat or curved surface and to entrain fluid from the surroundings so that region of lower pressure develops. Examples of a Coanda surface with gas injection can be seen at U.S. Pat. No. 10,364,984 B2 and US 2013/0053796 A1, both incorporated by reference herein.

Specifics about the Coanda surface and gas injection used in this example are:

| Parameter | Specification |
|---|---|
| Atomization chamber 16 diameter and height | ~2 ft. by 10 ft. |
| Atomization flow rate and gas | 15 kg/min Argon gas |
| Gas die 14 orifice no., dia., and directional angle | 30 holes at 0.082" dia. and angled 14° downstream |
| Feedstock | Ni metal/metal alloy |
| Coanda surface 56/57 form factor dimensions | See enlargement at FIGS. 12C-E |
| Supplementary Coanda gas 54 flow rate and species | ~2-5 kg/min argon gas |
| Coanda gas die orifice no., dia., and directional angle | The Coanda gas inlet was an annular slit of .002" gap and was angled perpendicular to the flow. The Coanda surface forced the gas to turn 90° and flow parallel to the driving atomization flow. |

FIGS. 12A-F illustrate an apparatus utilizing active/passive hybrid approach toward satellite suppression. In particular, FIG. 12A is a schematic view of atomization apparatus and satellite suppression system using a porous filter 60/61 (60 represents the filter generally and 61 its filter media or type) and protective Coanda-driven gas sheath from Coanda device 50. FIG. 12B is a CAD drawing of apparatus with view-window illustrated for visualizing flow. FIG. 12C is a frontal vertical section of FIG. 12B. Furthermore, the device consists of porous filter media 61 on the top layer and a Coanda-driven gas sheath. The enlarged views of FIGS. 12B and C show details, and the inset enlargement of the Coanda surface 56/57 at FIG. 12C includes dimensions to understand the surface shape of this example.

The filter 60 of is shown also at FIG. 12C. Particulars of the medium 61 are:

| Parameter | Specification |
|---|---|
| Material | Stainless Steel |
| Type of filtering 61 | Either multi-layered fine mesh (#635 Mesh) screen or sintered metal filter material |
| Pore size | <20 um |

FIG. 13 illustrates simulation results for the internal particle filter 60/61 and Coanda 50-driven sheath satellite suppression system. In particular, α is the time-averaged particle volume fraction after reaching steady state flow conditions, colored with a log scale. Dp is the time-averaged mean particle diameter after reaching steady state flow conditions. Tp is the time-averaged particle temperature after reaching steady state flow conditions.

As can be seen in FIG. 13, the modeling clearly indicates how recirculation particles are blocked by the filter material 61 of the hybrid-Coanda device 50, recirculation particle flow passes the sidewall-side of the Coanda device 50 and enters the filter media 61, and that no appreciable particles (fines or ultra-fines of the type that cause satelliting) reenter the central top area of the chamber 16. FIG. 13 also shows the Coanda flow from the radially-inward-positioned Coanda annular surface 56 creates a flow sheath vertically downward for a distance radially outward from the primary gas die 14 jet stream. This sheath is substantially along the critical region 20. As such, it is an additional way to deter satellite-causing particles from entering the primary gas stream, particularly at the critical satelliting region. As shown in FIG. 13, the time-averaged particle volume fraction, α, illustrates the time averaged presence of solid/liquid material inside of a voxel of the simulated atomization chamber relative to process gas. For instance, the red area represents voxels mainly consisting of nickel metal, while the blue color represents voxels composed of gas-only. These results indicate the ability of the hybrid Coanda/filter system 50/60 to effectively mitigate the presence of fine particulate in the critical satelliting region 20 (as determined from the $T_p$ figure and knowledge of the solidification temperature for nickel). Furthermore, $d_p$ illustrates the time averaged mean particle diameter within the spray chamber 16. As can be seen, primarily fine powders are captured in the recirculation flows and driven to the top of the atomization chamber, but the intervention utilized here is able to minimize the transport of these powders into the critical satelliting region. Thus, addition of the Coanda device 50 with injected gas at this critical location is predicted to provide anti-satelliting benefits. As will be appreciated, the modelling variables could be varied to look for specific benefits for implementation in an actual set-up. But the Coanda and filter set up here can be implemented as illustrated. The Coanda surface 56/57 surrounds the gas die 14 in the critical zone 20, here at about 4 inches beneath the lateral plane through the distal end of the gas die 14 and spaced between the central chamber axis and the sidewall. The supplementary gas flow injected along the Coanda device is argon gas at approx. 2-5 kg/min rate. The injected gas would tend to form a cylindrical sheath around the initial region of the spray pattern 17.

In addition, the filter media 61 is interposed in the circulation pathway coming up from the bottom of the chamber 16 along the chamber walls. The media 61 would basically be a ring of 6-12 inches in diameter, and 0.005-0.25 inch thickness, placed at or above the Coanda device 50 and essentially intercepting at least most of the recirculation flow along the chamber wall. The filter characteristics are selected to balance a meaningful removal rating of the types of fines or ultra-fines that cause satelliting from the recirculation, but without substantially or negatively affecting yield from the GA by creating an undesired vacuum pressure condition inside of the atomization zone.

US Published Patent Application 2002/0125591 A1 issued Sep. 12, 2002 and US Published Patent Application 2008/0271568 A1 issued Nov. 6, 2008, each incorporated by reference here and patents by Dunkley (2008) and Praxair (2000), regard use of re-circulation gas for satellite suppression and recycle of process gas, respectively. These patents discuss commonly used methods and require either a blower or compressor to use the (Clean) recirculated process gas. Contrary to prior art, the uniqueness of the vacuum created from the atomization gas die and Coanda flow device, according to embodiments of the present invention, are sufficient to drive process gas recirculation.

FIGS. 12B-E give details regarding one form the Coanda device could take. Others are, of course possible, to the extent they work in analogous ways including effectiveness at reducing satelliting.

Several examples of filter media 61 and its characteristics are indicated in the table supra. As will be appreciated by those skilled in the art however, other filter media and set-ups that achieve desired or needed results are possible. For example, woven wire mesh, sintered powder metal filters, or similar. Different materials of construction and methods of fabrication of these materials are also included. A principal function of the filter media is to have an effective removal rating of the types of recirculating particles that can cause satelliting. By effective removal rating is meant at least removal of more such particles than without a filter.

FIG. 12F is a rough diagrammatic illustration of one form the filter media could take, interposed to intercept recirculation flow and particles and filter them out before they otherwise would be re-introduced into and reach the critical region along the chamber axis. Others are, of course possible, to the extent they work in analogous ways including effectiveness at reducing satelliting.

As noted, this combination of Coanda device and filtering not only influence satellite mitigation at the critical region inside the chamber, but can also supplement this anti-satelliting intervention with physical removal of particles that can cause satelliting. As will be appreciated by those skilled in the art, the specifics of the Coanda device and the filter can vary according to desire or need. Typically, the design would at least be effective to reduce satelliting.

One of the critical concepts is to not be restrictive of recirculation flow. Both the Coanda-flow AND the primary atomization gas create negative pressure regions which can drive particulate flow into the critical satelliting region. IF the filter restricts too much flow, then negative consequences may result and actually realize increased satelliting behavior.

e. Example 5: CFD Simulation-Based Engineering of a Typical Commercial Spray Chamber With reference to FIG. 14, another set of variables 90 can be modelled and evaluated for beneficial results, including for anti-satelliting. For example, variability in such factors as exhaust constrictions, chamber height, chamber diameter, and others can be easily, effectively, and efficiently introduced into the modeling methodology and evaluated in analogous ways to those discussed in the other examples.

The example of chamber diameter has been previously discussed in the context of prediction of a critical area for placement of an intervention, in particular, a gas halo or halos. But that was in the context of a specific type and set of GA set ups.

The present example indicates that, similarly, varying one or more of the typical physical characteristics of any GA set up can reveal predictions via the modeling methodology that can be beneficial for GA operation, including anti-satelliting. Even if such insights provide minor or even marginal improvements to anti-satelliting, it can still be highly beneficial. Even relatively small improvements to any of flowability, powder morphology, or other end product powder characteristics, as a result of an aspect or aspects of the invention can be significant.

In the example of chamber height, the following considerations are important. 1) Increased chamber height increases the global potential for powder cooling available in the chamber. 2) Increasing chamber height increases the number of localized recirculation eddy-flows and required number of turbulent flow pathways necessary in order to successfully navigate the global recirculation necessary to reach the critical satelliting region. Additionally, increased chamber height can serve to reduce the influence of the 'bottleneck' phenomena due to flow restrictions common in industrial atomizers due to the long Height:Diameter ratios. Of note, is that chamber height generally adds complexity to the setup and operation of an atomizer and may greatly increase the capital costs associated with a new system. Optimization of this chamber height is critical to obtaining the greatest benefit in minimizing recirculation while minimizing the costs and complexity of implementation. Other factors that could be used as variables are listed below:

Important Factors: Exhaust Constrictions, Height & Diameter of Chamber, Etc.

| Factor | Significance |
|---|---|
| Exhaust Constrictions | Chamber Diameter:Chamber Exit Diameter determines opposition to flow at the exit and is the driving force behind the flow bottleneck driven recirculation. |
| Chamber diameter | Determines the potential complexity of the flow-field inside of the atomization chamber. Highly complex, turbulent flows with an expansive extent to spread lead to requirement for different mitigations trajectories |

FIG. 14 illustrates an example simulation results of a commercial spray chamber with common design (e.g. a GA set up at least of the general type). In the example, instantaneous flow fields of combined calculation of atomized particle temperature and gas vertical velocity simulation after reaching steady state flow conditions. (b) time-averaged particle volume fraction after reaching steady state flow conditions, colored with a log scale. (c) time-averaged mean particle diameter after reaching steady state flow conditions. (d) time-averaged particle temperature after reaching steady state flow conditions.

f. Example 6: Coanda-Driven Gas Sheath Flows

With reference to FIGS. 15A-B, another or additional set of variables can be modelled and evaluated for beneficial results, including for anti-satelliting. For example, the source and content of the gas used to inject into the atomization chamber for intervention can be varied. This can be easily, effectively, and efficiently introduced into the modeling methodology and evaluated in analogous ways to those discussed in the other examples.

Example 6 relates to satellite suppression via external clean process gas recirculation and Coanda-driven gas sheath flows. It is similar to Example 4 of FIGS. 12A-F and 13 in its use of a Coanda device 50 with gas injection to create a controlled, directed gas flow into the atomization chamber. Its main differences are as follows.

This example is a modification of the Coanda/filter hybrid concept and simulation results should be similar in nature. The big difference in the application is the reliability of the process for an industrial adoption scenario. Either, the driven gas is cleaned internal to the atomization chamber due to the use of filters, or, the driven gas is cleaned via regular processes and recycled externally. The advantage of external gas recirculation is not having to worry about plugging of screens or filters and loss of effectiveness at different times during an atomization. As diagrammatically illustrated in FIG. 15B, a carefully directed co-flow of clean sheath flow gas using the Coanda surface of the Coanda device to reduce satelliting is created through the use of moderate-pressure gas injected along the Coanda profile as shown in FIGS. 12A-F, but instead of using recirculation of gas inside of the atomization chamber to meet the vacuum pressures created from the Coanda flow and atomization gas die flows, an external gas source 72 can be used—specifically, gas from recirculated (recycled), clean system gas. In this example, the Coanda gas injection uses the same process gas for GA as the gas source. A fraction of the total atomization gas flow used for the atomization process can be collected or diverted after removal of the metal powder and used to satisfy the vacuum pressure created along the inner-facing Coanda surface to set up sheath flow along but spaced from the primary gas die stream as in FIGS. 12A-F and 13.

To further describe, in this example, a moderate pressure gas source is used to direct gas onto the Coanda surface 56 to generate the anti-satelliting sheath flow. The typical GA set up creates low pressure around the gas die 14 (see the topmost "V" symbols in FIG. 15B). The top level "V's" are sheath flow from the jet 17 from the gas die 14 that produces the primary atomization stream in the chamber 16. The lower-most "V" symbols indicate low pressure from the Coanda surface 56 that helps set up the protective sheath 73 of Coanda device injected process gas. These flows are used to create the pressure differential which drives the flow of 'clean' recirculated gas from after the powder separation steps. This differs compared to other techniques that have been suggested to eliminate satellite formation which require pumps or blowers to supply the recycled gas flows to the top of an atomization chamber to try to suppress chamber recirculation of fine particulate that leads to satelliting. The middle "V's" are intended to indicate where the low pressure regions now exist in the atomization chamber 16 which create recirculation eddies outside of the protective sheath flow from gas flow from a passageway out of an upper plenum 76 that directs gas from a powder-free gas source onto the Coanda annular surface 56 around the primary gas flow 17 from the gas die 14. In this manner, the Coanda surface 56 receives gas flows from two sources; the gas flows from both the upper plenum 76 and the internal Coanda gas injections. Cumulatively these sources set up the protective sheath shown in FIG. 15B. Additionally, the gas can include a powder-free source 70/72 to further deter introduction into the chamber of any particles that could satellite.

Additionally, in this example the gas for Coanda sheath flow can be advantageously taken from sources available in conventional GA set-ups. Here the sources are from process gas used for the GA process and prior to a wet scrubber that generates its own pressure flow and is used in many typical GA set-ups. In this example, no additional sources are needed. The only major structural modification is (as shown in FIG. 15A) to add an upper plenum 76 with the passageway aligned with the Coanda surface 56, and a duct 72 between the wet scrubber and the upper plenum.

As will be appreciated, the powder-free gas via plenum 76 could be used alone (without the Coanda device 50 and its gas injection. The modelling technique according to the invention could be used to evaluate the same.

As noted, this combination of Coanda device and upper plenum gas flow to the Coanda device not only influence satellite mitigation at the critical region inside the chamber, but can work together to reduce satelliting. As will be appreciated by those skilled in the art, the specifics of the Coanda device, the upper plenum, and their cooperation can vary according to desire or need. Typically, the design would at least be effective to reduce satelliting.

g. Passive Baffles—Example 7

With reference to FIG. 16A, another or additional set of variables can be modelled and evaluated for beneficial results, including for anti-satelliting. For example, the type and characteristics of the surface or device placed into the critical region to alter flow and/or reduce satelliting can vary. This can be easily, effectively, and efficiently introduced into the modeling methodology and evaluated in analogous ways to those discussed in the other examples.

Example 7 relates to satellite suppression in a Pilot Scale Atomizer with 2 foot diameter chamber, as described supra, but utilizing one or more passive baffles 80.

By passive baffle, it is meant that a physical structure or apparatus that alters gas flow is installed or built-into the interior of the atomization chamber 16. FIG. 16B illustrates one non-limiting example.

One implementation of the baffle concept is to combine the benefit of the 1-foot chamber (illustrated above) while mitigating the risk of flake formation due to collision of un-solidified droplets with the chamber walls. Essentially, a 1-foot diameter tube can be mounted concentric to the atomization gas die 14 at the top of the chamber 16 in order to create a "narrow-chamber" baffle section 80. The length can be determined via analysis of the spray pattern 17 and selecting a length such that the spray will not impact the narrow baffle, thus eliminating the formation of flakes while minimizing localized recirculation inside of the baffle and preventing global recirculation of fines into the critical satelliting region. As can be appreciated, multiple baffles 80 of increasing diameter could be suspended with lengths corresponding to the greatest extent as not to impact the spray, if additional protection is needed further downstream as determined from the CAD analysis of critical satelliting regions inside of the atomization spray chamber.

In another implementation, rather than fixing the baffle directly to the chamber roof and creating a localized vacuum at the top of the baffle section, the baffle can be affixed to a clean recirculated gas supply plenum, similar to Example 6, in order to further reduce the chance of local recirculation driven satellite formation inside of the baffle.

As will be appreciated by those skilled in this technical area, air flow baffles are used in a wide variety of industries and applications to alter air or gas phase flow. One example is in commercial or residential refrigerators. Another is commercial or residential heating and air conditioning. In many of these uses, the baffles are aerodynamically engineered and emplaced to direct flow, including to set up air sheaths or curtains withing an enclosed space.

Similarly, in this example, these completely passive structures can be used to influence air sheaths or curtains at least similar to those created by the gas halos, Coanda devices, or plenums in the examples supra. For example, the baffle 80 of FIG. 16B would alter typical gas flow inside the atomization chamber at or near the gas die 14 in the critical region to set up a sheath or curtain that influences at least particles that could cause satelliting from either not recirculating back up the critical region, to cool and be less likely to satellite even if recirculated to the critical region, or to join with other particles and increase in size before recirculating up to the critical region.

Dimensional features of the baffle 80 of FIG. 16B are indicated in that figure and discussed herein. Other features or considerations for these types of baffles include: (1) diameter (e.g. relatively narrow) and (2) length (determined to avoid interaction with spray pattern in order to eliminate splat/flake formation).

As noted, this passive physical baffle 80 is designed to influence satellite mitigation at the critical region inside the chamber. As will be appreciated by those skilled in the art, the specifics of the baffle can vary according to desire or need. Typically, the design would at least be effective to reduce satelliting.

FIGS. 17A and B illustrate a non-limiting alternative passive baffle arrangement. It can be wider in diameter. It can be used in combination with the powder-free recirculation gas 72 as previously discussed with respect to earlier examples. This illustrates that variations are possible according to designer need or desire.

Bibliography For Section _IV.C.

[1] Consortium for Additive Manufacturing Materials (CAMM), "Strategic Roadmap for the Next Generation of Additive Manufacturing Materials," Nexight Group, December, 2015.

[2] H. Gong, K. Rafi, H. Gu, T. Starr and B. Strucker, "Analysis of defect generation in Ti—6Al—4V parts made using powder bed fusion additive manufacturing process.," *Additive Manufacturing*, Vols. 1-4, pp. 87-98, 2014.

[3] R. Cunningham, S. P. Narra, C. Montgrmery, J. Beuth and A. D. Rollet, "Synchrotron-Based X-ray Microtomography Characterization fo the Effect of Processing Variables on Porosity Formation in Laser Powder-Bed Additive Manufacturing of Ti—6Al—4V," *JOM*, vol. 69, no. 3, pp. 479-484, 2017.

[4] M. Averyanova, P. Bertrand and B. Verquin, "Studying the influence of initial powder characteristics on the properties of final parts manufactured by the selective laser melting technology," *J. Virtual and Physical Prototyping*, vol. 6, no. 4, pp. 215-223, 2011.

[5] E. Klar and J. W. Fesko, "Atomization," in *Metals Handbook - Ninth Edition*, Metals Park, Oh, American Society for Metals, 1984, pp. 25-51.

[6] I. E. Anderson and J. C. Foley, "Determining the Role of Surfaces and Interfaces in the Powder Metallurgy Processing of Aluminum Alloy Powders," *Surf. Interface Anal.*, vol. 31, pp. 599-608, 2001.

[7] W. J. Boettinger and J. H. Perepezko, "Fundamentals of Rapid Solidification," in *Rapidly Solidified Crystalline Alloys*, S. K. Das, B. H. Kear and C. M. Adam, Eds., Warrendale, PA, The Metallurgical Society, Inc, 1985, pp. 21-58.

[8] J. J. Dunkley and B. Telford, "Control of "Satellite" Particles in Gas Atomization," in *PM2TEC*, Orlando, 2002.

[9] "2017 PM Industry Roadmap: Technology update for the Powder Metallurgy Industry," Metal Powders Industry Federation, USA, 2017.

[10] W. Associates, "Wohlers Report 2013," Metal AM, 2013.

[11] T. M. Research, "Metal Powders for Additive Manufacturing Market to reach US $1,783.9 Million by 2025," 2018.

D. Options and Alternatives

As mentioned, the invention can take many forms and embodiments. The exemplary embodiments are just a few.

For example, variations obvious to those skilled in the art will be included within the invention.

A few additional examples are as follows:

1. GA Set-Ups

As discussed supra, the methodology of modeling for critical regions and effectiveness of interventions is described primarily in the context of the Pilot GA set up in a CC-HPGA of relatively small scale (e.g. ~1 or 2 foot chamber diameter) with processing parameters mentioned in those examples. But as appreciated, the methodologies and the intervention apparatus/methods can be applied similarly in analogous ways to other scales of such set-ups or to other GA set ups.

2. Modelling

As discussed supra, the methodology of modeling for critical regions and effectiveness of interventions is described primarily in the context of specific modelling selections, programs, and algorithms. But as appreciated, variations of the methodology can be applied similarly in analogous ways with other versions. FIGS. 2A-B, and other discussion of modelling herein are non-limiting examples.

3. Interventions

As discussed supra, the interventions are described primarily in the context of the Pilot GA set up in a CC-HPGA of relatively small scale (e.g. ~1 or 2 foot chamber diameter) with processing parameters mentioned in those examples, and gas halos, Coanda devices with gas injection, plenums with gas injection, or baffles. But as appreciated, the intervention apparatus/methods can be applied similarly in analogous ways to other scales of such set-ups or to other GA set ups, or different configurations for control of gas flow.

4. Filtering

As discussed supra, filtering to remove or decrease particles capable of satelliting as a part of or addition to other interventions are described primarily in the context of the filtering media of specific Example 4, supra. But as appreciated, the filtering apparatus/methods can be applied similarly in analogous ways by different filtering apparatus/methods.

5. Combinations of Features

As discussed supra, the methodology of modeling for critical regions and effectiveness of interventions can be used apart from the interventions and vice versa. They can be used together. The interventions can be used individually or in various combinations.

What is claimed is:

1. A method of operating a high-pressure gas atomization (GA) system to suppress satelliting in the production of particles of metal powders from droplets of an atomized spray of a feedstock in a flow path in a GA spray chamber comprising:

(a) for a given feedstock comprising a metal to be powderized into metal powder particles, proposing a first physical system set-up and a first set of operating parameters of the GA system to be used;

(b) identifying critical location(s) for potential satelliting in the GA spray chamber of the GA system by a computer simulation based on modelling of droplet cooling, particle movement, and process conditions for the first physical system set-up and the first set of operating parameters of step (a);

(c) evaluating the computer simulation and proposing a second physical system set-up and a second set of operating parameters of the GA system;

(d) operating the GA system using the second physical system set-up and the second set of operating parameters for yield of non-, low-, or reduced-satellited metal powder particles of the produced metal powder from the droplets of the atomized spray.

2. The method of claim 1 further comprising adding an anti-satelliting intervention into the system at or for the critical location(s) that were identified by the modeling.

3. The method of claim 2 wherein the anti-satelliting intervention comprises:

(a) one or more gas halos relative one or more of the identified critical locations; or (b) particle filters and Coanda-driven gas sheath flow relative one or more of the identified critical locations; or (c) external clean process gas recirculation and Coanda-driven gas sheath flow relative one or more of the identified critical locations; or (d) one or more internal baffles to divert a circulation flow in or to the flow path or to protect a molten or semi-molten region of the atomized spray in the spray chamber.

4. The method of claim 1 wherein the computer simulation comprises:

(a) droplet cooling and solidification modelling for a given feedstock and GA set-up; and (b) Lagrangian particle tracking simulations.

5. The method of claim 1 wherein the identification of critical location(s) comprises identifying an average solidus temperature location in the atomized droplet spray from the computer simulation relative to a given GA chamber set-up.

6. The method of claim 5 wherein the average solidus temperature is correlated to a GA set-up chamber location.

7. The method of claim 1 wherein the computer simulation is applied to at least one of:

(a) design of a GA set-up;

(b) design of operating parameters of a GA set-up;

(c) evaluation of a GA set-up operation; and (d) tuning of operation parameters of a GA set-up.

8. The method of claim 7 applied to one of:

(a) a GA set-up to be manufactured; and (b) retrofit of an existing GA set-up.

9. The method of claim 1 further comprising using the GA system in the production of metal powders, wherein the physical set-up of the GA system comprises (a) a spray chamber size and shape, (b) an atomization die diameter, and (c) an atomization pressure.

10. The method of claim 9 wherein the metal powders are used for additive manufacturing or additive printing.

11. The method of claim 1 further comprising proposing one or more subsequent physical system set-ups and/or subsequent sets of operational parameters different from the second physical system set-up and/or the second set of operational parameters.

12. The method of claim 11 further comprising using the GA system with one of the one or more subsequent physical set-ups and/or subsequent sets of operational parameters.

13. The method of claim 1 wherein the identification of critical locations relates to one or more of: (a) particle volumetric fraction estimation in the simulations for particles formed in the spray chamber, (b) particle temperature during flow in the spray chamber, and (c) particle diameter during flow in the spray chamber.

14. The method of claim 1 wherein the computer simulation includes restrictions on computational domain and/or boundary conditions of the modelled spray chamber and operating conditions to reduce computational overhead.

15. The method of claim 1 wherein the operating of the GA system comprises testing the metal powder for flowability and compaction.

16. The method of claim 1 wherein the computer simulation comprise displayable visualizations of the GA set-up and processing of the droplets into particles in the set-up.

17. The method of claim 1 wherein the second physical system set-up and the second set of operating parameters comprises:

(1) addition of an anti-satelliting intervention into the physical set up of the GA system and no anti-satelliting adjustment to the first set of operating parameters of the GA system, (2) an anti-satelliting adjustment to the first set of operating parameters of the GA system and no addition of an anti-satelliting intervention into the physical set up of the GA system, or (3) addition of an anti-satelliting intervention into the physical set up of the GA system and an anti-satelliting adjustment to the first set of operating parameters of the GA system.

* * * * *